US008261844B2

(12) United States Patent
Itano et al.

(10) Patent No.: US 8,261,844 B2
(45) Date of Patent: Sep. 11, 2012

(54) FIRE EXTINGUISHER

(75) Inventors: Naoki Itano, Kobe (JP); Koichiro Mizoguchi, Kobe (JP)

(73) Assignee: Air Water Safety Service Inc., Hyogo (JP)

( * ) Notice: Subject to any disclaimer, the term of this patent is extended or adjusted under 35 U.S.C. 154(b) by 868 days.

(21) Appl. No.: 11/992,095

(22) PCT Filed: Oct. 13, 2006

(86) PCT No.: PCT/JP2006/320511

§ 371 (c)(1),
(2), (4) Date: Mar. 14, 2008

(87) PCT Pub. No.: WO2007/043671

PCT Pub. Date: Apr. 19, 2007

(65) Prior Publication Data

US 2009/0260839 A1 Oct. 22, 2009

(30) Foreign Application Priority Data

Oct. 13, 2005 (JP) ..... P2005-299447

(51) Int. Cl.
*A62C 35/58* (2006.01)

(52) U.S. Cl. ..... 169/85; 169/78

(58) Field of Classification Search ..... 169/85, 169/71, 77, 75, 78; 239/303, 311, 337
See application file for complete search history.

(56) References Cited

U.S. PATENT DOCUMENTS

| | | | | |
|---|---|---|---|---|
| 4,390,069 | A * | 6/1983 | Rose, Jr. | 169/15 |
| 5,086,846 | A * | 2/1992 | Carlson | 169/15 |
| 5,623,995 | A * | 4/1997 | Smagac | 169/30 |
| 6,016,874 | A * | 1/2000 | Bennett | 169/77 |
| 6,112,822 | A * | 9/2000 | Robin et al. | 169/46 |
| 6,155,351 | A * | 12/2000 | Breedlove et al. | 169/14 |
| 6,267,183 | B1 * | 7/2001 | Smagac | 169/30 |
| 6,543,547 | B2 * | 4/2003 | Neumeir et al. | 169/30 |
| 6,763,894 | B2 * | 7/2004 | Schoenrock et al. | 169/47 |

FOREIGN PATENT DOCUMENTS

| | | |
|---|---|---|
| JP | 60-012727 | 1/1985 |
| JP | 60-027172 | 2/1985 |
| JP | 02-032217 | 2/1990 |
| JP | 2000-140143 | 5/2000 |
| JP | 2001-187165 | 7/2001 |
| JP | 2001-333215 | 11/2001 |
| JP | 2002-102377 | 4/2002 |
| JP | 2003-190314 | 7/2003 |

* cited by examiner

*Primary Examiner* — Davis Hwu

(74) *Attorney, Agent, or Firm* — Harness, Dickey & Pierce, P.L.C.

(57) ABSTRACT

A lightweight fire extinguisher is disclosed. In one embodiment, the fire extinguisher, which is portable, includes a press-source fluid container capable of retaining compressed air; extinguishant containers capable of retaining extinguishant; a pressure-source fluid tube connected to the pressure-source fluid container and the extinguishant containers, for leading the compressed air retained in the pressure-source container to the extinguishant containers; a pressure reducing valve intervening in the pressure-source fluid tube, for reducing pressure of the compressed air flowing down the pressure-source fluid tube; discharge device capable of discharging the extinguishant retained in the extinguishant containers; and an extinguishant tube connected to the extinguishant containers and the discharge device, for leading the extinguishant retained in the extinguishant containers to the discharge device.

18 Claims, 43 Drawing Sheets

FIRE EXTINGUISHER

TECHNICAL FIELD

The present invention relates to a fire extinguisher which discharges extinguishant retained in a container using compressed fluid and extinguishes a fire with the extinguishant.

BACKGROUND ART

A first related art is disclosed in Japanese Unexamined Patent Publication JP-A 2000-140143. A fire extinguisher of the first related art includes an air cylinder which is filled with compressed air, and a liquid tank which is filled with a fire extinguishing liquid, the air cylinder and the liquid tank being communicated with each other. The fire extinguisher further includes a jet gun for spraying the fire extinguishing liquid in the form of mist. The jet gun is connected to the liquid tank by way of a spraying hose through which the fire extinguishing liquid is led by inner pressure of the liquid tank. The jet gun has an on-off valve and a spout nozzle, and is capable of spraying the led fire extinguishing liquid in the form of mist from the spout nozzle by switching the on-off valve to an open state. In the fire extinguisher, a breathing apparatus is further provided. In the fire extinguisher thus configured, compressed air of 5 MPa or more and 30 MPa or less fed to the air cylinder is led into the liquid tank, and the compressed air causes the fire extinguishing liquid to be delivered by pressure to the jet gun and be sprayed in the form of mist from the jet gun.

A second related art is disclosed in Japanese Unexamined Patent Publication JP-A 2003-190314. A two-fluid fire extinguisher of the second related art includes: an air cylinder which is filled with compressed air; a liquid supply source capable of supplying a pressurized liquid; a two-fluid nozzle for spraying in the form of mist a mixture of the compressed air and the pressurized liquid; an air hose for leading the compressed air to the two-fluid nozzle, which is connected to the air cylinder and the two-fluid nozzle; and a liquid hose for leading the pressurized liquid to the two-fluid nozzle. In the two-fluid fire extinguisher thus configured, the compressed air led from the air cylinder and the pressurized liquid led from the liquid supply source are mixed in the two-fluid nozzle and then sprayed in the form of mist.

In the fire extinguisher of the first related art, the compressed air of 5 MPa or more and 30 MPa or less is led from the air cylinder into the liquid tank, whereby water can be sprayed in the form of mist from the spout nozzle. Since the compressed air of 5 MPa or more and 30 MPa or less is led into the liquid tank, the liquid tank needs to have sufficient resistance against the pressure. In order to provide such resistance, the liquid tank needs to be thick-walled, which causes the liquid tank to have a larger weight, resulting in an increase in a weight of the fire extinguisher.

If the pressure of the compressed air is lowered to a level below the range disclosed in the first art in order to have the liquid tank thin-walled, the extinguishant will be sprayed in a decreased amount and therefore fail to be sprayed in dense mist, which failure makes it difficult to enhance fire-extinguishing efficiency. It is therefore difficult in the fire extinguisher of the first related art, to take advantage of the decrease in the pressure of the compressed air for obtaining a thinner-walled configuration.

In the two-fluid fire extinguisher of the second related art, the compressed air contained in the air cylinder and the liquid fed from the liquid supply source are mixed in the two-fluid nozzle to form misty water which is then sprayed to a to-be-extinguished object. By spraying the misty water as above, a fire on the to-be-extinguished object is extinguished. In the two-fluid fire extinguisher, the compressed air and the liquid are mixed to form the misty water, in which process a large amount of the compressed air is required. If an amount of the compressed air contained in the air cylinder is small, a length of spray time is short, which causes a difficulty in extinguishing fire sufficiently. It is therefore necessary to increase a capacity of the air cylinder in order to extend the length of spray time. Such an increase in the capacity of the air cylinder inevitably accompanies an increase in a weight thereof, with the result that the fire extinguisher becomes larger in weight.

DISCLOSURE OF INVENTION

An object of the invention is to provide a lightweight fire extinguisher.

The invention provides a fire extinguisher comprising:

a pressure-source fluid container capable of retaining compressed pressure-source fluid;

an extinguishant container capable of retaining extinguishant;

a pressure-source fluid tube connected to the pressure-source fluid container and the extinguishant container, for leading the pressure-source fluid retained in the pressure-source container to the extinguishant container;

pressure reducing means intervening in the pressure-source fluid tube, for reducing pressure of pressure-source fluid flowing down the pressure-source fluid tube;

discharge means capable of discharging the extinguishant retained in the extinguishant container; and an extinguishant tube connected to the extinguishant container and the discharge means, for leading the extinguishant retained in the extinguishant container to the discharge means.

According to the invention, the pressure-source fluid retained in the pressure-source fluid container is depressurized by the pressure reducing means and led to the extinguishant container through the pressure-source fluid tube. The extinguishant retained in the extinguishant container is pressurized by the led pressure-source fluid to be ejected from the extinguishant container to the extinguishant tube. The ejected extinguishant is then led to the discharge means through the extinguishant tube. A fire extinguisher wearer uses the discharge means to discharge the extinguishant thus led, thereby putting out a fire.

Further, in the invention, it is preferable that the pressure reducing means is a pressure control valve for reducing the pressure of the pressure-source fluid and maintaining the pressure constant.

According to the invention, a pressure-source fluid having a pressure maintained constant by the pressure control valve can be led to the extinguishant container. A flow volume of the extinguishant ejected from the extinguishant container to the extinguishant tube can be maintained constant regardless of a remaining amount of the pressure-source fluid.

Further, in the invention, it is preferable that the fire extinguisher further comprises gas supply means which is connected to the pressure reducing means and is capable of supplying the pressure-source fluid depressurized by the pressure reducing means, and the pressure-source fluid retained in the pressure-source fluid container is mixture gas containing at least oxygen.

According to the invention, mixture gas containing at least oxygen can be depressurized by the pressure reducing means and supplied by the gas supply means. The wearer can therefore breathe the mixture gas supplied by the gas supply means.

Further, in the invention, it is preferable that back flow prevention means which intervenes in the pressure-source fluid tube and prevents the extinguishant from flowing back in the pressure-source fluid tube from the extinguishant container toward the pressure-source container, is provided downstream of the pressure reducing means in a direction that the pressure-source fluid flows down.

According to the invention, the back flow prevention means can stop the extinguishant flowing from the extinguishant container toward the pressure-source fluid container, at a position downstream of the pressure reducing means in the flow direction. The extinguishant can be therefore prevented from flowing backward to the pressure reducing means.

Further, in the invention, it is preferable that the fire extinguisher further comprises down flow prevention means which intervenes in the extinguishant tube and prevents the pressure-source fluid from flowing down the extinguishant tube.

According to the invention, the pressure-source fluid can be prevented from flowing down the extinguishant tube to the discharge means by the down flow prevention means. The pressure-source fluid can be thus prevented from being discharged from the discharge means.

Further, in the invention, it is preferable that the fire extinguisher further comprises excessive flow prevention means which intervenes in the pressure-source fluid tube and prevents the pressure-source fluid from flowing down the pressure-source fluid tube when a flow volume of the pressure-source fluid flowing down the pressure-source tube reaches a predetermined flow volume or more.

According to the invention, the excessive flow prevention means intervenes in the pressure-source fluid tube. The excessive flow prevention means prevents the pressure-source fluid from flowing down the pressure-source fluid tube when the flow volume of the pressure-source fluid flowing down the pressure-source tube reaches the predetermined flow volume or more. The pressure-source fluid can be prevented from being wasted.

Further, in the invention, it is preferable that the extinguishant is a flame retardant aqueous solution having a resin dissolved, which resin becomes higher in viscosity as a temperature rises.

According to the invention, the aqueous solution having the resin dissolved is used as the extinguishant, which resin has higher viscosity as its temperature rises. As a result, the extinguishant discharged toward the to-be-extinguished object will have a higher temperature and therefore higher viscosity. The extinguishant having higher viscosity is less flowable as compared to water, with the result that the extinguishant attached to the to-be-extinguished object can be therefore prevented from flowing, etc., and thus being spread out. Further, the temperature of the extinguishant flowing down the extinguishant tube is lower than that of the discharged extinguishant, resulting in lower viscosity which allows for a decrease in the pressure required for delivering the extinguishant to the discharge means through the extinguishant tube.

Further, in the invention, it is preferable that the fire extinguisher further comprises a frame for arranging the pressure-source fluid container and the extinguishant container, and the frame is configured to hold the pressure-source fluid container and the extinguishant container upright.

According to the invention, the pressure-source fluid container and the extinguishant container are held upright by the frame on which the pressure-source fluid container and the extinguishant container are arranged.

BRIEF DESCRIPTION OF DRAWINGS

Objects, features, and advantages of the invention will be more explicit from the following detailed description taken with reference to the drawing wherein.

BEST MODE FOR CARRYING OUT THE INVENTION

Figure 1:
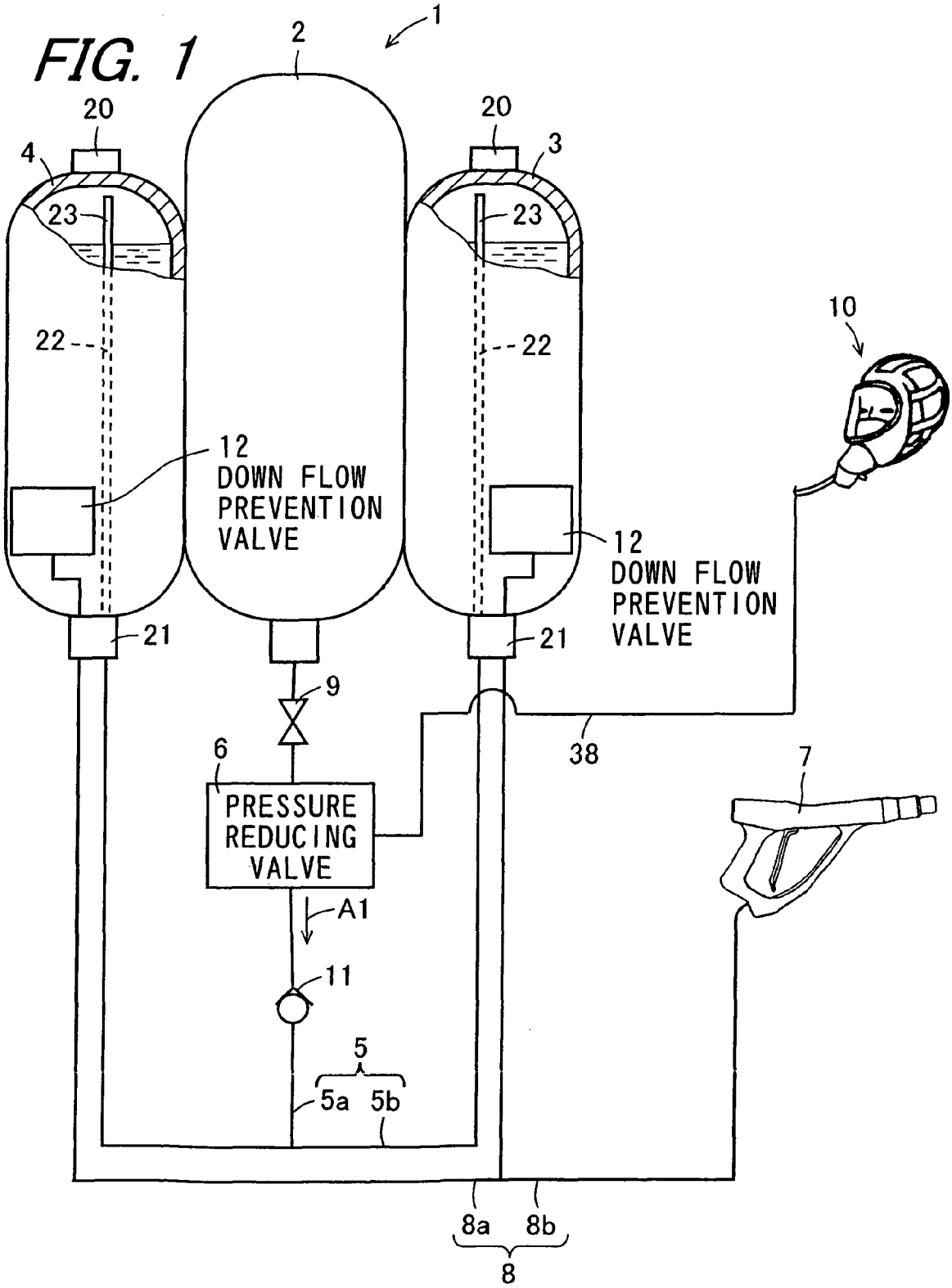
FIG. 1 is a system diagram schematically showing a configuration of a fire extinguisher 1 according to a first embodiment of the invention.

Now referring to the drawings, preferred examples of the invention are described below.

A plurality of embodiments for carrying out the invention will be hereinafter described in reference to the drawings. In each of the embodiments, parts corresponding to matters already described in the preceding embodiments may be denoted by the same reference numerals, and overlapping descriptions may be omitted. In the case where only a part of a configuration is described, the other part of the configuration is the same as that described in the preceding embodiments. It is possible to not only combine parts described in embodiments with each other but also combine embodiments partially with each other.

Figure 2:
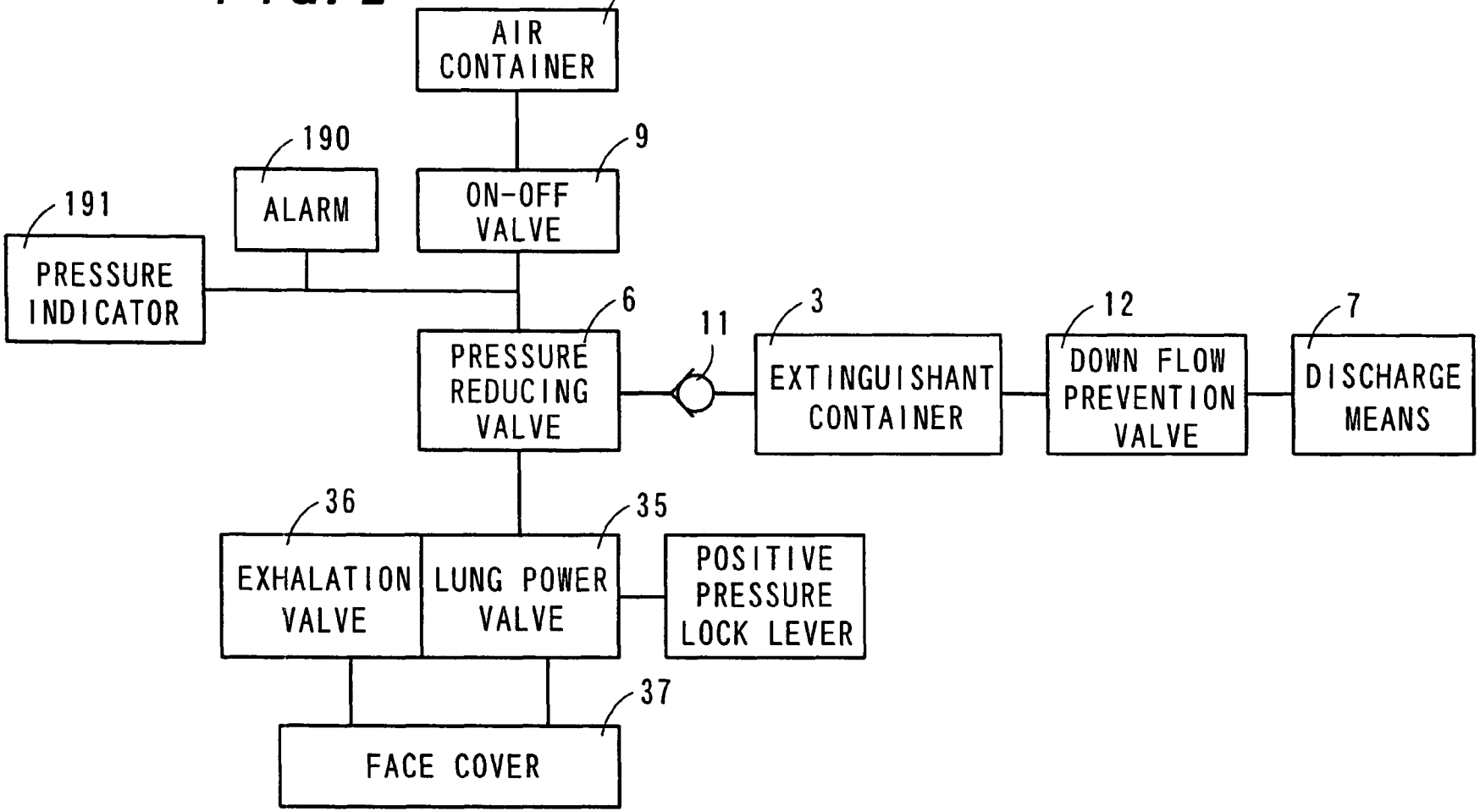
FIG. 2 is a block diagram showing a configuration of the fire extinguisher 1.
Figure 3:
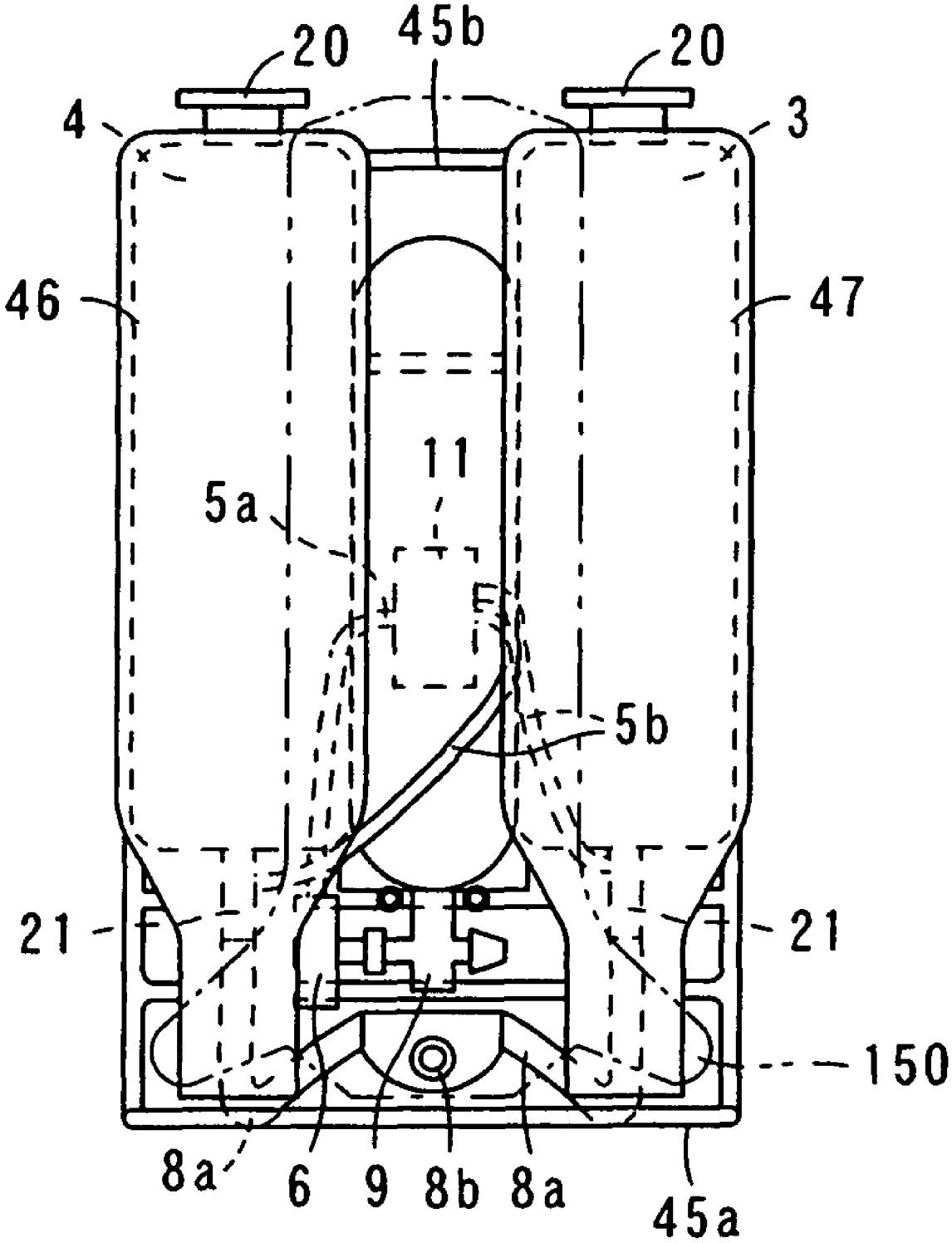
FIG. 3 is a front view showing the fire extinguisher 1.

FIG. 1 is a system diagram schematically showing a configuration of a fire extinguisher 1 according to a first embodiment of the invention. FIG. 2 is a block diagram showing a configuration of the fire extinguisher 1. FIG. 3 is a front view showing the fire extinguisher 1. The fire extinguisher 1 is a portable fire extinguisher which is used to extinguish a fire on a to-be-extinguished object such as a house, furniture, or an electronic device. The fire extinguisher 1 is configured to be portable when put on a person or when carried by a vehicle, for example. The fire extinguisher 1 is configured to be capable of ejecting extinguishant with the aid of compressed air to thereby discharge the extinguishant to a to-be-extinguished object, thus allowing for fire extinction. In the present embodiment, the fire extinguisher 1 is configured so as to be carried on the back of the fire extinguisher wearer, thus being portable.

The fire extinguisher 1 includes a pressure-source fluid container 2, two extinguishant containers 3 and 4, a pressure-source fluid tube 5, a pressure reducing valve 6, an extinguishant tube 8, discharge means 7, an on-off valve 9, a breathing apparatus 10, a back flow prevention valve 11, a down flow prevention valve 12, a container holder 13, an alarm 190, and a pressure indicator 191.

The pressure-source fluid container 2 is configured to be capable of retaining compressed pressure-source fluid, i.e., compressed air, and filled with the compressed air. The pressure-source fluid container 2 is filled with the pressure-source fluid of 29.4 MPa or 14.7 MPa. The pressure-source fluid container 2 is formed of a glass fiber-made FRP-aluminum alloy or a carbon fiber-made FRP (fiber-reinforced plastic)-aluminum alloy, for example. Note that materials are not limited to those as above. The pressure-source fluid container 2 is formed into a substantially cylindrical shape that has one end closed and the other end open in an axial direction, in which open end the on-off valve 9 is provided.

The two extinguishant containers 3 and 4, which are configured to be capable of retaining extinguishant, retain the extinguishant therein. The extinguishant containers 3 and 4 are made of stainless steel, for example. Note that materials of the extinguishant containers 3 and 4 are not limited to the above and may be a resin. The two extinguishant containers 3 and 4 are formed into a substantially cylindrical shape, each of which has both ends open in an axial direction such that an opening at one end is sealed by a lid 20 while an opening at the other end is provided with an assembled tubing 21. In the present embodiment, the two extinguishant containers 3 and 4 are identical with each other in shape and configuration.

The extinguishant is an aqueous solution which is flame retardant and in which is dissolved a resin that becomes higher in viscosity as a temperature rises. The resin is water-soluble acrylamide resin, for example, and to be specific, a resin containing N-isopropylacrylamide as a main ingredient. Note that the resin is not limited to the resin exemplified above and may be any resin as long as it is flame retardant and becomes higher in viscosity as a temperature rises.

The pressure-source fluid tube 5 is made of an NBR (butadiene-acrylonitrile copolymer)-based synthetic resin, for example, and connected to the pressure-source fluid container 2 and the two extinguishant containers 3 and 4 so that the compressed air in the pressure-source fluid container 2 can be led to the respective extinguishant containers 3 and 4. In the embodiment, the pressure-source fluid tube 5 is connected to the pressure-source fluid container 2 by way of the on-off valve 9. Note that a material of the pressure-source fluid tube 5 is not limited to the above material. A direction that the compressed air flows down from the pressure-source fluid container 2 to the extinguishant containers 3 and 4 will be hereinbelow referred to as an A1 direction.

To explain specifically, the pressure-source fluid tube 5 has a first pressure-source fluid tube portion 5*a* and a second pressure-source fluid tube portion 5*b*. The first pressure-source fluid tube portion 5*a* has one end connected to the on-off valve 9 and the other end continuing into a middle part of the second pressure-source fluid tube portion 5*b*. The second pressure-source fluid tube portion 5*b* has one end continuing into one extinguishant container 3 and the other end continuing into the other extinguishant container 4.

Figure 4:
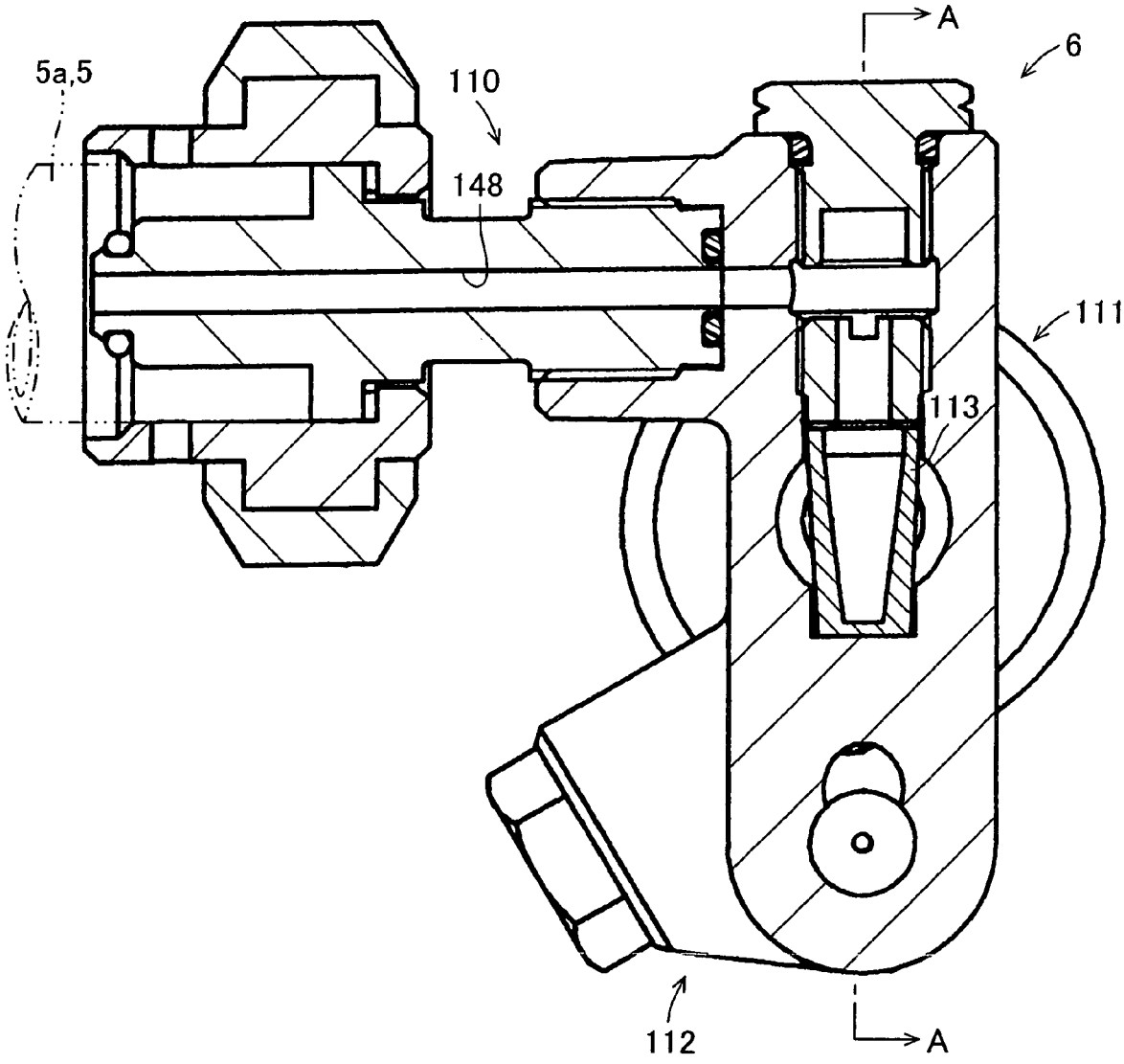
FIG. 4 is a plan sectional view showing a pressure reducing valve 6.
Figure 5:
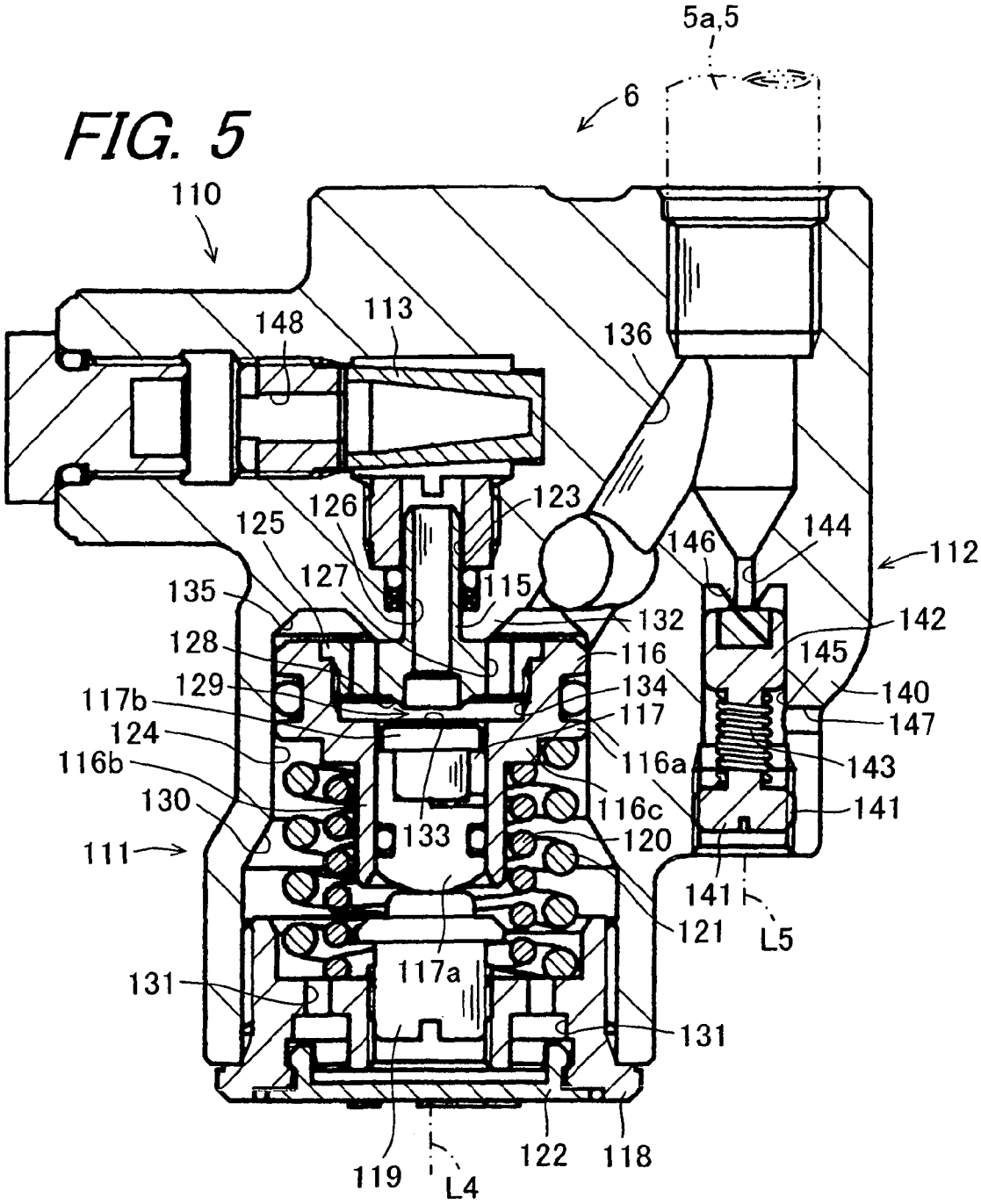
FIG. 5 is a sectional view showing the pressure reducing valve 6 taken on line A-A in FIG. 4.

FIG. 4 is a plan sectional view showing the pressure reducing valve 6. FIG. 5 is a sectional view showing the pressure reducing valve 6 taken on line A-A in FIG. 4. To explain with reference to FIGS. 1 to 3, the pressure reducing valve 6 serving as pressure reducing means as well as being a pressure control valve is made of aluminum or brass, for example, and intervenes in the first pressure-source fluid tube portion 5*a* so as to reduce pressure of the compressed air flowing down the pressure-source fluid tube 5. In the embodiment, the pressure reducing valve 6 is a pressure control valve for lowering to 0.7 MPa, for example, the pressure of the compressed air flowing down the pressure-source fluid tube 5 and maintaining the pressure constant. Note that the pressure reducing valve 6 is not limited to a valve which reduces the pressure to 0.7 MPa, nor limited to a valve having such a configuration as to maintain the pressure constant. Furthermore, the pressure reducing valve 6 is not limited to a valve made of aluminum or brass.

To explain more in detail, the pressure reducing valve 6 has a compressed-air passage forming section 110, a pressure control valve section 111, and a safety valve section 112, which are integrally formed. In the compressed-air passage forming section 110, a compressed-air passage 148 is formed. The compressed-air passage 110 has a filter 113 intervening therein for filtering compressed air flowing down the compressed-air passage 110. The pressure control valve section 111 includes a housing portion 114, a primary port forming part 115, a pressure receiving member 116, a valve element 117, a closing member 118, a valve element adjusting member 119, a first spring member 120, a second spring member 121, and a lid part 122.

The housing portion 114 has an axis line L4 and is provided with a first space 123 and a second space 124 which are formed around the axis line L4. The first space 123 is formed so as to have a smaller diameter than that of the second space 124. The first space 123 and the second space 124 continue into each other. In the housing portion 114, the first space 123 is formed on an axially one end side while the second space 124 is formed on the axially other end side. In the housing portion 114, the first space 123 continues into the compressed-air passage 148 and has its axially other end open in the axial direction. The housing portion 114 is provided with a ring-shaped protrusion 132 encompassing an outer periphery of an opening through which the first space 123 faces the second space 124.

The primary port forming part 115 is formed into a cylindrical shape and over an entire length of outer periphery on its axially one end, an outward flange part 125 is formed which protrudes radially outward. The primary port forming part 115 has an axis line which is identical to the axis line L4. An inner periphery of the cylindrical part of the primary port forming part 115 defines a primary port 126. In the outward flange part 125, a plurality of communication channels 127 are formed around the axis line L4. The primary port forming part 115 is hermetically provided in the housing portion 114 in a manner that a part of the primary port forming part 115 other than the outward flange part 125 is housed in the first space 123.

The pressure receiving member 116 has an outward flange housing part 116*a* and a valve element housing part 116*b*. The outward flange housing part 116*a* is formed into a cylindrical shape and has an inner periphery onto which the outward flange part 125 is threaded. The outward flange housing part 116*a* is housed in the second space 124 as being hermetically provided in the housing portion 114. The outward flange part 125 is slidably displaceable in a direction parallel to the axis line L4, and hermetically provided in the housing portion 114.

The valve element housing part 116*b* is of a cylindrical shape of which outer diameter and inner diameter are smaller than those of the outward flange housing part 116*a*. The outward flange housing part 116*a* and the valve element housing part 116*b* have the common axis which is identical to the axis line L4, and are integrally formed. A flange-shaped first spring member support 116*c* is formed over an entire length of an outer periphery of the valve element housing part 116*b* at an end thereof continuing into the outward flange housing part 116. The first spring member support 116*c* is formed so as to have an outer diameter which is smaller than the outer diameter of the outward flange housing part 116*a*.

The valve element 117 has a seat holding part 117*a* and a seat part 117*b*. The seat holding part 117*a* is formed into a cylindrical shape and has an axially one end to which the seat part 117*b* is fitted. The seat part 117*b* is formed into a substantially cylindrical shape. The valve element 117 is hermetically housed in an inner space of the valve element housing part 116*b*. The seat holding part 117*a* and the seat part 117*b* each have its axis which is identical to the axis line L4. In the primary port forming part 115, a ring-shaped valve seat 128 is formed so as to encompass an opening of the primary port 126 which opening faces the seat part 117*b*. The seat part 117*b* forms the valve seat 128 and an orifice 129.

The housing portion 114 has an opening into which the closing member 118 is threaded, thus being closed. The closing member 118 is formed into a cylindrical shape and has an inner periphery onto which the valve element adjusting member 119 is threaded. The valve element adjusting member 119 is formed into a substantially cylindrical column shape and threaded to the closing member 118 so as to be capable of contacting the axially other end of the seat holding part 117*a*. The valve element adjusting member 119 has an axis which is identical to the axis line L4. The axially other end of the seat holding part 117*a* is formed so as to be partially spherical in order to prevent uneven contact of the valve element adjusting member 119. When rotated by a tool such as a screwdriver, the valve element adjusting member 119 can be displaced in the direction parallel to the axis line L4 so that a movable range of the valve element 117 can be adjusted.

The first spring member 120 is a helical compression spring and mounted on the valve element housing part 116*b* from the outside so as to be arranged in a ring-shaped spring housing space 130 formed between the valve element housing part 116*b* and the housing portion 114. The first spring member 120 has one end supported by the first spring member support 116*c* and the other end supported by the closing member 118. The second spring member 121 is a helical compression spring and mounted on the first spring member 120 from the outside so as to be housed in the spring housing space 130. The second spring member 121 has one end supported by the outward flange housing part 116*a* and the other end supported by the closing member 118. In the closing member 118, an atmosphere open hole 31 is formed so that the spring housing space 130 is open to the atmosphere. Further, the lid part 122 for covering the valve element adjusting member 119 is fitted to the closing member 118.

In the configuration as above, a primary pressure chamber 133 is formed radially inward of the orifice 129 and a first secondary pressure chamber 134 is formed radially outward of the orifice 129. A ring-shaped second secondary pressure chamber 135 is formed radially outward of the protrusion 132 of the housing. The first and second secondary pressure chambers 134 and 135 are communicated with each other through the communication channels 127 and constitute the secondary pressure chamber. In the housing portion 114, a secondary port 136 is formed which continues into the second secondary pressure chamber 135.

The compressed fluid flowed from the primary port 126 down into the primary pressure chamber 133 passes through the orifice 129 and flows into the first secondary pressure chamber 134. The compressed fluid in the first secondary pressure chamber 134 flows down into the second secondary pressure chamber 135 through the communication channels 127. The pressure receiving member 116 receives the pressure of the compressed air in the first and second secondary pressure chambers 134 and 135. The first and second spring members 120 and 121 are arranged so that the pressure receiving member 116 is biased by elastic force which counters the pressure received as above. In accordance with the pressure thus received, that is, the pressure of the compressed air on the secondary side, the pressure receiving member 116 is slidably displaced in the housing portion 114 to thereby adjust an opening degree of the orifice 129. The compressed air is depressurized and maintained at constant pressure, then being discharged to the secondary port 136.

The safety valve section 112 has an axis line L5 and includes a housing portion 140, a spring holding member 141, a safety valve element 142, and a safety valve spring member 143. In the housing portion 140, a valve hole 144 and a safety valve housing hole 145 are each formed around the axis line L5. The valve hole 144 continues into the secondary port 136 and the safety valve housing hole 145 and is formed so as to have a smaller diameter than that of the safety valve housing hole 145. In the housing portion 140 is formed a ring-shaped safety valve seat 146 encompassing an opening of the valve hole 144 which opening faces the safety valve housing hole 145. The housing portion 140 has a part open on an axially one side, that is, on an opposite side to the secondary port, and into the open part is threaded the spring holding member 141. In the safety valve housing hole 145, the safety valve element 142 is housed so as to be slidably displaceable in a direction parallel to the axis line L5. The safety valve element 142 is slidably displaced to thereby move to contact the safety valve element 146 and away from the safety valve element 146. The safety valve spring member 143 intervenes between the safety valve element 142 and the safety element spring member 143, and biases the safety valve element 142 with elastic force in such a direction as to contact the safety valve seat 146. In the housing portion 140 is formed an atmosphere open hole 147 for letting the safety valve housing hole 145 be open to the atmosphere. In the safety valve section 112, when the pressure inside the secondary port 136 reaches the predetermined pressure or more, the separation from the safety valve seat 146 occurs so that the compressed air is released into the atmosphere and thereby has pressure reduced.

The pressure reducing valve 6 intervenes in the pressure-source fluid tube 5, and the compressed-air passage 148 and the secondary port 136 continue into a pressure-source fluid channel 30 so that the compressed air flows from the compressed-air passage 148 toward the secondary port 136.

Figure 6:
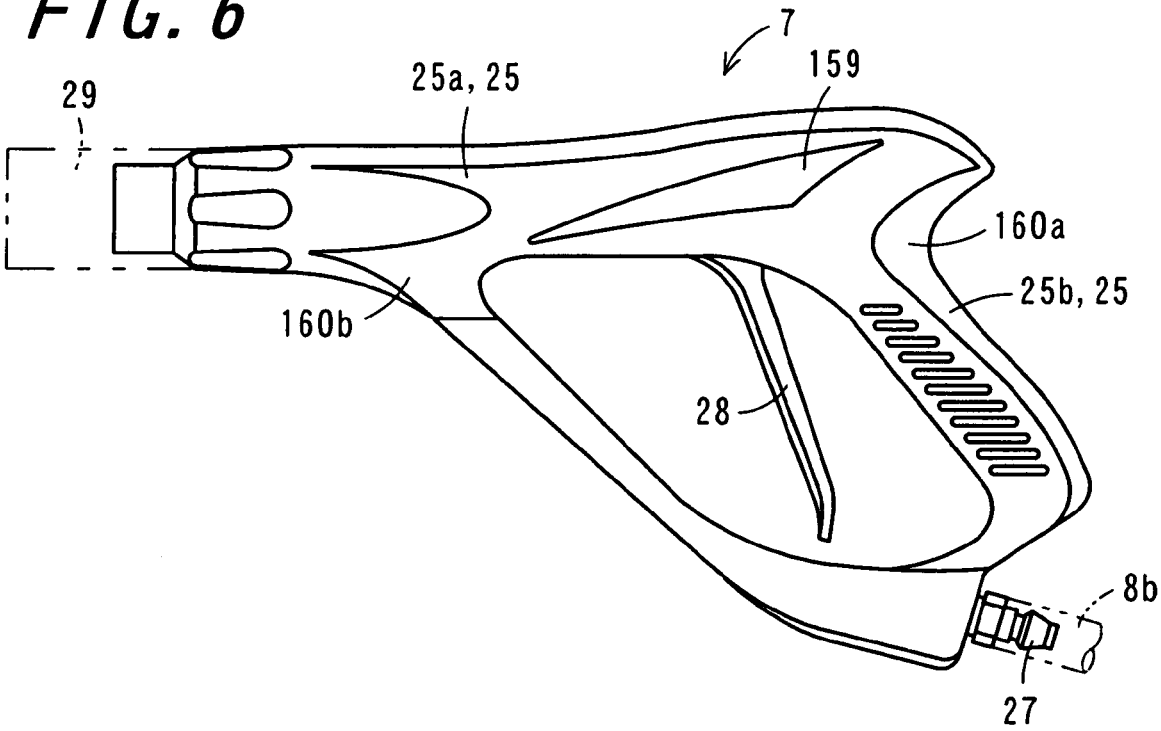
FIG. 6 is a front view showing discharge means 7.
Figure 7:
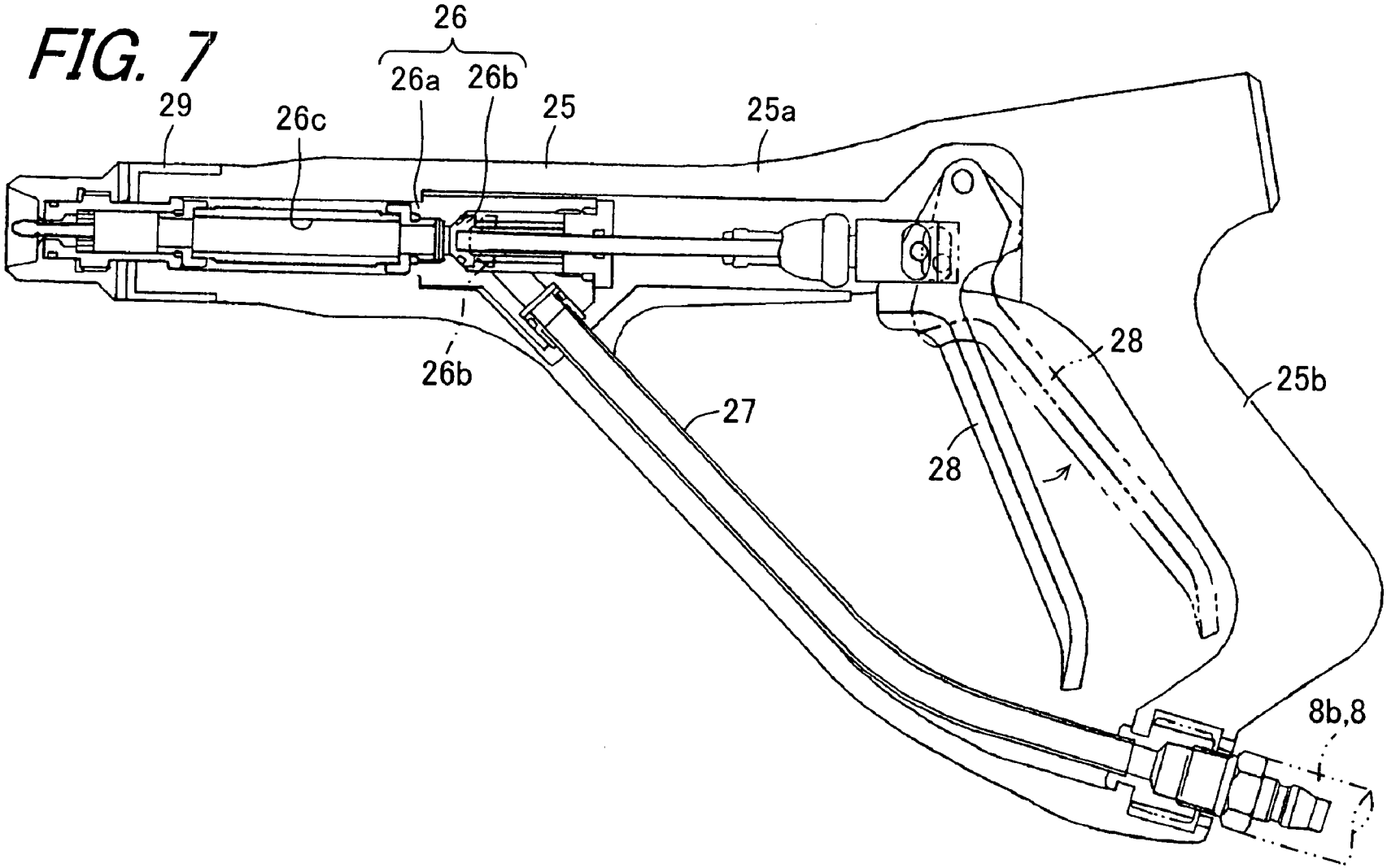
FIG. 7 is a front sectional view showing the discharge means 7.

FIG. 6 is a front view showing the discharge means 7. FIG. 7 is a front sectional view showing the discharge means 7. For the convenience of explanations, FIG. 7 is different from a cross section of the discharge means 7 shown in FIG. 6. To explain in reference to FIGS. 1 and 2, the discharge means 7 is a so-called hand gun and configured so as to be capable of discharging the extinguishant contained in the extinguishant containers 3 and 4.

The extinguishant tube 8 is made of an NBR-based synthetic resin, for example, and connected to the two extinguishant containers 3 and 4 and the discharge means 7 so that the extinguishant contained in the two extinguishant containers 3 and 4 is led to the discharge means 7. Note that a material of the extinguishant tube 8 is not limited to the above material. The extinguishant tube 8 includes a first extinguishant tube portion 8*a* and a second extinguishant tube portion 8*b*. The extinguishant tube portion 8*a* has one end connected to the one extinguishant container 3 and the other end connected to the other extinguishant container 4. The second extinguishant tube portion 8*b* has one end connected to the discharge means 7 and the other end connected to a middle part of the first extinguishant tube portion 8*a*.

Figure 8:
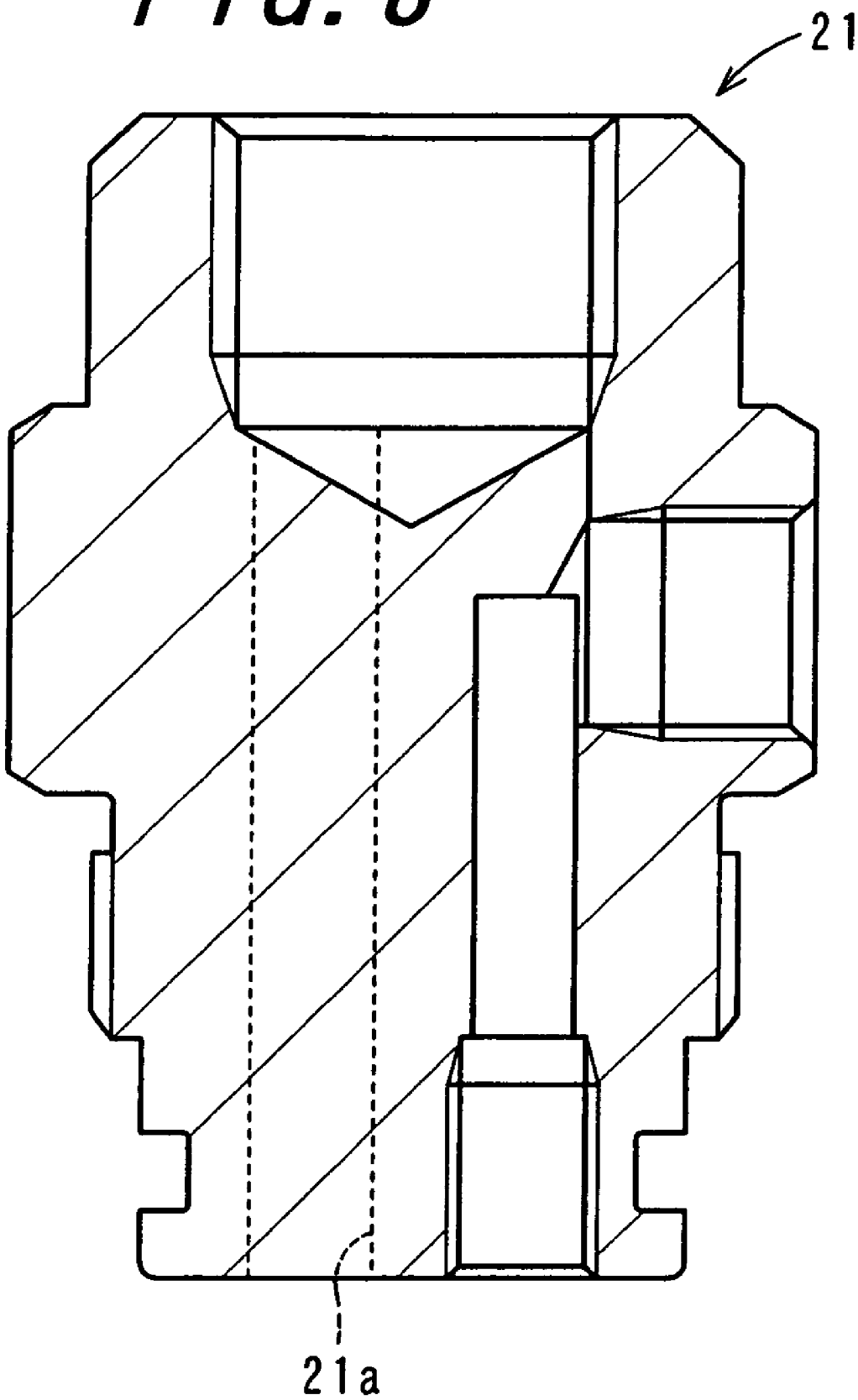
FIG. 8 is a view showing an assembled tubing 21.
Figure 9:
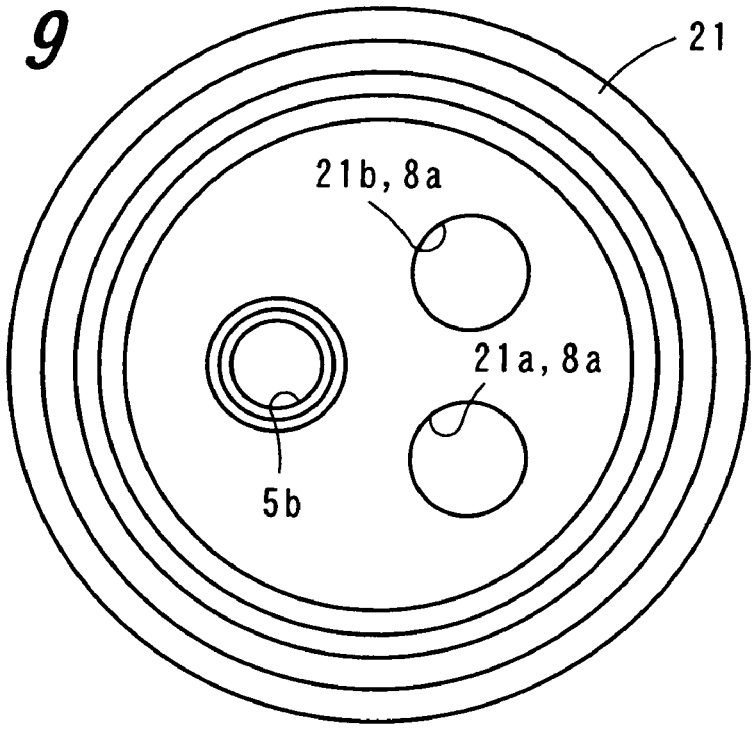
FIG. 9 is a bottom view showing the assembled tubing 21 seen from bottom on the sheet of FIG. 8.
Figure 10:
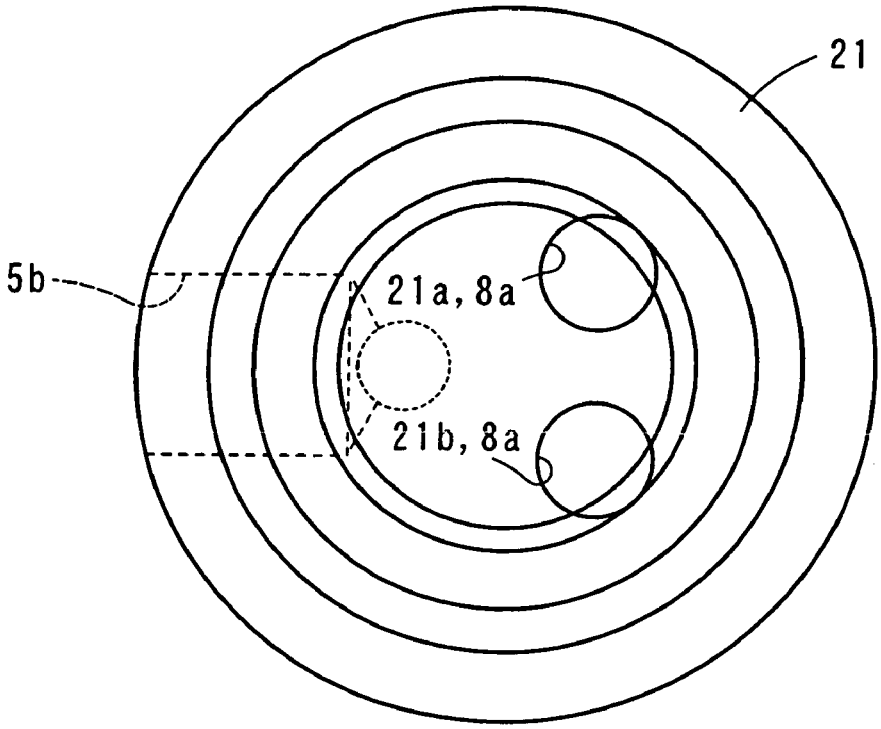
FIG. 10 is a plan view showing the assembled tubing 21 seen from top on the sheet of FIG. 8.

FIG. 8 is a view showing the assembled tubing 21. FIG. 9 is a bottom view showing the assembled tubing 21 seen from bottom on the sheet of FIG. 8. FIG. 10 is a plan view showing the assembled tubing 21 seen from top on the sheet of FIG. 8. The axially other openings of the two extinguishant containers 3 and 4 are each provided with the assembled tubing 21, and in the assembled tubing 21 are formed some parts of the pressure-source fluid tube 5 and the extinguishant tube 8. In the assembled tubing 21, a plurality of channels; two channels 21*a* and 21*b* in the embodiment, are formed so that the part of the extinguishant tube 8 secures a flow volume of the extinguishant flowing down from the extinguishant containers 3 and 4 to the discharge means 7. In the remaining part of the extinguishant tube 8, the flow volume of the extinguishant is secured by one channel. By thus forming the parts of the pressure-source fluid tube 5 and the extinguishant tube 8 in one assembled tubing 21, there is no need to newly process the extinguishant containers 3 and 4 so as to be connected to the pressure-source fluid tube 5 or the extinguishant tube 8, resulting in a simpler structure.

The one end and the other end of the second pressure-source fluid tube 5 are each provided with a siphon 22 having a bottomed cylindrical shape which extends from the other end to a vicinity of the one end of the extinguishant containers 3 and 4 along the axis lines of the extinguishant containers 3 and 4. The siphon 22 has its axially one end open and connected to the second pressure-source fluid tube 5, and its axially other end provided with a communication hole 23 which radially penetrates the siphon 22 from inside to outside thereof. The extinguishant containers 3 and 4 retain such an amount of the extinguishant that the communication hole 23 of the siphon 22 is located higher than the extinguishant level in a state where the extinguishant containers 3 and 4 are upright. In other words, the communication hole 23 is located so that the retained extinguishant does not flow into the communication hole 23 in the state where the extinguishant containers 3 and 4 are upright.

The discharge means 7 includes a discharge means housing 25, an on-off valve portion 26, a supply tube 27, a lever 28, and a spray nozzle 29. The discharge means housing 25 is painted with black and made of aluminum, for example. Note that the color is not limited to black and may be red, blue, yellow, and green, and the material is neither limited to aluminum and may be a resin. The discharge means housing 25 has a housing body 25*a* and a grip portion 25*b*. The housing body 25*a* is formed into a substantially long rectangular shape, and its longitudinal one end is formed into a cylindrical shape which is open in a longitudinal direction. In the following description, an axis line of the cylindrical portion on the longitudinal one end may be referred to as an axis line of the housing body 25*a*.

Inside the housing body 25*a*, a space is formed from the one end to the other end in the longitudinal direction. One surface portion of the housing body 25*a* has an opening in the vicinity of the longitudinal other end. Further, in the vicinity of the longitudinal other end of the housing body 25*a*, protrusions 159 are formed on two surface portions adjacent to the one surface portion having the opening. The protrusion 159 protrudes away from the surface portion. The protrusion 159 is painted in, for example, red, blue, yellow, and green, which color is different from that of the remaining portion of the discharge means 7. Note that the color is not limited to different colors and may be the same color. The grip portion 25*b* is formed into a substantially U-shape so as to be capable of being gripped, having its one end 160*a* integrated into the longitudinal other end of the housing body 25*a*, with the other end 160*b* integrated into a longitudinal middle part of the housing body 25*a*.

The on-off valve portion 26 has a valve path forming part 26*a* which is formed into a substantially cylindrical shape, and a valve element 26*b*. The valve path forming part 26*a* is arranged on the longitudinal one end-side inside the housing body 25*a* so as to have an axis line in common with the housing body 25*a*. The valve path forming part 26*a* has its axially one end provided with an opening which is communicated with the opening on the longitudinal one end of the housing body 25*a*, and inside the opening of the valve path forming part 26*a* is formed a valve path 26*c*. The valve element 26*b* is formed into a bar, and inserted hermetically into the axially other end of the valve path forming part 26*a*. The valve element 26*b* is configured so as to be slidably displaceable in the valve path forming part 26*a* in an axial direction thereof, and configured so as to be capable of opening and closing the valve path 26*c* by the sliding displacement in the axial direction. The valve path forming part 26*a* is formed so that the supply tube 27 can be connected thereto, and formed so that an inner area of the supply tube 27 thus connected continues into the valve path 26*c*.

The supply tube 27 has one end connected to the extinguishant tube 8 and the other end connected to the valve path forming part 26*a*. The supply tube 27 is configured so as to be capable of leading to the valve path 26*c* the extinguishant flowing down the extinguishant tube 8. The supply tube 27 is fitted to the grip portion 25*b*. The lever 28 has its one part provided inside the housing body 25*a* in the vicinity of the axially other end thereof and its remaining part protruding from the opening of the housing body 25*a*. The remaining part of the lever 28 is formed so as to be capable of being gripped together with the grip portion 25*b* and provided so as to be displaceable, to be specific, angularly displaceable when gripped. The valve element 26*b* engages with the lever 28 and is configured so as to be slidably displaceable along the axis line of the housing body 25*a* in conjunction with the displacement of the lever 28. That is to say, the configuration is such that the angular displacement of the lever 28 causes the valve element 26*b* to slide along the axis line of the valve path forming part 26*a*, that is, in the longitudinal direction of the housing body 25*a*, thus allowing the valve path 26*c* to be opened and closed.

Figure 11:
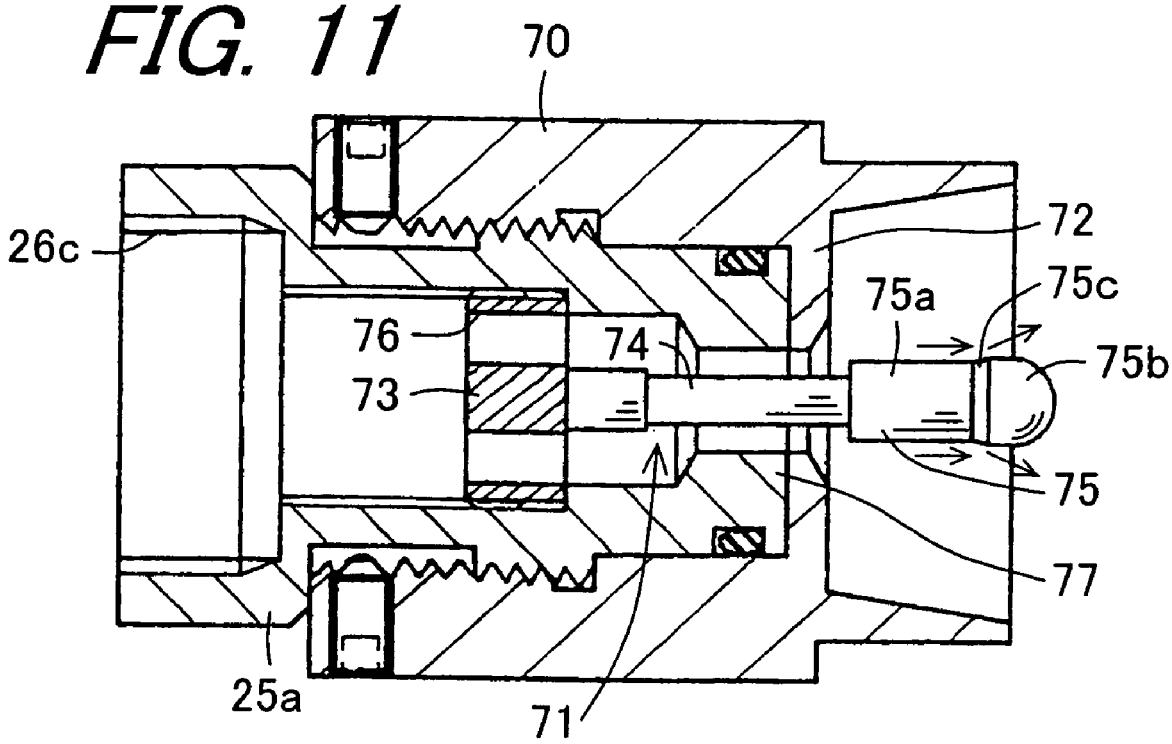
FIG. 11 is an enlarged view showing a spray nozzle 29.

FIG. 11 is an enlarged view showing the spray nozzle 29. On the axially one end of the housing body 25*a*, the spray nozzle 29 is formed. The spray nozzle 29 is configured so as to be capable of spreading the extinguishant. To explain in more detail, the spray nozzle 29 has a nozzle housing portion 70 and a nozzle shaft 71. The nozzle housing portion 70 is formed into a cylindrical shape and over an entire length of inner periphery on its axially middle part, an inward flange part 72 is formed which protrudes radially inward. The inner periphery of the inward flange part 72 has a part thereof formed into a tapered shape, of which diameter becomes gradually smaller from the axially other end toward one end of the nozzle housing portion 70. The nozzle housing portion 70 is attached on its axially one end to the axially one end of the housing part 25*a* of the discharge means 7 so as to be capable of being displaced axially, having an inner periphery on the other end formed into a tapered shape, of which diameter becomes gradually smaller from the axially other end toward one end. The nozzle housing portion 70 is threaded into the housing body 25*a* and mounted so as to be capable of being displaced axially. The nozzle housing portion 70 and the housing body 25*a* have the axis line in common.

The nozzle shaft 71 has a shaft base portion 73, a shaft bar 74, and a flow leading part 75. The shaft base portion 73 is formed into a disc shape. Around an axis line of the shaft base portion 73, a plurality of down flow holes 76 axially penetrating are formed at regular intervals. The shaft bar 74 is formed into a substantially cylindrical column shape and has its axially one end integrated into the shaft base portion 73. The axially other end of the shaft bar 74 is provided integrally with the flow leading part 75. The flow leading part 75 has a first flow leading part 75*a* which is formed into a cylindrical column shape, a second flow leading part 75*b* which is formed into a hemisphere shape, and a third flow leading part 75*c* which couples the first flow leading part 75*a* with the second flow leading part 75*b*. The first flow leading part 75*a* is formed to have a diameter which is smaller than that of the second flow leading part 75*b* and larger than that of the shaft bar 74. Further, the first flow leading part 75*a* is formed to have a diameter which is smaller than the inner periphery of the inward flange part 72. The third flow leading part 75*c* is formed into a tapered shape of which diameter becomes gradually smaller from the second flow leading part 75*b* toward the first flow leading part 75*a*. The first to third flow leading parts 75*a* to 75*c* have the axis line in common, and the shaft base portion 73, the shaft bar 74, and the flow leading part 75 have the axis line in common.

The nozzle shaft 71 is arranged so that the shaft bar 74 is inserted into the inward flange part 72. The shaft bar 74 inserted has a space radially from the inward flange part 72. Over an entire length of the inner periphery of the axially one end of the housing body 25*a*, a flange part 77 is formed which protrudes inward. In contact with the flange part 77, the shaft base portion 73 of the nozzle shaft 71 is arranged inside the housing body 25*a*. The shaft base portion 73 and the housing part 25*a* of the discharge means 7 have the axis line in common.

Figure 12:
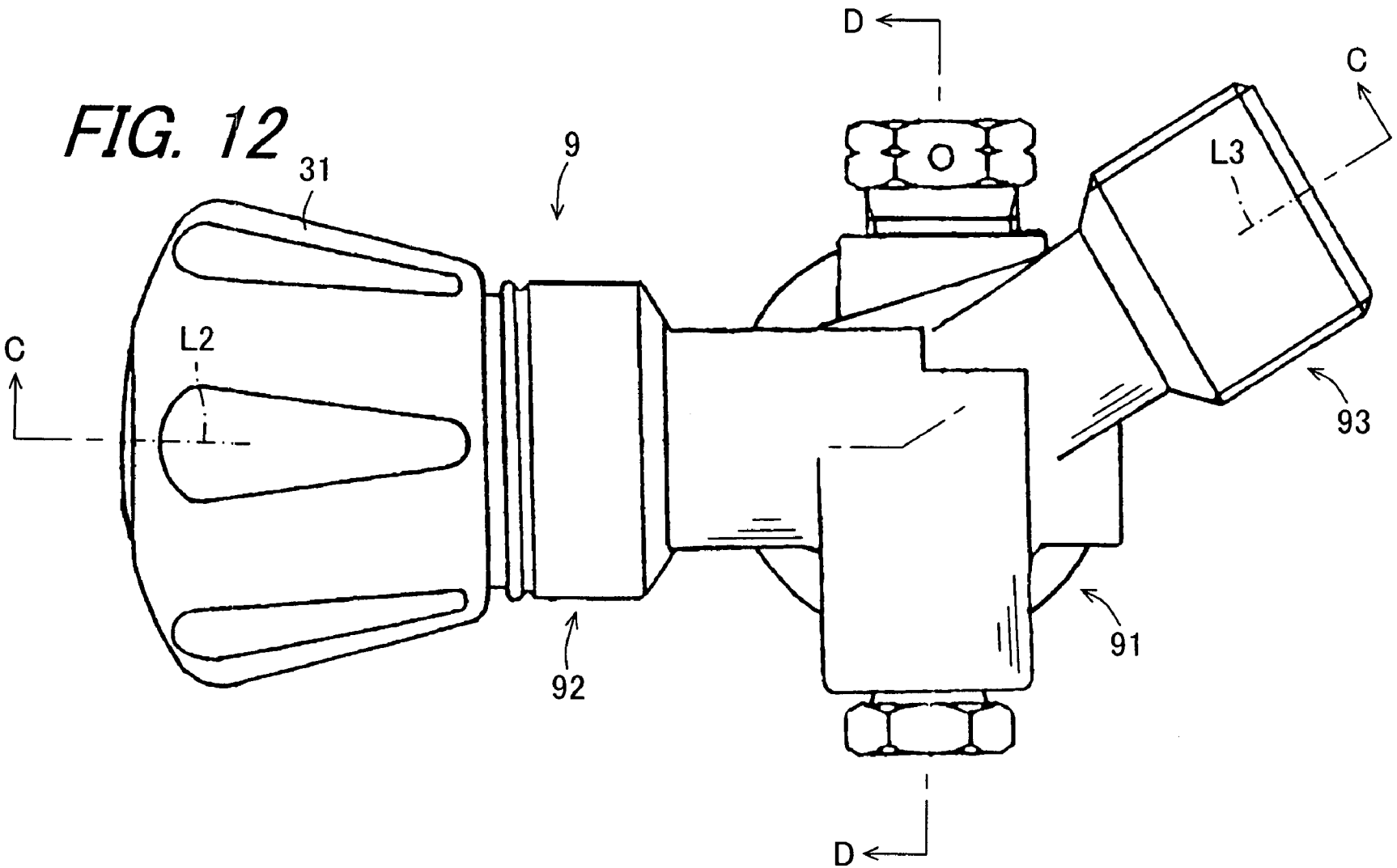
FIG. 12 is a plan view showing an on-off valve 9.
Figure 13:
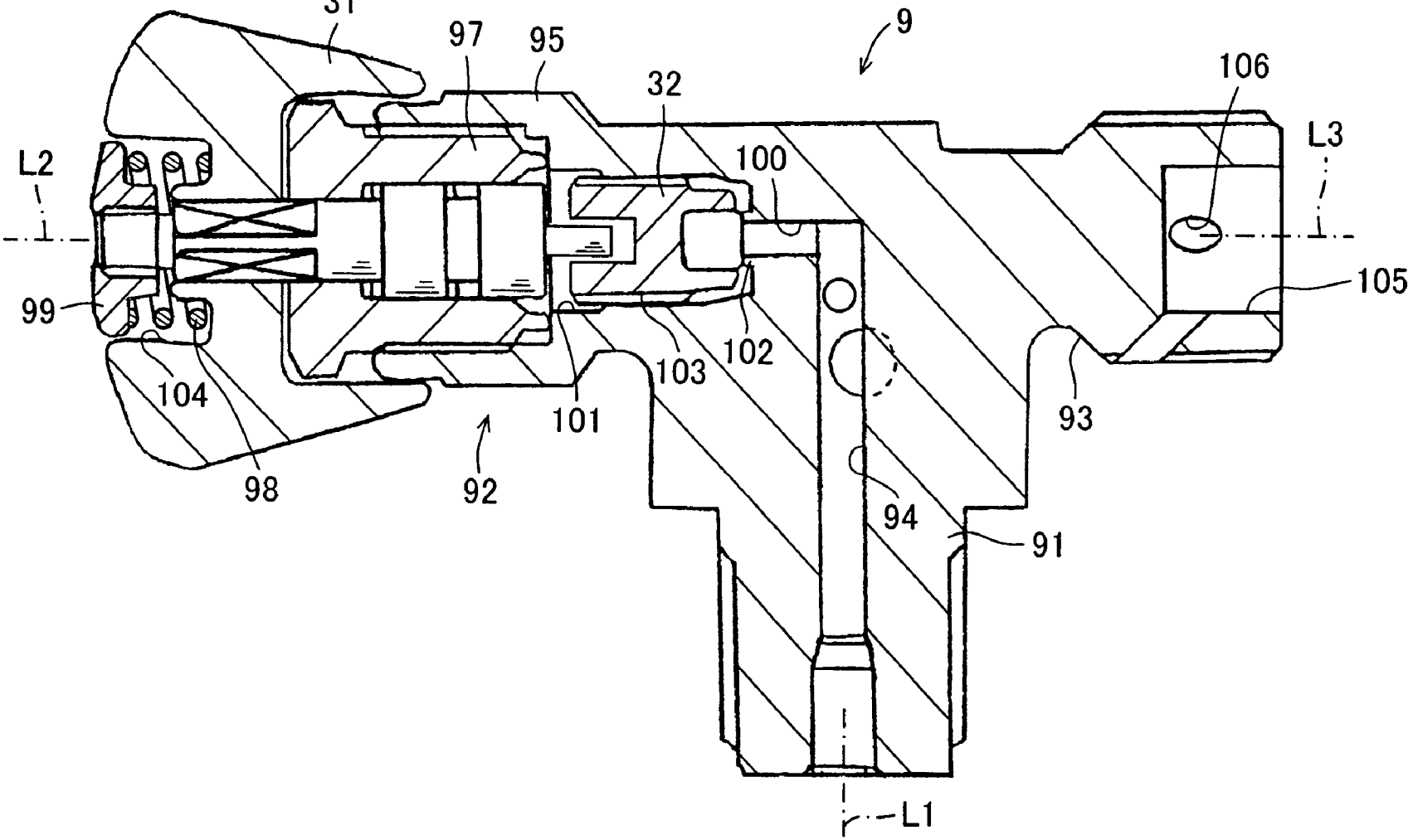
FIG. 13 is a view showing the on-off valve 9 taken on line C-C in FIG. 12.
Figure 14:
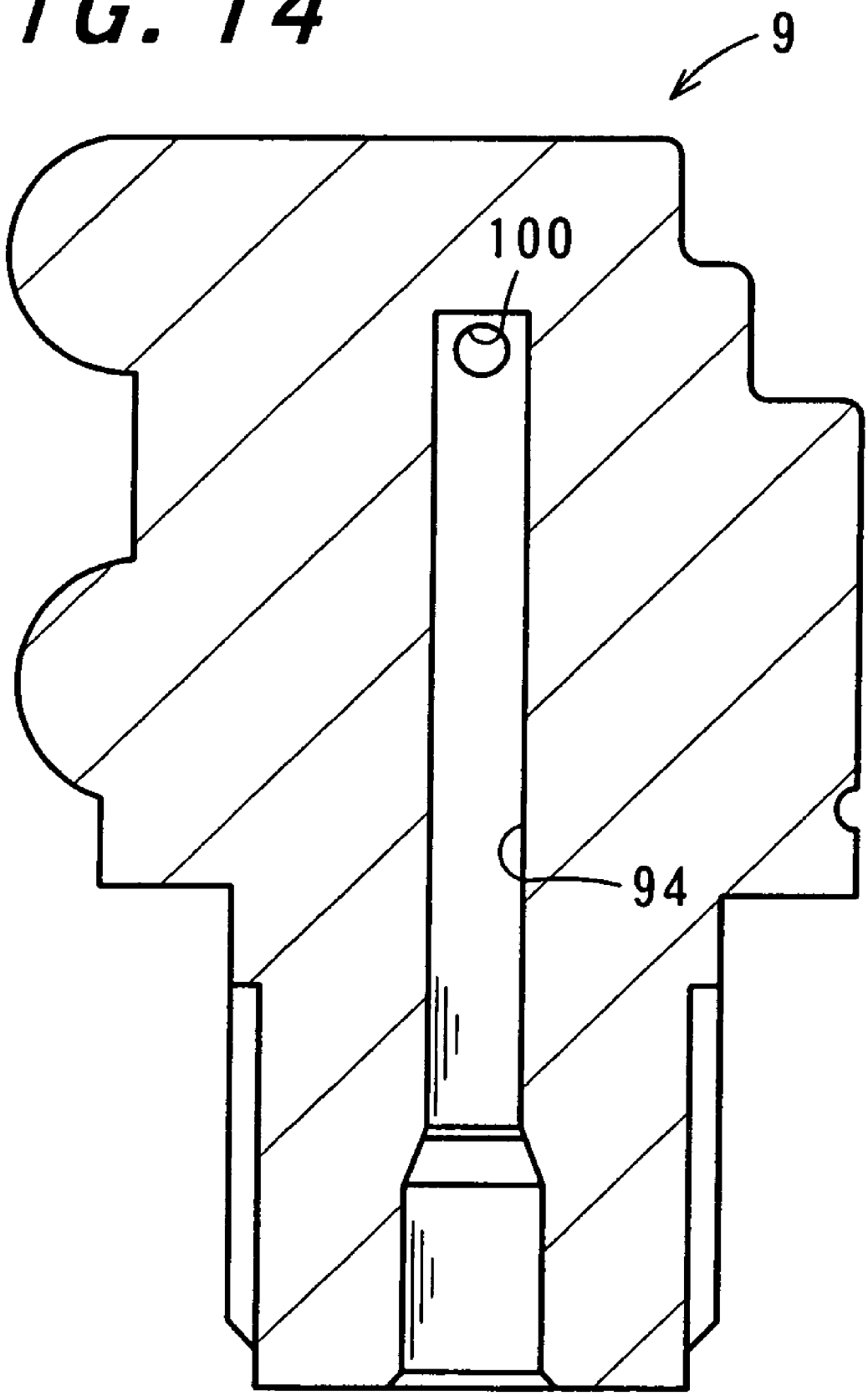
FIG. 14 is a view showing the on-off valve 9 taken on line D-D in FIG. 12.

FIG. 12 is a plan view showing the on-off valve 9. FIG. 13 is a view showing the on-off valve 9 taken on line C-C in FIG. 12. FIG. 14 is a view showing the on-off valve 9 taken on line D-D in FIG. 12. The on-off valve 9 is connected to the first pressure-source fluid tube portion 5*a* and disposed on the opening of the pressure-source fluid container 2. The on-off valve 9 has a channel which continues into the pressure-source fluid channel 30 and the pressure-source fluid container 2, and is configured so as to be capable of opening and closing the channel. The on-off valve 9 basically includes a handgrip 31 and an on-off valve element 32, and is configured so that an operation of the handgrip 31 causes the on-off valve element 32 to open and close the channel.

To explain in more detail, the on-off valve 9 includes a first channel forming portion 91, an on-off valve portion 92, and a second channel forming portion 93, which are integrally formed. In the first channel forming portion 91, a first channel 94 is formed through which the compressed fluid can flow. The first channel forming portion 91 is connected to the opening of the pressure-source fluid container 2. The first channel forming portion 91 has an axis line L1 around which axis line the first channel 94 is formed. The first channel 94 is formed so that the compressed air retained in the pressure-source container 2 flows down. The on-off valve portion 92 includes a housing portion 95, the handgrip 31, the on-off valve element 32, a stem 97, a spring member 98, and a spring holding member 99.

The housing portion 95 has an axis line L2 around which axis line L2 an on-off valve primary port 100 and an on-off valve element housing hole 101 are formed. In the housing portion 95, the on-off valve primary port 100 is formed on an axially one end-side while the on-off valve element housing hole 101 is formed on the other end-side, which port and hole are communicated with each other. The housing portion 95 has the on-off valve primary port 100 continuing into the first channel 94, and its axially other end is open along the above axis line. The on-off valve primary port 100 is formed to have a diameter smaller than that of the on-off valve element housing hole 101. In the housing portion 95, a ring-shaped on-off valve seat 102 is formed so as to encompass an opening through which the on-off valve primary portion 100 faces the on-off valve element housing hole 101.

The on-off valve element 32 is formed into a cylindrical column shape on which outer periphery an on-off valve groove 103 is formed from an axially one end to the other end. The on-off valve 32 is housed in the on-off valve element housing hole 101 and provided so as to be slidably displaceable in a direction parallel to the axis line L2. The on-off valve 32 is provided so as to be capable of being seated on the on-off valve seat 102. To be specific, the on-off valve element 32 is configured so as to be displaced in the direction parallel to the axis line L2, thereby being seated and moving away.

The stem 97 is formed into a substantially cylindrical column shape and housed in the on-off valve housing hole 102 so as to be slidably displaceable in the direction parallel to the axis line L2 in a state where its axially one end can contact the on-off valve portion 102. The axially one end of the stem 97 is hermetically provided in the housing portion 95 so as to be slidably displaceable in the direction parallel to the axis line L2. The stem 97 has the axially other end protruding from the opening of the housing portion 95 in the direction parallel to the axis line L2. The on-off valve 32 and the stem 97 have axis lines which are identical to the axis line L2.

The handgrip 31 is formed into a substantially truncated cone, to which the stem 97 is inserted as being displaceable in the direction parallel to the axis line L2 and prevented from rotating around the axis line L2. The handgrip 31 is disposed so as to cover the axially other end of the housing portion 95. To the axially other end of the stem 97, the spring holding member 99 is threaded. In the handgrip 31, a ring-shaped spring member housing space 104 is formed around the axially other end of the stem 97 inserted. In the spring member housing space 104, a helical compression spring, i.e., the spring member 98 is housed and its axially one end contacts the spring holding member 99 while the other end contacts the handgrip 31. The handgrip 31 and the spring member 98 have axis lines which are identical to the axis line L2. In the arrangement as above, the spring member 98 biases the handgrip 31 with elastic force which is parallel to the axis line L2 and directed toward the housing portion 95.

The second channel forming portion 93 has an axis line L3 around which axis line L3 a second channel 105 is formed. To the second channel forming portion 93, the pressure-source fluid tube 5 is connected. The second channel forming portion 93 is formed so as to lead to the pressure-source fluid tube 5 the compressed fluid flowing down the second channel 105 in a state where the pressure-source fluid tube 5 is connected. Over the on-off valve portion 92 and the second channel forming portion 93, a communication path 106 is formed through which the on-off valve element housing hole 101 and the second channel 105 are communicated with each other. When the on-off valve element 32 moves away from the on-off valve seat 102, the communication path 106 is formed so as to lead to the second channel 105 the compressed air which is led by flowing down the on-off valve primary port 100 and passing through the on-off groove 103.

Figure 15:
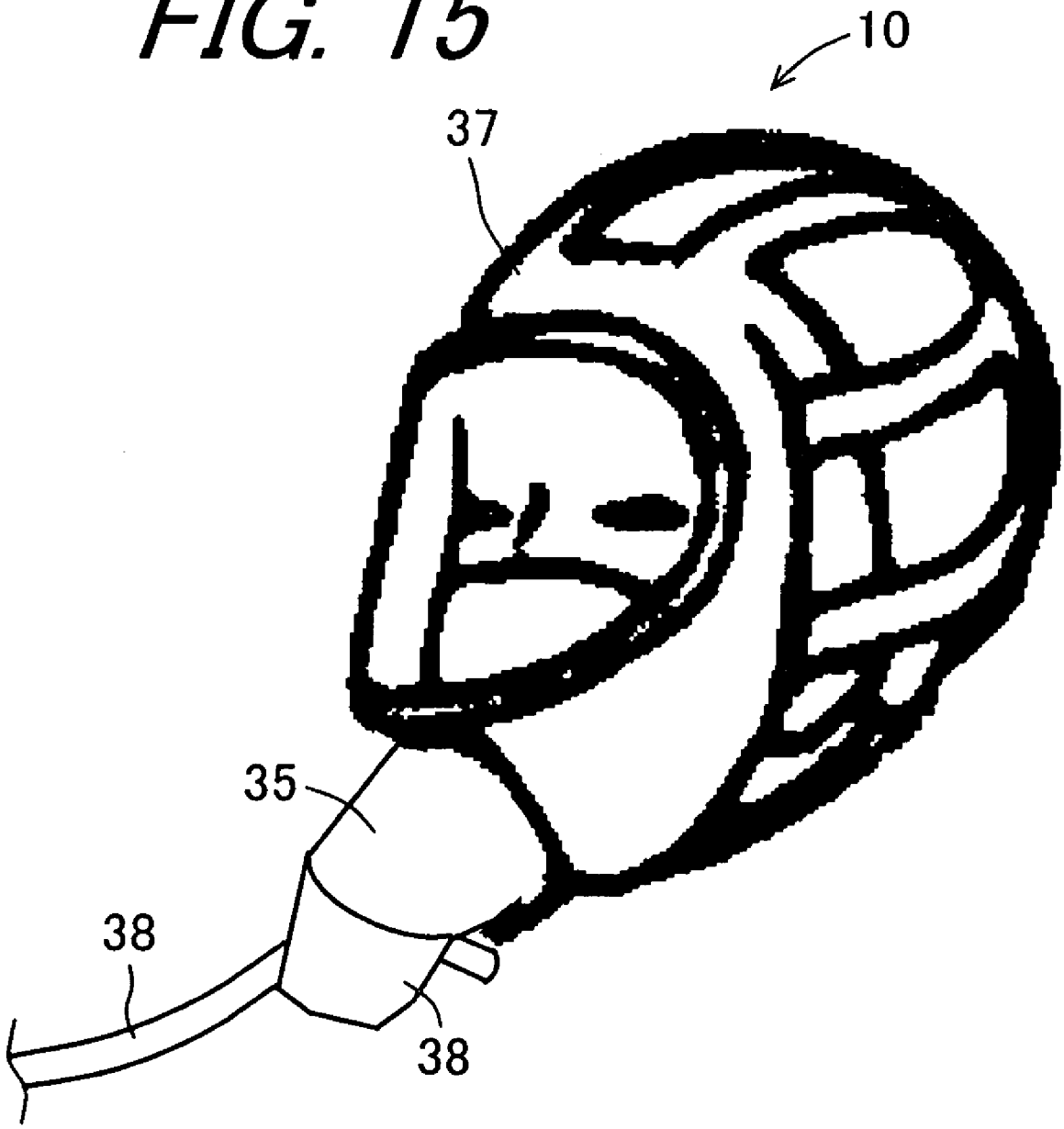
FIG. 15 is a perspective view showing a breathing apparatus 10.
Figure 16:
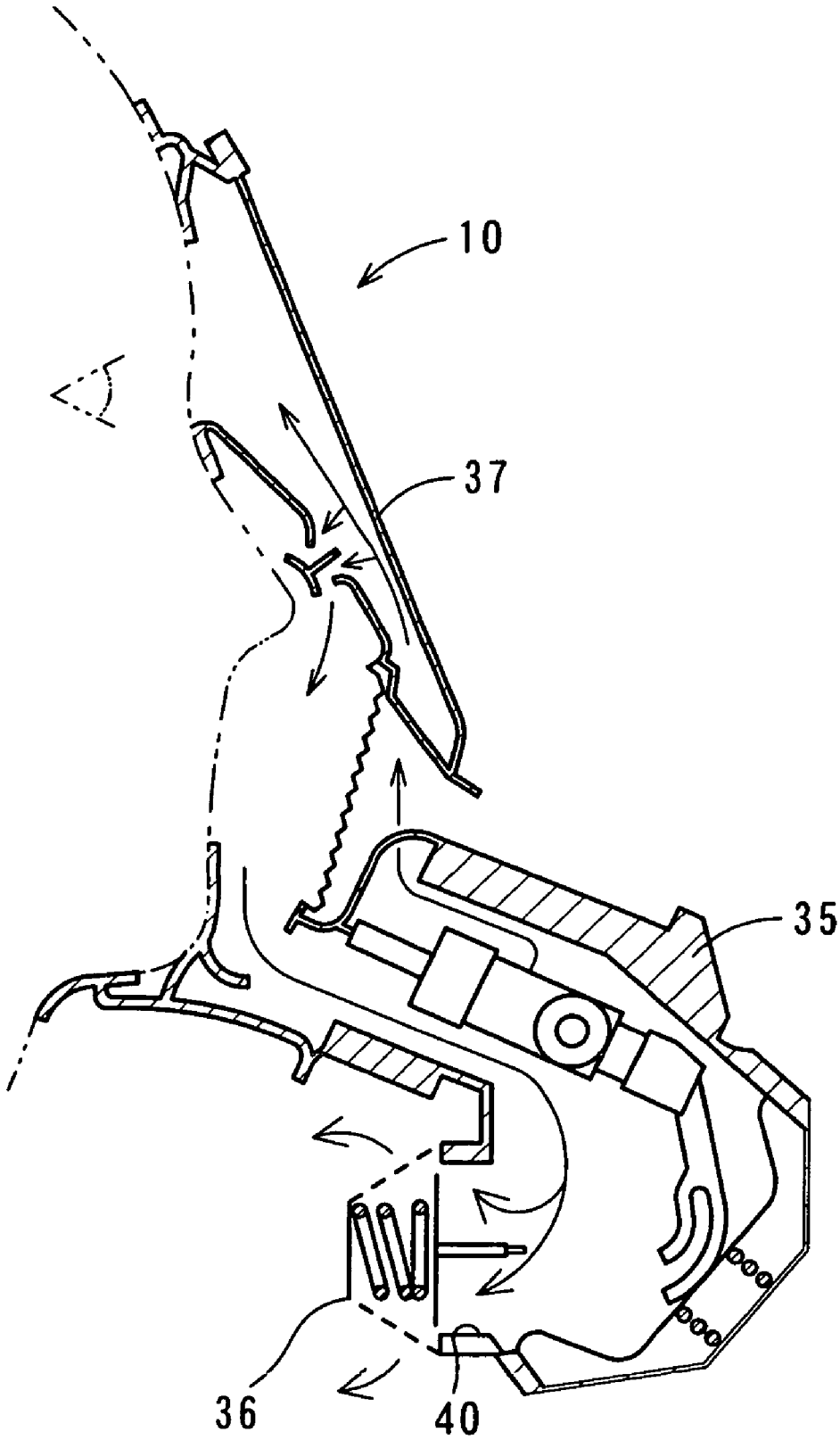
FIG. 16 is a sectional view showing a cross section of the breathing apparatus 10.
Figure 17:
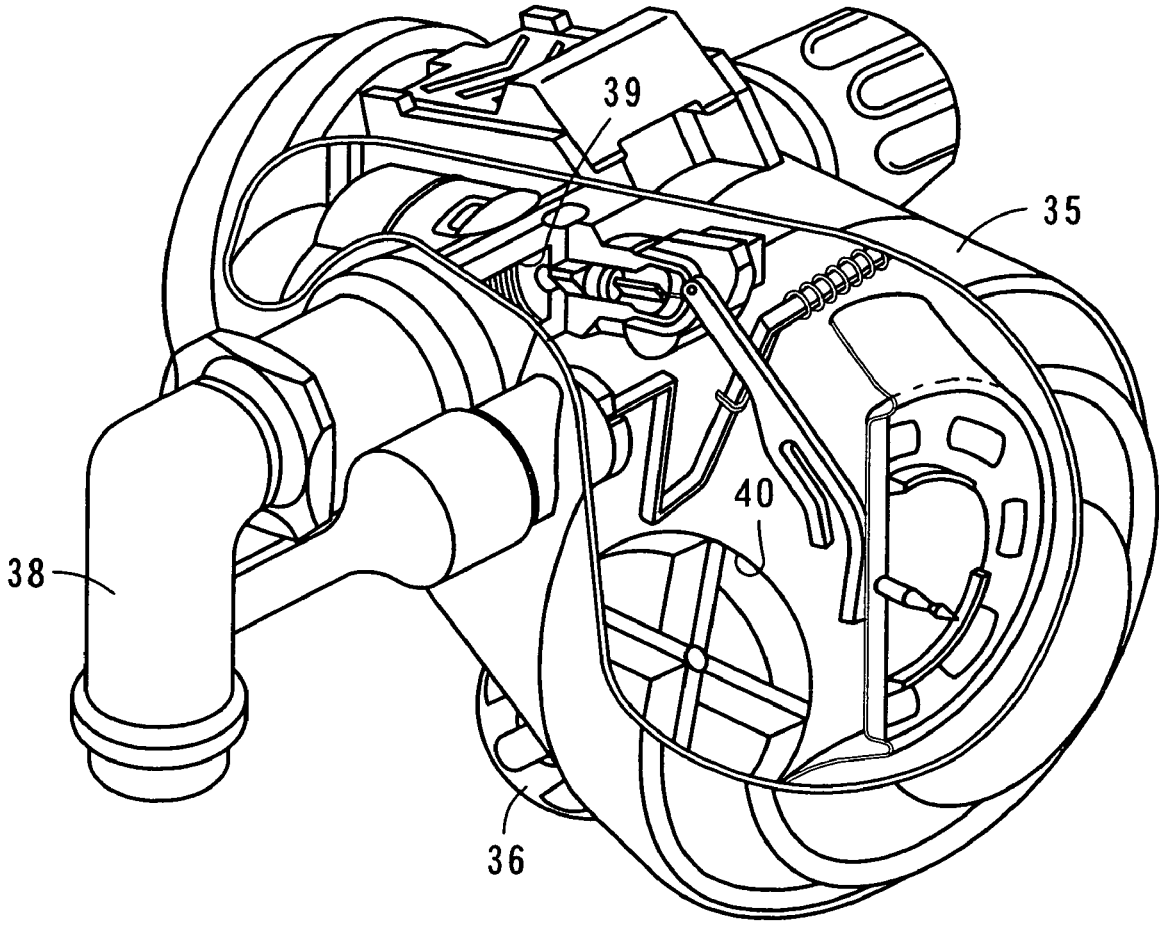
FIG. 17 is a partially cutaway perspective view showing a lung power valve 35 and an exhalation valve 36 included in the breathing apparatus 10.

FIG. 15 is a perspective view showing the breathing apparatus 10. FIG. 16 is a sectional view showing a cross section of the breathing apparatus 10. FIG. 17 is a partially cutaway perspective view showing a lung power valve 35 and an exhalation valve 36 included in the breathing apparatus 10. The breathing apparatus 10 serving as gas supply means is configured so as to be capable of supplying the compressed air depressurized by the pressure reducing valve 6. The breathing apparatus 10 includes a face cover 37, a gas supply tube 38, the lung power valve 35, and the exhalation valve 36. The face cover 37 is configured so that a person can put it on one's face, and formed so as to cover the person's eyes, nose, and mouth when the person wears it. The gas supply tube 38 connects the face cover 37 with the pressure reducing valve 6. The lung power valve 35 intervenes in the gas supply tube 38 and configured so as to be capable of adjusting an opening degree of a gas supply path 39 which is formed inside the gas supply tube 38. The lung power valve 35 is configured so as to adjust the opening degree of the gas supply path 39 based on pressure of air inside the face cover 37. To be specific, when the pressure of the air inside the face cover 37 becomes a level lower than predetermined pressure, i.e., positive pressure, the gas supply path 39 is opened, and when the pressure of the air inside the face cover 37 becomes the positive pressure or higher, the gas supply path 39 is closed. The exhalation valve 36 is configured so as to adjust an opening degree of an exhalation path 40 which is formed in the face cover 37 based on the pressure of the air inside the face cover 37. To be specific, when the pressure of the air inside the face cover 37 exceeds the positive pressure, the exhalation path 40 is opened, and when the pressure of the air inside the face cover 37 is the positive pressure or lower, the exhalation path 40 is closed.

Figure 18:
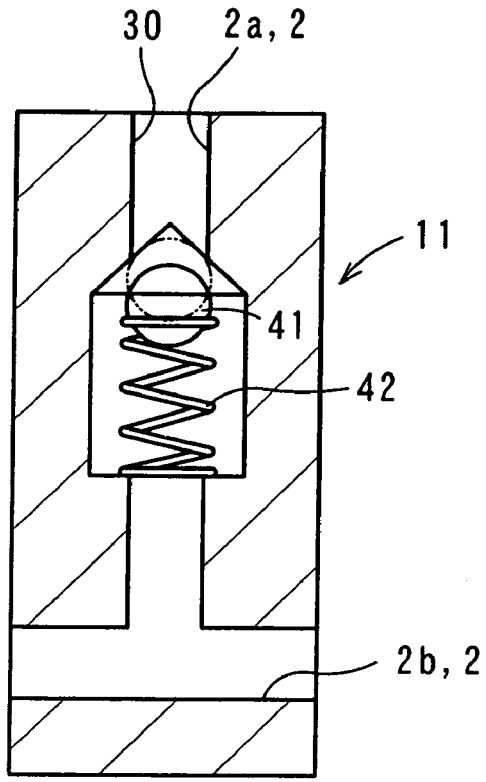
FIG. 18 is a sectional view schematically showing a back flow prevention valve 11.

FIG. 18 is a sectional view schematically showing the back flow prevention valve 11. The back flow prevention valve 11 serving as back flow prevention means intervenes in the pressure-source fluid tube 5 and configured so as to prevent the extinguishant from flowing back the pressure-source fluid tube 5 from the extinguishant containers 3 and 4 toward the pressure-source container 2. The back flow prevention valve 11 is provided downstream of the pressure reducing valve 6 in the A1 direction. The back flow prevention valve 11 includes a back flow prevention valve element 41 and a back flow prevention valve spring member 42. The back flow prevention valve element 41 is arranged in the pressure-source fluid tube 5 and configured so as to be capable of opening and closing the pressure-source fluid channel 30. The back flow prevention valve spring member 42 biases the back flow prevention valve element 41 with elastic force which is directed to an upstream side in the A1 direction, and is arranged so as to displace the back flow prevention valve element 41 in a direction of closing the pressure-source fluid channel 30. Further, the back flow prevention valve element 41 is arranged so as to receive the pressure of the compressed air flowing down and the pressure of the extinguishant flowing back the pressure-source fluid tube 5. In the configuration as above, the back flow prevention valve element 41 maintains the pressure-source fluid channel 30 closed even when the pressure downstream and the pressure upstream of the back flow prevention valve element 41 in the A1 direction are the same. Thus, it is possible to maintain at least a state where the pressure given by the extinguishant is higher than the pressure given by the compressed air, with the result that a function of preventing the back flow is high.

Figure 19:
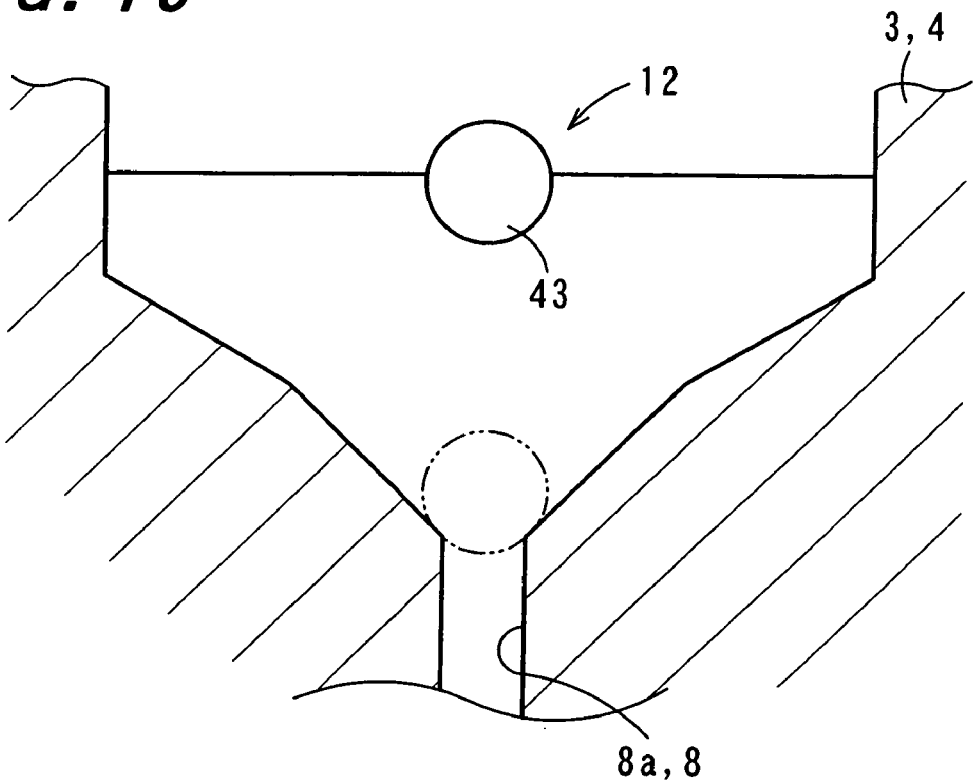
FIG. 19 is a sectional view schematically showing a down flow prevention valve 12.

FIG. 19 is a sectional view schematically showing the down flow prevention valve 12. The down flow prevention valve 12 serving as down flow prevention means is configured so as to prevent the compressed air from flowing down the extinguishant tube 8. The down flow prevention valves 12 are disposed on one end and the other end of the first extinguishant tube portion 8*a* and configured so as to open and close the openings on the one end and the other end of the first extinguishant tube portion 8*a* based on the amount of the extinguishant retained in the extinguishant containers 3 and 4. In the embodiment, when the extinguishant retained in the extinguishant containers 3 and 4 is used up, floats 43 having density less than the extinguishant close the openings on the one end and the other end of the first extinguishant tube portion 8*a* (In FIG. 19, the float 43 is drawn in two-dot chain lines) so that the compressed air is prevented from flowing down the extinguishant tube 8.

Figure 20:
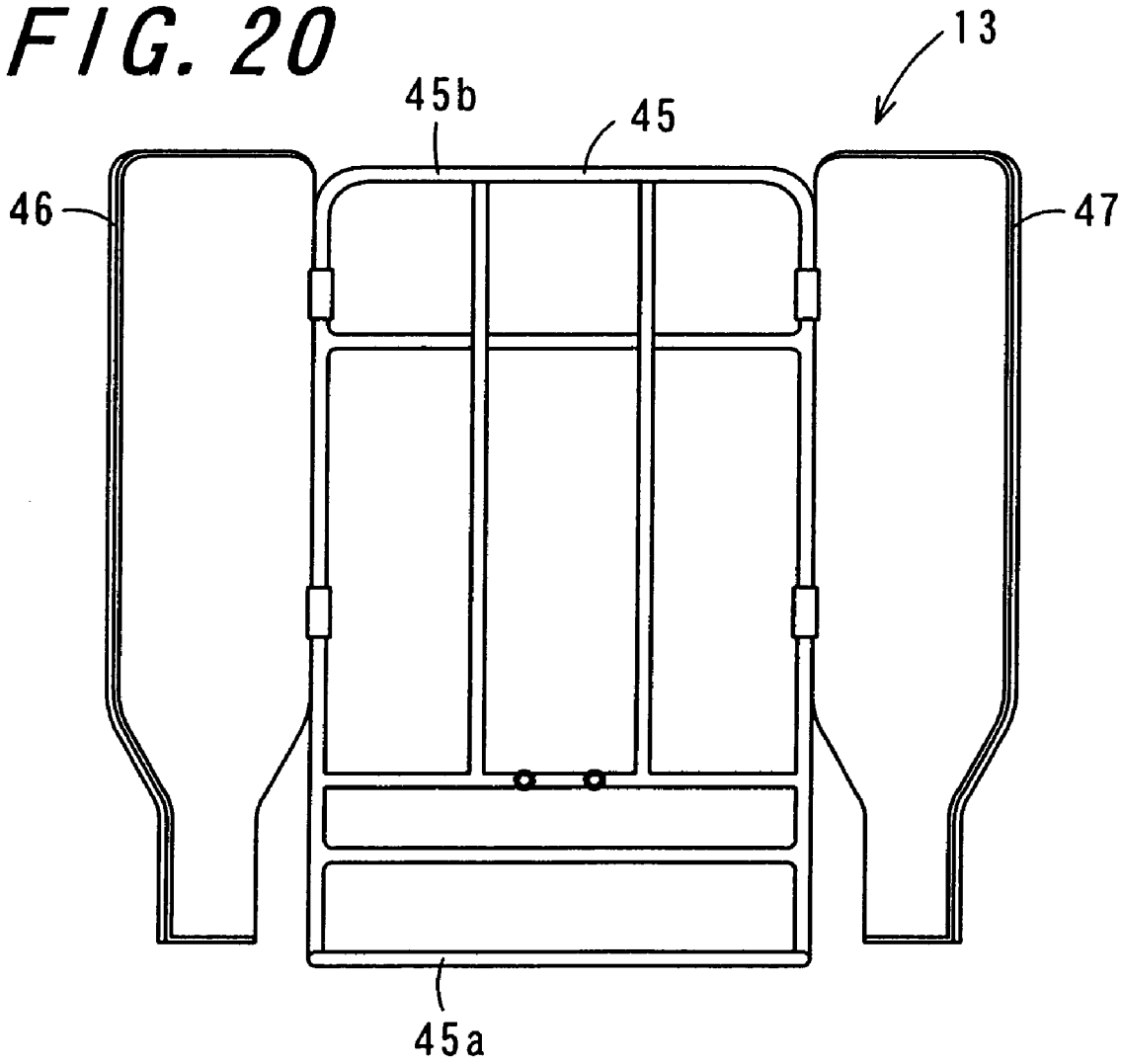
FIG. 20 is a front view showing a container holder 13 having cover members 46 and 47 open.
Figure 21:
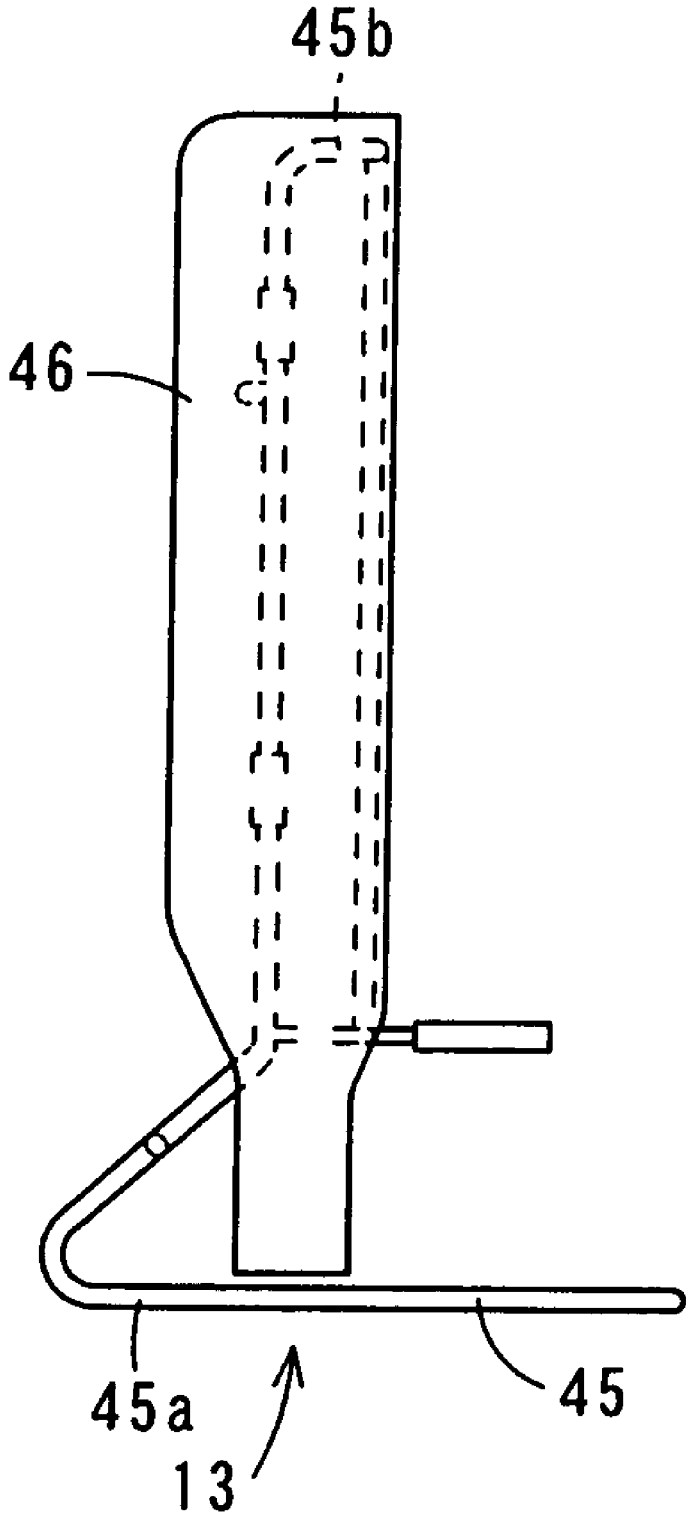
FIG. 21 is a left side view showing the container holder 13 viewed from a left side on the sheet of FIG. 20.
Figure 22:
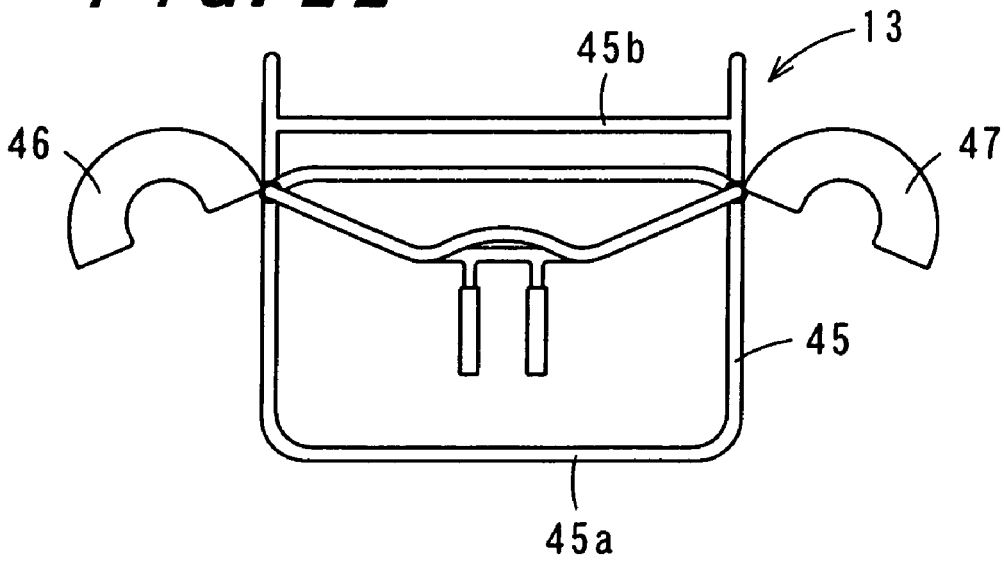
FIG. 22 is a plan view showing the container holder 13 viewed from an upside on the sheet of FIG. 20.
Figure 23:
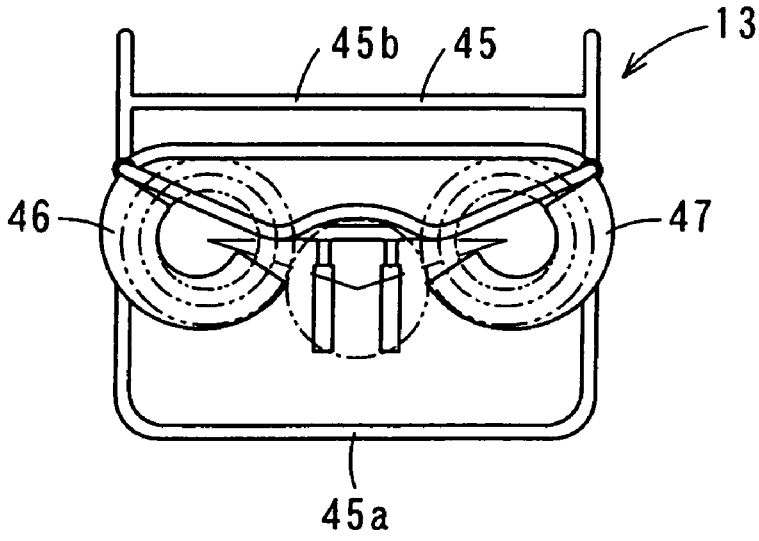
FIG. 23 is a plan view showing the container holder 13.
Figure 24:
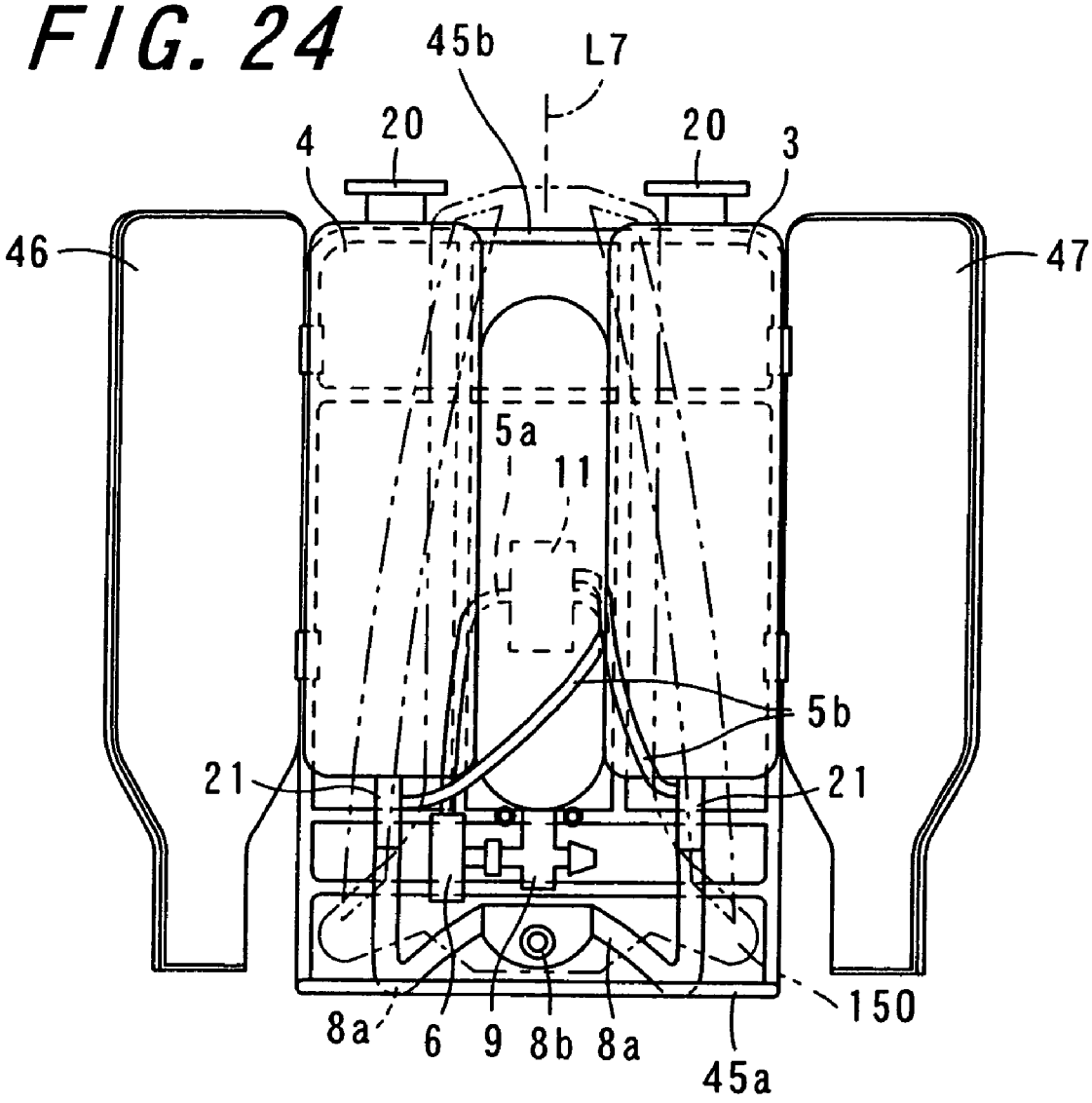
FIG. 24 is a front view showing a state where the pressure-source fluid container 2 and the extinguishant containers 3 and 4 are mounted on the container holder 13.

FIG. 20 is a front view showing the container holder 13 having cover members 46 and 47 open. FIG. 21 is a left side view showing the container holder 13 viewed from a left side on the sheet of FIG. 20. FIG. 22 is a plan view showing the container holder 13 viewed from an upside on the sheet of FIG. 20. FIG. 23 is a plan view showing the container holder 13. FIG. 24 is a front view showing a state where the pressure-source fluid container 2 and the extinguishant containers 3 and 4 are mounted on the container holder 13. Since the container holder 13 has a bilaterally symmetric structure on the sheet of FIG. 20, the container holder 13 viewed from a right side on the sheet of FIG. 20 is symmetrical to the container holder 13 viewed from the left side on the sheet of FIG. 20.

The container holder 13 includes a frame 45, the two cover members 46 and 47, and a back plate 150. The frame 45 is configured so that the pressure-source fluid container 2 and the two extinguishant containers 3 and 4 can be arranged upright. To be specific, the two extinguishant containers 3 and 4 provided in the frame 45 are disposed with a space therebetween and arranged so as to have axis lines parallel to each other. The pressure-source fluid container 2 is provided between the two extinguishant containers 3 and 4 and disposed so as to have an axis line parallel to the axis lines of the two extinguishant containers 3 and 4. The pressure-source fluid container 2 and the two extinguishant containers 3 and 4 are disposed so as to have axis lines thereof positioned at apexes of an isosceles triangle (shown in a chain line in FIG. 23). The frame 45 is configured so that the pressure-source fluid container 2 and the two extinguishant containers 3 and 4 can be disposed at the positions as above. Accordingly, in FIG. 40, the two extinguishant containers 3 and 4 are provided symmetrically with respect to an axis line L7 of the pressure-source fluid container 2.

The frame 45 is made of stainless steel, for example, and formed so that the pressure-source fluid container 2 and the two extinguishant containers 3 and 4 are detachable. Note that the frame 45 is not limited to a frame made of stainless steel. The frame 45 is configured so as to be capable of holding the pressure-source fluid container 2 and the two extinguishant containers 3 and 4 upright. In other words, the frame 45 is configured so as to be self-sustainable in the state where the pressure-source fluid container 2 and the two extinguishant containers 3 and 4 are upright. In the state where the container holder 13 is self-sustained, the axis lines of the pressure-source fluid container 2 and respective extinguishant containers 3 and 4 extend vertically.

The frame 45 upright includes a leg portion 45*a* which contacts a horizontal plane such as a floor, and a trunk portion 45*b* coupled to the leg portion 45*a*, for detachably holding the respective containers 2, 3, and 4. In the state where the respective container 2, 3, and 4 are attached to the trunk portion 45*b*, the leg portion 45*a* of the frame 45 and the respective containers 2, 3, and 4 are located with spaces therebetween, and in the upright state, the respective containers 2, 3, and 4 are disposed above the leg portion 45*a* with spaces therebetween.

In the upright state, the on-off valve 9 and the pressure reducing valve 6 are located below the pressure-source fluid container 2 and above the leg portion 45*a* of the frame 45. Further, the respective pressure-source fluid and extinguishant tubes 5 and 8, the pressure reducing valve 6, the on-off valve 9, and the back flow prevention valve 11 are also located above the leg portion 45*a*. The respective containers 2, 3, and 4, the pressure-source fluid tube 5, the extinguishant tube 8, the pressure reducing valve 6, the on-off valve 9, and the back flow prevention valve 11 can be thus prevented from directly contacting the floor and therefore prevented from damages.

Further, the frame 45 supports directly or indirectly the pressure-source fluid tube 5, the pressure reducing valve 6, the extinguishant tube 8, the one-off valve 9, and the back flow prevention valve 11. In the embodiment, the back plate 150 is used to support the respective structures 5, 6, 8, 9 and 11. The back plate 150 is formed into a plate shape and faces a back of a user when the user wears the fire extinguisher 1. To be specific, the back plate 150 is disposed opposite to the axis line of the pressure-source fluid container 2 with respect to a virtual plane including the two axis lines of the extinguishant containers 3 and 4, and extends in parallel with the virtual plane. The back plate 150 is stably fixed to the frame 45 when attached to an upper end and a lower end of the frame 45 upright.

The frame 45 is provided with a shoulder belt 48 which is used for the user to carry the fire extinguisher 1 on one's back. The two extinguishant containers 3 and 4 are disposed so that a transverse width of the fire extinguisher 1 is shorter than a shoulder width when the user carries the fire extinguisher 1 on one's back. The transverse width herein represents a direction in which the extinguishant containers 3 and 4 are spaced away from each other and which is perpendicular to the axis lines and equal to a direction that a base extends of the above isosceles triangle formed by connecting the axis lines of the three containers 2 through 4.

The two cover member 46 and 47 are formed into a semi-cylindrical shape and rotatably mounted on the frame 45. The semi-cylindrical shape is synonymous with a shape which is obtained by cutting a cylinder along a virtual plane including an axis line thereof. The cover members 46 and 47 are made of FRP, for example, and surfaces thereof are painted in red, grey, or black. Note that the cover members 46 and 47 are not limited to those made of the material as above and painted in the color as above. For example, the cover members 46 and 47 may be formed of acrylic modified high-impact vinyl chloride which material itself has a color such as red or black. The two cover members 46 and 47 are configured, respectively, so as to cover the two extinguishant containers 3 and 4 mounted in the frame 45. The rotation of one cover member 46 allows for switching of one extinguishant container 3 between covered and exposed while the rotation of the other cover member 47 allows for switching of the other extinguishant container 4 between covered and exposed. To be specific, the cover members 46 and 47 are formed into a substantially semi-cylindrical shape. The cover members 46 and 47 are formed so as to have larger diameters than those of the extinguishant containers 3 and 4, and each has a peripheral one end rotatably provided on the trunk portion 45*b* of the frame 45. To be specific, the cover members 46 and 47 are provided so as to be capable of rotating around the axis lines which are parallel to the extinguishant containers 3 and 4. When rotated respectively, the cover members 46 and 47 can cover and expose the extinguishant containers 3 and 4.

The alarm 190 is provided on a branch from the pressure-source fluid tube 5 which intervenes between the on-off valve 9 and the pressure reducing valve 6. The alarm 190 is configured so as to inform the wearer that the pressure of the compressed air flowing down from the on-off valve 9 to the pressure reducing valve 6 becomes the predetermined pressure or lower. The alarm 190 informs the wearer with a whistle, for example. The wearer can be thus informed of the pressure, that is, a remaining amount, of the compressed air inside the pressure-source fluid container 2. Accordingly, the wearer can be prevented from having trouble breathing during use.

The pressure indicator 191 is provided on a branch from the pressure-source fluid tube 5 which intervenes between the on-off valve 9 and the pressure reducing valve 6. The pressure indicator 191 measures the pressure of the compressed air flowing down from the on-off valve 9 to the pressure reducing valve 6, and is configured so as to be capable of displaying the pressure. The wearer can be thus informed of the pressure, that is, the remaining amount, of the compressed air inside the pressure-source fluid container 2, and can see a remaining length of time to discharge the extinguishant and an available length of time to breathe.

An operation of the fire extinguisher 1 configured as above will be described hereinbelow. The handgrip 31 of the on-off valve 9 is operated to thereby open the channel inside the on-off valve 9 so that the compressed air flows through the pressure-source fluid channel 30. To be specific, when the handgrip 31 is rotated, the stem 97 is displaced, with the result that the on-off valve element 32 moves away from the on-off valve seat 102. The first channel 94 and the second channel 105 are thus communicated with each other, and the compressed air inside the pressure-source fluid container 2 then flows through the pressure-source fluid channel 30 via the on-off valve 9. The compressed air flows down the pressure-source fluid tube 5 and has the pressure being reduced by the pressure reducing valve 6. After depressurized, the compressed air passes through the pressure-source fluid tube 5 via the siphon 22, then being led to the extinguishant containers 3 and 4. The extinguishant retained in the extinguishant containers 3 and 4 is pressurized by the led compressed air, and discharged from the extinguishant containers 3 and 4 to the extinguishant tube 8. The extinguishant discharged is led to the discharge means 7 through the extinguishant tube 8. The wearer puts out fire by discharging the led extinguishant through the discharge means 7.

In the on-off valve 9, a one-way rotation of the handgrip 31 around the axis line L2 causes the stem 97 to rotate in conjunction therewith to thereby displace the on-off valve element 32 away from the valve seat 102 in a direction parallel to the axis line L2. The on-off valve primary port 100 and the second channel 105 are communicated with each other so that the compressed air flows down. The other-way rotation of the handgrip 31 around the axis line L2 causes the stem 97 to rotate in conjunction therewith to thereby displace the on-off valve element 32 to be seated on the valve seat 102 in a direction parallel to the axis line L2. When the on-off valve element 32 is displaced to be seated on the on-off valve seat 102, the on-off valve primary port 100 and the second channel 105 are blocked, resulting in suspension of the compressed air supply.

Owing to the pressure reducing valve 6, the pressure-source fluid of which pressure is maintained constant can be led to the extinguishant container. As a result, a spout amount of the extinguishant ejected from the extinguishant containers 3 and 4 to the extinguishant tube 8 can be maintained constant regardless of the remaining amount of the compressed air, and the discharge amount of the extinguishant discharged from the discharge means 7 can be maintained constant. To be specific, the pressure is reduced by the pressure control valve section 111. The pressure receiving member 116 receives the pressure of the secondary compressed air and based on the pressure, adjusts the opening degree of the orifice 129 to thereby maintain the pressure of the secondary compressed air at a constant level. The pressure is thus reduced.

The compressed gas in the form of the mixture gas containing at least oxygen can be supplied to the face cover 37 through the gas supply tube 38 after depressurized by the pressure reducing valve 6. The wearer can take the air supplied through the face cover worn, which has the predetermined pressure (positive pressure). The wearer can thus breathe.

The back flow prevention valve 11 can block the extinguishant at a position downstream of the pressure reducing means in the A1 direction, from flowing back to the pressure source fluid container 2 from the extinguishant containers 3 and 4. In other words, when the extinguishant flows back to the pressure source fluid container 2 from the extinguishant containers 3 and 4, the pressure-source fluid channel 30 is closed in the back flow prevention valve to thereby prevent the back flow of the extinguishant. The extinguishant can be thus prevented from flowing back to the pressure reducing valve 6.

The down flow prevention valve 12 can block the compressed air from flowing down the extinguishant tube 8 to the discharge means 7 and thereby being discharged. To be specific, the extinguishant retained in the extinguishant containers 3 and 4 is used up, the down flow prevention valve 12 closes the openings at one end and the other end of the extinguishant tube 8 so that the compressed air is prevented from flowing down the extinguishant tube 8. The compressed air can be thus prevented from being discharged from the discharge means 7.

In the fire extinguisher 1, an aqueous solution having a resin dissolved, which resin becomes higher in viscosity as a temperature rises. As a result, the extinguishant discharged toward the fire will have a higher temperature and therefore higher viscosity. The extinguishant having higher viscosity is less flowable as compared to water, with the result that the extinguishant attached to the to-be-extinguished object can be therefore prevented from flowing, etc., and thus being spread out. Further, the temperature of the extinguishant flowing down the extinguishant tube is lower than that of the discharged extinguishant, resulting in lower viscosity which allows for a decrease in the pressure required for delivering the extinguishant to the discharge means 7 through the extinguishant tube 8.

Owing to the frame 45 where the pressure-source fluid container 2 and the extinguishant containers 3 and 4 are arranged, the pressure-source fluid container and the extinguishant containers can be held upright. Further, the cover members 46 and 47 are rotated, thus allowing for switching between the state where the extinguishant containers 3 and 4 are covered and protected and the state where the extinguishant containers 3 and 4 are exposed and detachable.

Figure 25:
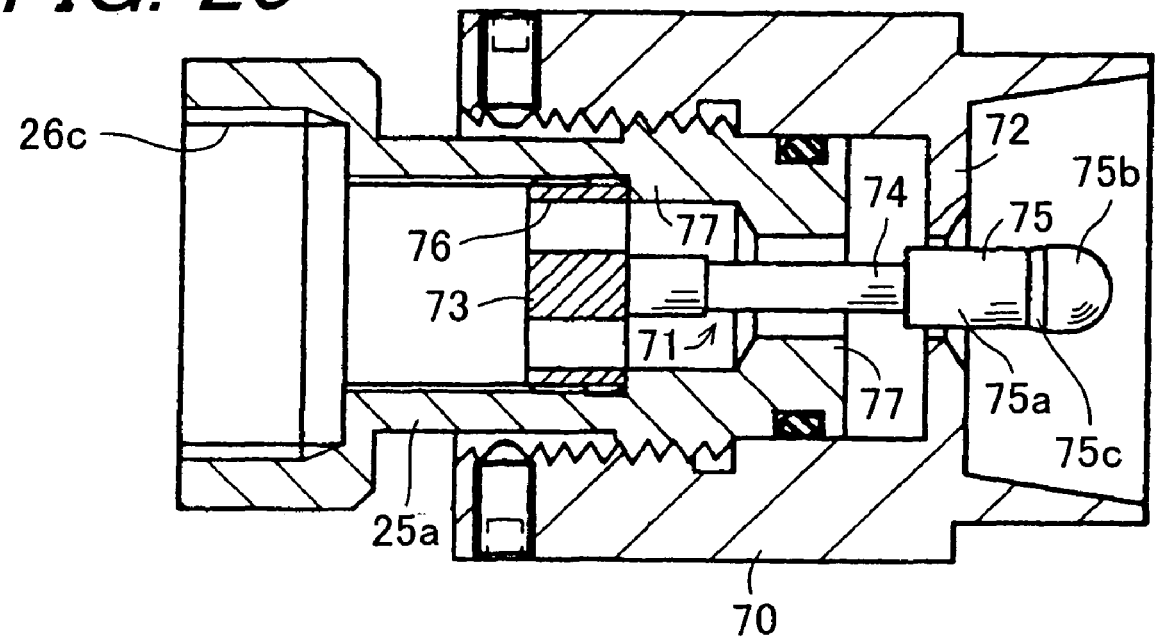
FIG. 25 is a view showing a state where a nozzle housing portion 70 is displaced relative to a housing body 25*a* of the discharge means 7.

FIG. 25 is a view showing a state where the nozzle housing portion 70 is displaced relative to the housing body 25*a* of the discharge means 7. In the discharge means 7, when the lever 28 is angularly displaced, the valve element 26*b* is axially displaced to thereby open the valve path 26*c*. When such an operation is carried out in the state where the compressed air is led to the pressure-source fluid channel 30 by operation of the handgrip 31 of the on-off valve 9, the extinguishant led to the valve path 26*c* through the extinguishant tube 8 and the supply tube 27 passes through the valve path 26*c* and reaches the spray nozzle 29 to be thereby spread and sprayed. To be specific, in the state where the axially one end of the housing body 25*a* and the inward flange part 72 are in contact with each other as shown in FIG. 11, the extinguishant passes through the down flow holes 76 and the inward flange part 72 and collides against the one end of the first flow leading part 75*a* to be thereby spread and discharged to outside. Further, when the nozzle housing portion 70 is displaced so that the first flow leading part 75*a* is inserted into the inward flange part 72 as shown in FIG. 25, the third flow leading part 75*c* causes the extinguishant to be gently spread radially outward. As above, the displacement of the nozzle housing portion 70 can change a range of the extinguishant to be spread.

Figure 26:
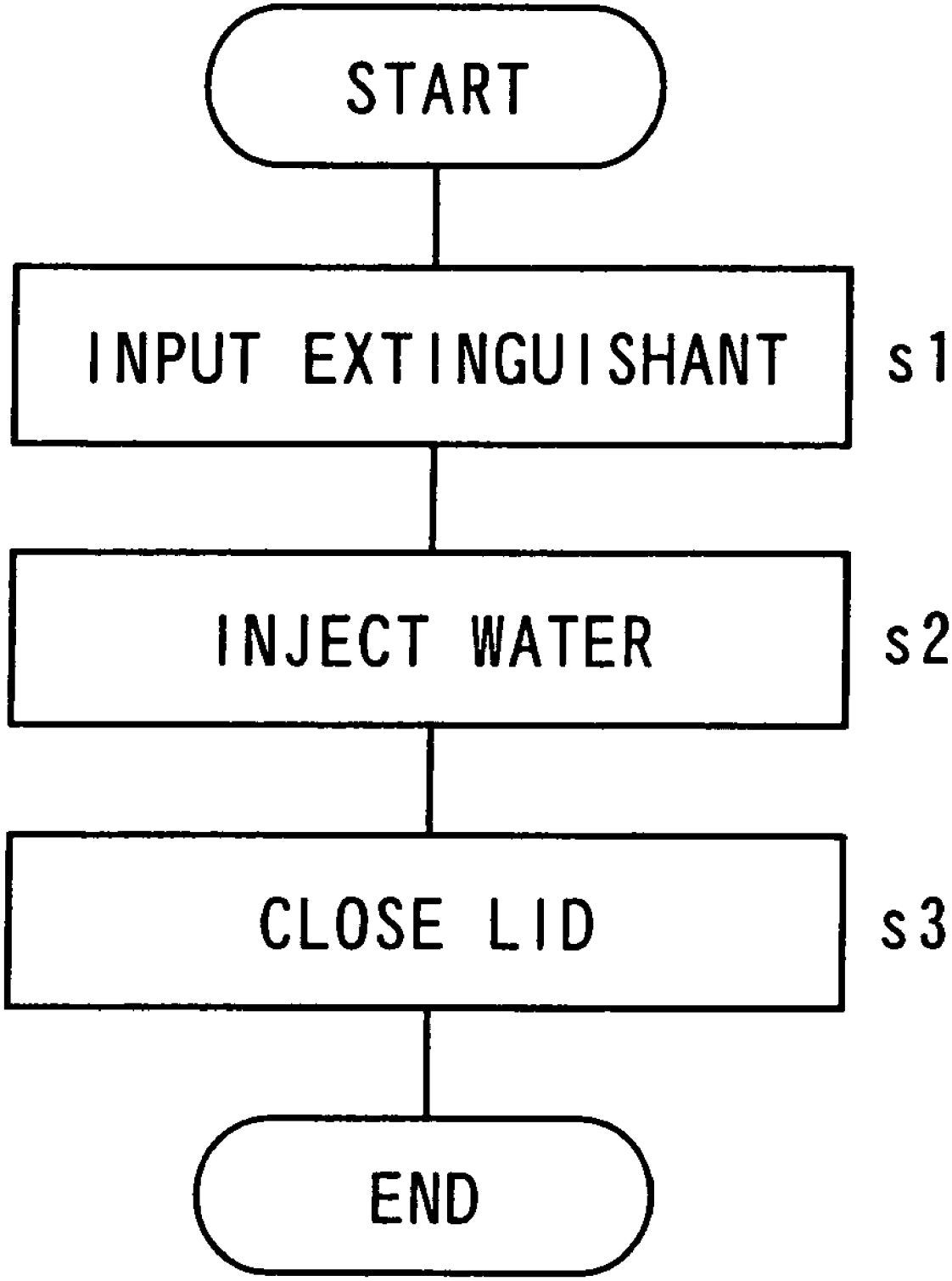
FIG. 26 is a flowchart for showing a procedure of supplying the extinguishant to the extinguishant containers 3 and 4.

FIG. 26 is a flowchart for showing a procedure of supplying the extinguishant to the extinguishant containers 3 and 4. When the lids 20 of the extinguishant containers 3 and 4 are opened, the liquid supply process starts and proceeds to Step s1. At Step s1, condensed liquid of the extinguishant is supplied to the extinguishant containers 3 and 4. After the supply is finished, the process then proceeds to Step s2. At Step s2, water is supplied to dilute the condensed liquid of the extinguishant. The water supply is carried out by use of a hose, for example. Upon supplying the water, the hose is placed with a supply port thereof in the condensed liquid of the extinguishant so that air bubbles are not generated in the condensed liquid of the extinguishant. After the condensed liquid of the extinguishant is diluted, the process then proceeds from Step s2 to Step s3. At Step s3, the extinguishant containers 3 and 4 are sealed with the lids 20. After the sealing, the liquid supply process is completed.

In the following descriptions, effects given by the fire extinguisher 1 configured as above will be explained. According to the fire extinguisher 1 of the present embodiment, the compressed air enables the extinguishant retained in the extinguishant containers 3 and 4 to be ejected, with the result that the extinguishant can be ejected with the aid of a small amount of the compressed air, that is not like the two-fluid fire extinguisher of the second related art where a large amount of air is used for spraying water. The volume of the compressed air which is to be retained in the pressure-source fluid container 2 can be therefore smaller than that in the two-fluid fire extinguisher of the related art, with the result that the pressure-source fluid container 2 can be smaller in weight. Further, the pressure-source fluid container 2 which retains the same volume of the compressed air may have the compressed air with reduced pressure so that the pressure-source fluid container 2 does not need higher pressure resistance, and the wall of the extinguishant container may be thinner than those in the fire extinguisher of the second related art. The weight of the pressure-source fluid container 2 can be therefore smaller. The decrease in the weight of the pressure-source fluid container 2 as above can decrease the weight of the fire extinguisher 1.

Furthermore, in the fire extinguisher 1, the compressed air is depressurized by the pressure reducing valve 6, and the compressed air thus depressurized is then led to the extinguishant containers 3 and 4 through the pressure-source fluid tube 5. The pressure of the compressed air led to the extinguishant containers 3 and 4 can be thus prevented from fluctuating, with the result that the discharge amount of the extinguishant discharged from the discharge means 7 can be prevented from fluctuating. The prevention of fluctuation in the discharge amount of the extinguishant enabled by leading the depressurized compressed air to the extinguishant containers 3 and 4 as described above allows the extinguishant to be stably discharged without depending on a length of discharge time. When the compressed air is led after depressurized, the extinguishant containers 3 and 4 do not need higher pressure resistance, and the walls of the extinguishant containers 3 and 4 may be thinner than those in the fire extinguishers of the first and second related arts. The weight of the fire extinguisher 1 can be therefore reduced.

Further, according to the fire extinguisher 1 of the embodiment, the flow volume of the extinguishant ejected from the extinguishant containers 3 and 4 to the extinguishant tube 8 can be constant regardless of the remaining amount of the compressed air by virtue of the pressure reducing valve 6. The discharge amount of the extinguishant discharged from the discharge means 7 through the extinguishant tube 8 can be therefore maintained constant. In the fire extinguishers of the first and second related arts, the extinguisher is discharged based on the inner pressure of the extinguisher containers 3 and 4 and therefore, the discharge amount depends on an amount of the extinguishant retained, in other words, depends on a length of discharge time. In the invention, the extinguishant is ejected with the aid of the compressed air of which pressure is maintained constant, so that the constant amount of the extinguishant can be discharged without depending on the length of discharge time. By maintaining the discharge amount of the extinguishant as described above, it is possible to attain the fire extinguisher 1 having stable fire-extinguishing ability, of which discharge amount of the extinguishant does not depend on the length of discharge time.

Further, according to the fire extinguisher 1 of the embodiment, the compressed air retained in the pressure-source container 2 is depressurized to the predetermined pressure (positive pressure) and then supplied by the breathing apparatus 10 to the face cover 37 so that the wearer wearing the face cover 37 can take the air in. The wearer can thus breathe the air supplied. When the compressed air for ejecting the extinguishant from the extinguishant containers 3 and 4 is supplied to the wearer as described above, there is no need to newly provide a container for retaining the compressed air only for the above air supply. This allows for the fire extinction and the air supply, resulting in the fire extinguisher 1 which is reduced in weight.

Further, in the invention, the compressed air is depressurized and led from the pressure-source fluid container 2 to the extinguishant containers 3 and 4, with the result that the amount of the compressed air led from the pressure-source fluid container 2 to the extinguishant containers 3 and 4 is smaller than that in the fire extinguisher 1 of the first related art. The breathing apparatus 10 can therefore supply the wearer with a larger amount of the compressed air as compared to the fire extinguisher of the first related art. This enables the wearer to stay longer in a fire location, etc., to battle the fire without worrying about the lack of oxygen as compared to the case of using the fire extinguisher of the first related art.

Further, according to the fire extinguisher 1 of the embodiment, the back flow prevention valve 11 can prevent the extinguishant from flowing backward to the pressure reducing valve 6. The extinguishant can be thus prevented from being led by the breathing apparatus and ejected to the face cover 37 through the lung power valve 35. The wearer can therefore feel safe to breathe by use of the breathing apparatus 10. It is thus possible to attain the fire extinguisher 1 which can supply such air that the wearer can feel safe to breathe and which can discharge the extinguishant from the discharge means 7.

Further, according to the fire extinguisher 1 of the embodiment, the down flow prevention valve 12 prevents the compressed air led to the extinguisher containers 3 and 4 from flowing down the extinguisher tube 8 and thus being discharged from the discharge means 7 when the extinguisher dischargeable from the extinguisher containers 3 and 4 is used up. If the compressed air continues to be discharged after the extinguishant is used up, the compressed air in the pressure-source fluid container 2 is wasted. When the pressure-source fluid is prevented from being discharged by use of the down flow prevention valve 12, the waste of the compressed air as above can be cut down.

As compared to the case where the down flow prevention valve 12 is not provided, a length of time for the air to be supplied from the gas supply means can be increased by cutting down the waste of the compressed air after the extinguishant is used up in the case where the breathing apparatus 10 is provided. It is therefore possible to stay in the fire location longer as compared to the case where no down flow prevention valve is provided. In the fire location, the wearer may search for the to-be-extinguished object to battle the fires while breathing with the use of the breathing apparatus 10. Since the fire fighting operation is carried out while the to-be-extinguished object is searched for, it is important for the fire extinguisher having the gas supply function to extend the available length of time for air supply.

Further, according to the fire extinguisher 1 of the embodiment, the aqueous solution having the resin dissolved therein is used as the extinguishant, which resin becomes higher in viscosity as its temperature rises, with the result that the extinguishant attached to the to-be-extinguished object can be therefore prevented from flowing etc., and thus being spread out, so that a larger amount of the extinguishant can stay around the to-be-extinguished object as compared to water. When the large amount of the extinguishant stays, an increased amount of heat will be absorbed, thus allowing for enhancement of the cooling effect for the to-be-extinguished object. The fire-extinguishing performance can be therefore higher than those of the fire extinguishers of the first and second related arts. When the fire-extinguishing performance is enhanced, the fire can be put out with use of a small amount of the extinguishant, with the result that the volume of the extinguishant to be retained in the extinguishant containers 3 and 4 can be smaller. This allows for a decrease in the weight of the extinguishant containers 3 and 4 and thus a decrease in the weight of the fire extinguisher 1. Moreover, the low viscosity of the extinguishant allows for a decrease in the pressure required for discharging the extinguishant which flows down the extinguishant tube 8, with the result that the pressure of the compressed air to be led to the extinguishant containers 3 and 4 can be reduced. The extinguishant containers 3 and 4 are therefore not required to have higher pressure resistance and can be thinner-walled.

Further, according to the fire extinguisher 1 of the embodiment, the frame 45 can hold the pressure-source fluid container 2 and the extinguishant containers 3 and 4 upright. The pressure-source fluid container 2 and the extinguishant containers 3 and 4 will therefore not be laid on the ground, for example, and the surfaces of these containers can be prevented from being damaged. The prevention of such damages can inhibit the containers 2 through 4 from bursting.

Further, according to the fire extinguisher 1 of the embodiment, the communication hole 23 of the siphon 22 is located higher than the extinguishant level in the state where the extinguishant containers 3 and 4 are upright. The compressed air can be therefore prevented from passing through the extinguishant. When the compressed air passes through the extinguishant, the air bubbles are generated in the extinguishant flowing down the extinguishant tube 8 which bubbles disturb the discharge of the extinguishant. Such a problem as just described is overcome by preventing the compressed air from passing through the extinguishant so that the extinguishant can be stably discharged. Further, when the communication hole 23 is formed, the extinguishant can be prevented from flowing into the siphon 22 and being led to the pressure-source fluid tube 5.

Further, according to the fire extinguisher 1 of the embodiment, the pressure-source fluid container 2 and the two extinguishant containers 3 and 4 arranged as above are arranged so as to be symmetrical with respect to a virtual plane which includes the axis line of the pressure-source fluid container 2 and is perpendicular to a transverse direction thereof. Accordingly, when the wearer carries the fire extinguisher 1 on one's back, the center of gravity can be prevented from being shifted rightward and leftward. This can result in a decrease in the fatigue upon fighting the fires. Further, when the base of the isosceles triangle formed by connecting the axis lines of the three containers 2 through 4 is longer than the other two sides, the gravity center is prevented from being shifted backward on the wearer's back, which can result in a decrease in the fatigue upon fighting the fires.

Further, according to the fire extinguisher 1 of the embodiment, the aqueous solution having the resin dissolved therein is sprayed as the extinguishant to the to-be-extinguished object, which resin becomes higher in viscosity as its temperature rises, with the result that the to-be-extinguished object can be covered with gelled extinguishant having higher viscosity. The to-be-extinguished object can be thus covered to lower oxygen concentration and a temperature around the to-be-extinguished object, being then able to be extinguished.

Further, according to the fire extinguisher 1 of the embodiment, the extinguishant containers 3 and 4 are filled with the extinguishant in a manner that no bubbles are generated. It is therefore possible to prevent a decrease in the fire-extinguishing efficiency resulting from the bubbles generated in the extinguishant.

Further, according to the fire extinguisher 1 of the embodiment, the extinguishant containers 3 and 4 are covered with the cover members 46 and 47 while the pressure-source fluid container 2 is exposed. Such exposure of the pressure-source fluid container 2 can remind that the pressure-source fluid container 2 should be treated with care.

Further, in the pressure reducing valve 6, the two spring members 122 and 121 bias the pressure receiving member 116 with elastic force. The pressure receiving member 116 can be thus biased with stable elastic force so that the pressure receiving member 116 can be prevented from suddenly changing.

Further, the spray nozzle 29 can spray the extinguishant annularly to spread the extinguishant over a wide range of the to-be-extinguished object. Furthermore, when the spray nozzle 29 is displaced in a direction parallel to an axis line thereof, an angle of the extinguishant to be sprayed relative to the axis line can be changed so that the extinguishant can be sprayed at a spray angle suitable for the to-be-extinguished object.

By using the fire extinguisher 1 according to the embodiment, it is possible to effectively carry out an initial fire fighting operation with a small amount of the extinguishant and compressed air in a location where it is difficult to secure water. The fire extinguisher 1 is particularly effective for extinguishing, for example, a vehicle fire on an expressway, a forest fire, a fire in a crowded residential area which is difficult for a vehicle to enter, a fire in a large-scale disaster area, a fire in an area with roads blocked, and fires in a factory and a building.

In the embodiment, the use of the extinguishant as described above allows for an effect of preventing reignition by virtue of its attachment to the to-be-extinguished object, so that an excellent fire-extinguishing ability can be exhibited. Further, in the embodiment, the compressed air is retained in the pressure-source fluid container 2 so that only the extinguishant flows into the extinguishant tube 8 during the fire fighting operation, thus preventing the compressed air from being undesirably wasted, and allowing for an increase as much as possible in the remaining amount of air inside the pressure-source fluid container 2 for the wearer to breathe. Further, the compressed air depressurized by the pressure reducing valve 6 is used to spray the extinguishant, resulting in a small recoil force upon the discharge and thus enabling the fire fighting operation with one hand gripping the discharge means 7, i.e., the hand gun. Further, it is possible to reduce dispersal of the to-be-extinguished object caused by extinguishant jets.

Further, the use of the extinguishant as described above can enhance the fire-extinguishing efficiency even with a small amount of the extinguishant; have such a weight that the fire extinguisher 1 can be carried on one's back; and enhance the fire-extinguishing ability. Furthermore, only the extinguishant is adapted to flow into the extinguishant tube 8 during the fire fighting operation, thereby preventing an increase in the volume even when the self-feeding breathing apparatus and the pressure-source fluid container 2 are used together, and allowing for an increase in the portability. Further, the use of the pressure reducing valve 6 eliminates the need to use pressure containers for the extinguishant containers 3 and 4 which can be thus reduced in weight.

Figure 27:
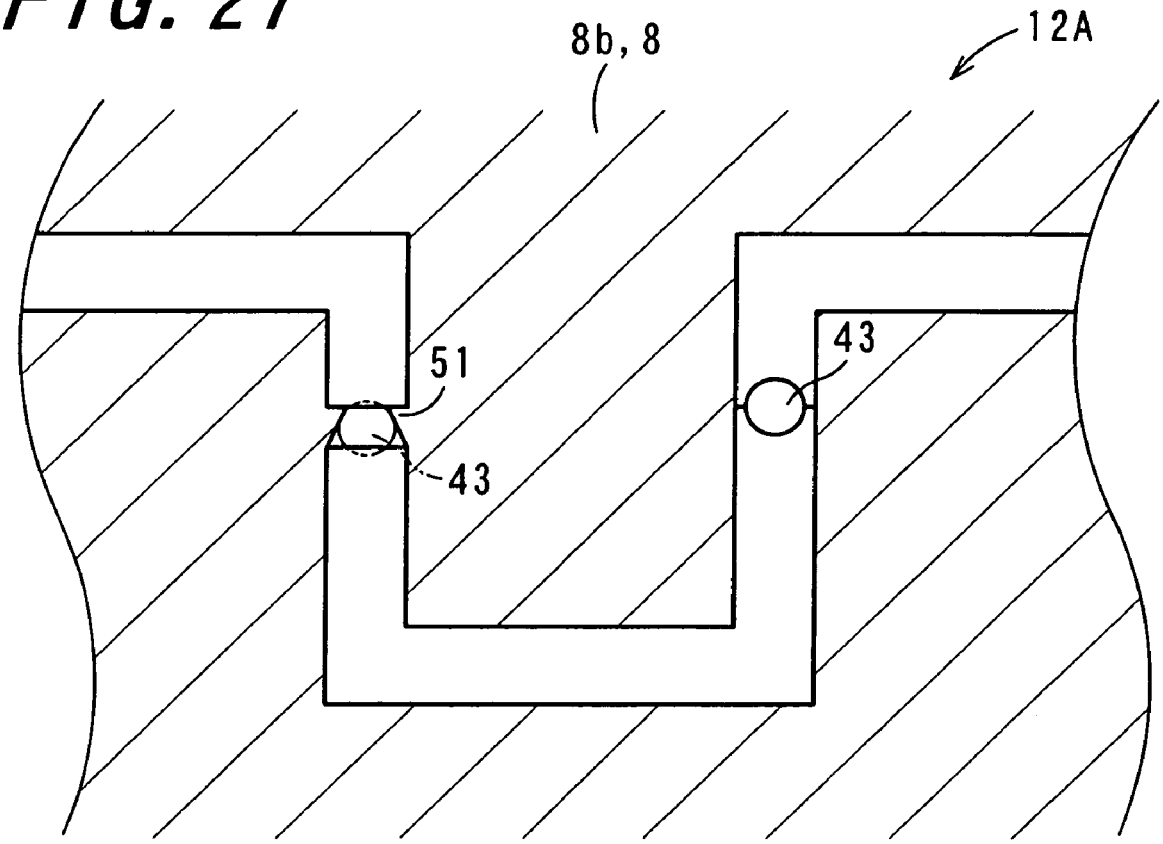
FIG. 27 is a sectional view schematically showing down flow prevention means 12A included in a fire extinguisher according to a second embodiment of the invention.

FIG. 27 is a sectional view schematically showing down flow prevention means 12A included in a fire extinguisher according to a second embodiment of the invention. The fire extinguisher according to the present embodiment is similar to the above-described fire extinguisher 1 according to the first embodiment. In the fire extinguisher according to the present embodiment, the above-described down flow prevention valve 12 is replaced by a down flow prevention valve 12A described as follows.

The down flow prevention valve 12A intervenes in the second extinguishant tube portion 8*b*. By use of the down flow prevention valve 12A, the compressed air flowing down from the two extinguishant containers 3 and 4 can be prevented from flowing down to the discharge means 7 and being discharged therefrom.

To explain in more detail, the down flow prevention valve 12A includes the float 43 and a flange part 51 formed in the second extinguishant tube portion 8*b*. The float 43 is provided inside the extinguishant tube 8. The flange part 51 is formed so as to protrude inward over an entire length of inner periphery of the second extinguishant tube portion 8*b*. An inner periphery of the flange part 51 thus formed is formed to have a diameter which is smaller than that of the inner periphery of the second extinguishant tube portion 8*b*. The float 43 is formed into a sphere shape and made of a material which has smaller density than that of the extinguishant. The float 43 is formed to have a diameter which is larger than the inner diameter of the flange part 51 and which is smaller than the inner diameter of the extinguishant tube 8.

When the extinguishant retained is used up, the float 43 moves inside the extinguishant tube 8 toward the flange part 51 with the aid of the compressed air. When reached the flange part 51, the float 43 is seated on the flange part 51 to close a channel formed in the extinguishant tube 8 (In FIG. 27, the float is drawn in two-dot chain lines) so that the compressed air is prevented from flowing down the second extinguishant tube portion 8*b*.

According to the fire extinguisher of the embodiment, there is no need to provide the down flow prevention valves 12A in the respective extinguishant containers 3 and 4, thus allowing the fire extinguisher to have a simpler configuration. Further, the down flow prevention valve 12A is disposed upstream in the A1 direction, of a branching point from which the pressure-source fluid tube 5 is diverged, so that the compressed air can be prevented at once from being led to the extinguishant containers 3 and 4, thereby enabling to keep a state where the lateral weight balance is maintained.

Figure 28:
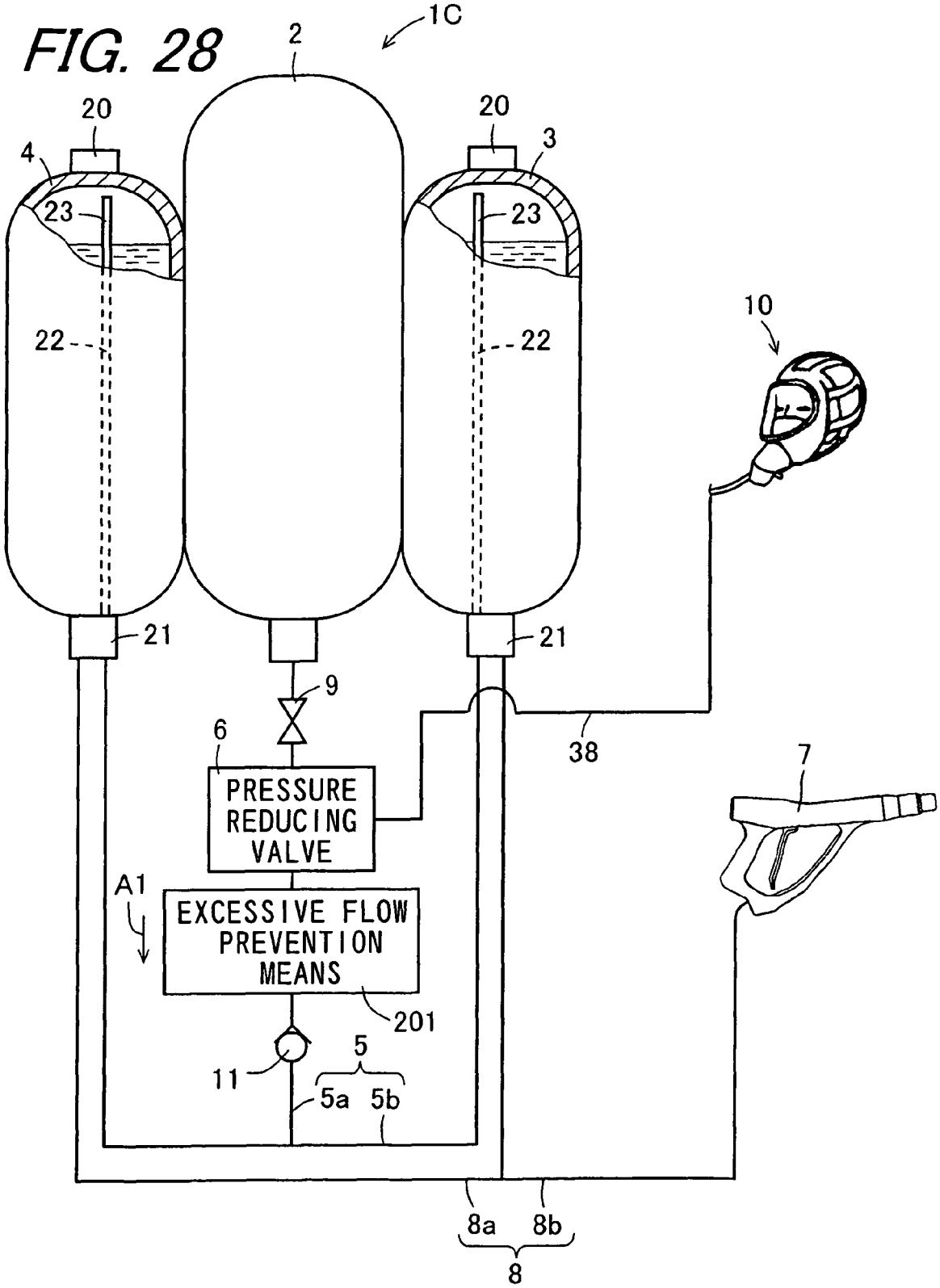
FIG. 28 is a system diagram schematically showing a configuration of a fire extinguisher 1C according to a third embodiment of the invention.
Figure 29:
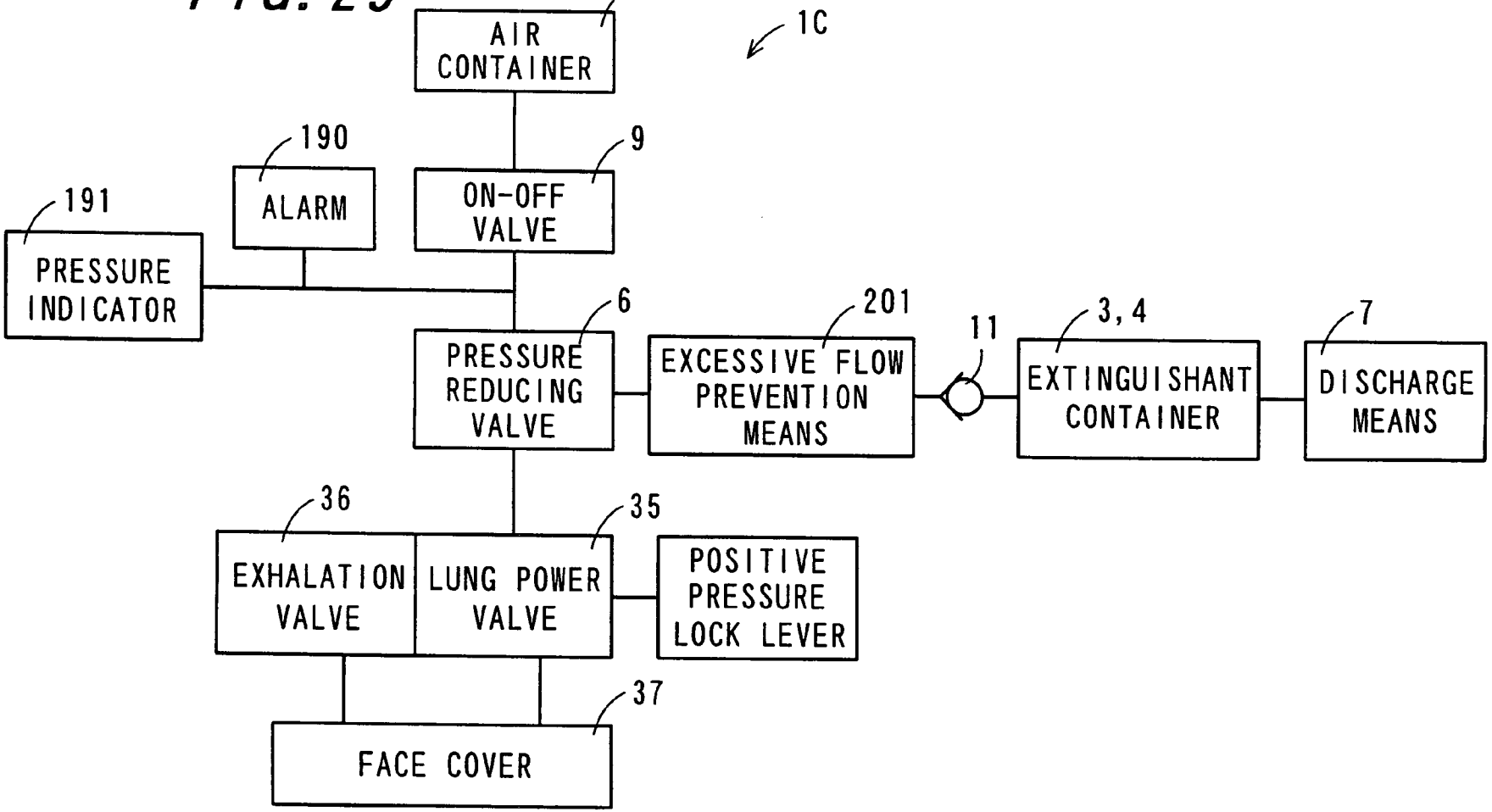
FIG. 29 is a block diagram showing a configuration of the fire extinguisher 1C.

FIG. 28 is a system diagram schematically showing a configuration of a fire extinguisher 1C according to a third embodiment of the invention. FIG. 29 is a block diagram showing a configuration of the fire extinguisher 1C. The fire extinguisher 1C according to the present embodiment is similar to the above-described fire extinguisher 1 according to the first embodiment. In the fire extinguisher 1C according to the present embodiment, the above-described down flow prevention valve 12 is replaced by excessive flow prevention means 201 described as follows, and the above-described back flow prevention valve 11 is replaced by a back flow prevention valve 11A described as follows.

The excessive flow prevention means 201 intervenes in the first pressure-source fluid tube portion 5*a*. The excessive flow prevention means 201 is provided downstream of the pressure reducing valve 6 in the A1 direction and upstream of the back flow prevention valve 11A in the A1 direction. The excessive flow prevention means 201 as just stated prevents the compressed air from flowing down the first pressure-source fluid tube portion 5*a* when the flow volume of the compressed air flowing down the first pressure-source fluid tube portion 5*a* reaches the predetermined set flow volume or more.

Figure 30:
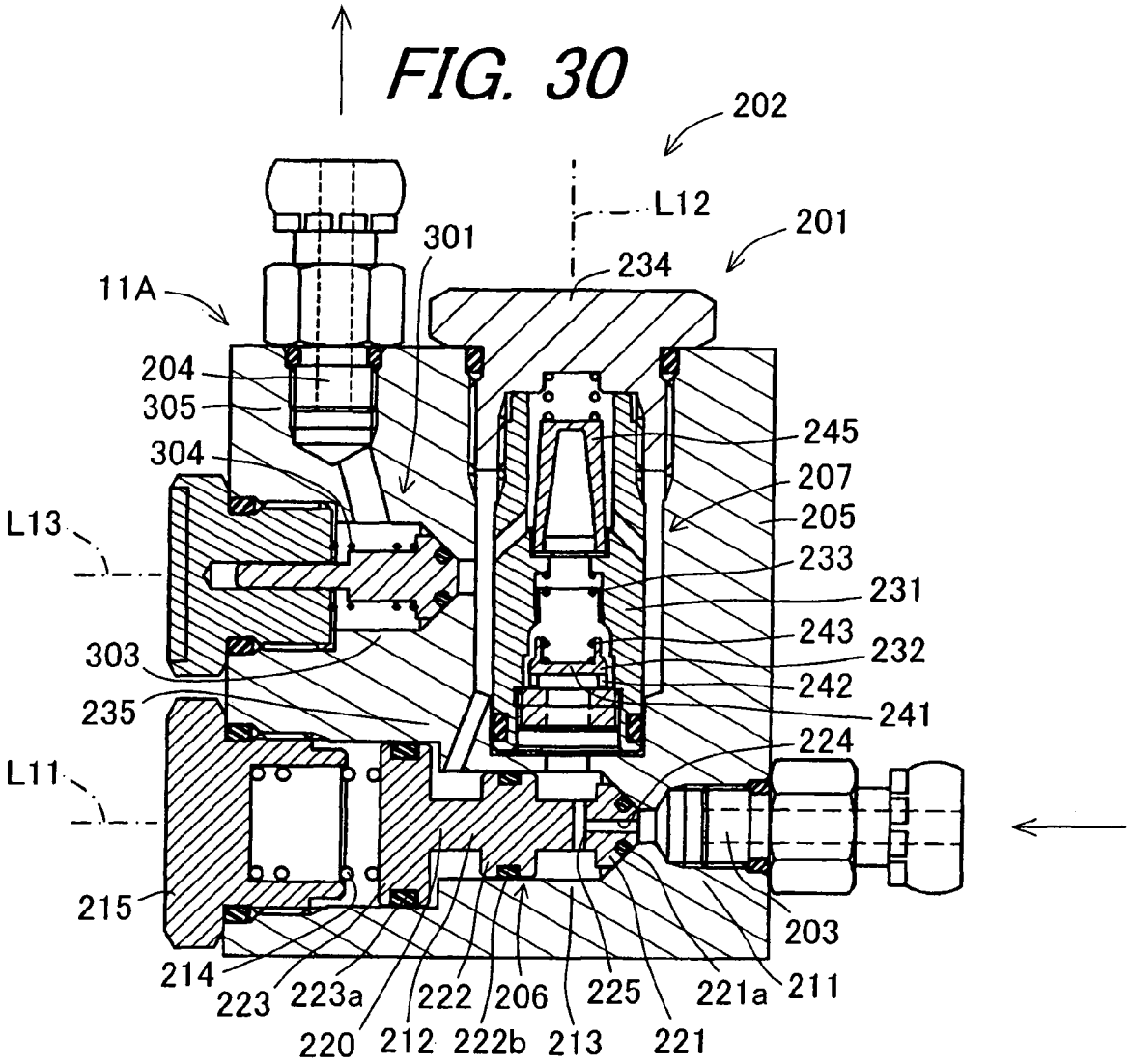
FIG. 30 is a sectional view showing a back flow prevention valve 11A and excessive flow prevention means 201.

FIG. 30 is a sectional view showing the back flow prevention valve 11A and the excessive flow prevention means 201. In the embodiment, the back flow prevention valve 11A and the excessive flow prevention means 201 are incorporated into one valve composite 202. The valve composite 202 intervenes in a part of the pressure-source fluid 5 which part is located downstream of the pressure reducing valve 6 in the A1 direction. In the valve composite 202, an inlet port 203 and an outlet port 204 are formed, and a housing portion 205 is fixed to the back plate 150. The pressure-source fluid tube 5 leads to the inlet port 203 of the valve composite 202 the compressed air which is depressurized by the pressure reducing valve 6, and leads to the respective extinguishant containers 3 and 4 the compressed air which is ejected from the outlet port 204 of the valve composite 202.

The excessive flow prevention means 201 includes a reducing structure 206 for reducing a down flow rate of the compressed air when the down flow is started, and an excessive flow prevention structure 207 for closing a tube when the down flow rate of the compressed air becomes excessive. The reducing structure 206 includes an inlet port forming portion 211, a reducer 212, a first housing space forming portion 213, a reducing spring member 214, and a first housing space closing portion 215. The reducing structure 206 is formed in a part of the valve composite 202, and a first axis line L11 is set.

The inlet port forming portion 211 defines the inlet port 203 that is a space to which the compressed air is led from the pressure-source fluid tube 5. The first housing space forming portion 213 continues into the inlet port 203; has the first axis line L11 as a central axis line; and forms the first housing space having a stepped cylindrical columnar shape. The first housing space is formed so that a diameter of the first-axially one-side region is smaller than that of the first-axially other-side region. Further, a first-axially one end of the first housing space forming portion 213 has a conical surface of which diameter is smaller as advanced in one way along the first axis line. On the first-axially other end of the first housing space forming portion 213, an opening is formed which opens the first housing space in the other way along the first axis line. The first housing space contains the reducer 212 and the reducing spring member 214, and has its opening closed by the first housing space closing portion 215.

The reducer 212 has a cylindrical columnar base 220 and first to third protruding parts 221, 222, and 223 which protrude from the base 220 radially over an entire periphery thereof. The first protruding part 221 continues into an axially one end of the base 220 and has a substantially conical outline. The second protruding part 222 continues into an axially middle part of the base 220 and has a substantially cylindrical columnar outline. The third protruding part 223 continues into an axially other end part of the base 220 and has a substantially cylindrical columnar outline. The first protruding part 221 and the second protruding part 222 are spaced and arranged along the axis line of the base 220. The second protruding part 222 and the third protruding part 223 are spaced and arranged along the axis line of the base 220. The third protruding part 223 has a larger diameter than that of the second protruding part 222.

The reducer 212 is housed in the first housing space so as to have an axis in common with the first housing space and configured so as to be displaced along the first axis line. Further, the first protruding part 221 and the second protruding part 222 are disposed in a first-axially one-side region of the first housing space while the third protruding part 223 is disposed in the first-axially other-side region of the first housing space. Outer peripheral surfaces of the second protruding part 222 and the third protruding part 223 are provided with sealing members 222*a* and 223*a* which elastically contact an inner peripheral surface of the first housing space forming portion 213 over an entire perimeter thereof. Inside the first housing space, spaces sectioned by the respective protruding parts 222 and 223 can be thus sealed having the compressed air therein. Further, in the base 220 of the reducer 212, an insertion hole 224 is formed which extends along the central axis line from an axially one end surface to a region located on an axially one side of the second protruding part 222, and a through hole 225 which continues into the insertion hole 224 and radially penetrates a region between the first protruding part 221 and the second protruding part 222. The insertion hole 224 and the through hole 225 are formed into thin holes whose diameters are sufficiently smaller than the diameter of the first housing space.

Further, a conical surface of the first protruding part 221 is provided with a sealing member 221*a* which can elastically contact a side surface on first-axially one side of the first housing space forming portion 213 over an entire perimeter thereof. When the reducer 212 is pressed in one way along the first axis line, the conical surface of the first housing space forming portion 213 contacts the sealing member 221*a* of the first protruding part 211 in the reducer 212, with the result that the compressed air is prevented from passing between the conical surface of the first housing space forming portion 213 and the first protruding part 221 of the reducer 212. In this case, the compressed air inside the inlet port 203 passes through a first path which includes the insertion hole 224 and the through hole 225 in the base 220, and moves to a space between the first protruding part 221 and the second protruding part 222.

Further, the reducer 212 moves in the other way along the first axis line whereby the conical surface of the first housing space forming portion 213 and the sealing member 221*a* of the first protruding part 221 in the reducer 212 are spaced away, thus allowing the compressed air to pass between the reducer 212 and the first protruding part 221. In this case, the compressed air inside the inlet port 203 passes through the first path which includes the insertion hole 224 and the through hole 225 in the base 220, and moreover passes through a second path which includes an area between the conical surface of the first housing space forming portion 213 and the first protruding part 221 of the reducer 212, thus moving to the space between the first protruding part 221 and the second protruding part 222. The second path has a channel sectional area larger than that of the first path so that a large part of the compressed air passes through the second path.

The reducing spring member 214 is a helical compression spring and housed in the first housing space so as to have an axis in common with the first housing space as being supported by the first housing space closing portion 215. The reducing spring member 214 is disposed in the first-axially other-side region of the first housing space so that the first-axially one end thereof contacts the reducer 212 while the first-axially other end thereof contacts the first housing space closing portion 215. The reducing spring member 214 elastically presses the reducer 212 in one way along the first axis line. The first housing space is sectioned by the third protruding part 223 of the reducer 212 whereby a one-side region and the other-side region along the axis line of the third protruding part 223 will be sealed. In the embodiment, a space is maintained at atmospheric pressure which space is positioned on the first-axially other-side of the third protruding part 223 and in which space the reducing spring member 214 is disposed. When the pressure in the space on a first-axially one side of the third protruding part 223 exceeds the predetermined first set value, the reducer 212 is displaced to the first-axially other side so as to counter the spring force of the reducing spring member 214, by means of force which is generated by a difference between pressures on both sides of the third protruding part 223.

The excessive flow prevention structure 207 includes a second housing space forming portion 231, an excessive flow prevention valve element 232, an excessive flow preventing spring member 233, a second housing space closing portion 234, and an introduction space forming portion 235. The excessive flow prevention structure 207 is formed in a part of the valve composite 202, and a second axis line L12 is set.

The second housing space forming portion 231 has the second axis line L12 as a central axis line; continues into the first housing space; and forms the second housing space having a stepped cylindrical columnar shape. The second housing space continues into the space between the first protruding part 221 and the second protruding part 222 in the reducer 212 contained in the first housing space. Further, the second housing space is formed so that a diameter of the second-axially one-side region is larger than that of the second-axially other-side region. Further, on the axial other end of the second housing space forming portion 231, an opening is formed which opens the second housing space in the other way along the axis line. The second housing space contains the excessive flow prevention valve element 232 and the excessive flow preventing spring member 233, and has its opening closed by the second housing space closing portion 234.

The excessive flow prevention valve element 232 includes a valve element 241, a positioning piece 242, and a spring support piece 243. The valve element 241 is formed into a disc shape. Further, the positioning piece 242 is provided for positioning the valve element 241 and protrudes from the valve element 241 to one side in a thickness direction. Further, the spring support piece 243 is provided for supporting the excessive flow preventing spring member 233 and protrudes from the valve element 241 to the other side in a thickness direction.

The valve element 241 is housed in the second housing space so as to have an axis identical to the second axis line L12, and configured so as to be capable of being displaced along the second axis line. Further, the valve element 241 is located in the second-axially one-side region of the second housing space, and formed so as to be larger than a sectional area of the middle region of the second housing space as viewed along the second direction. The positioning piece 242 contacts a second-axially one end surface of the second housing space forming portion 231, whereby a gap is formed between the valve element 241 and the end surface and inner peripheral surface of the second housing space forming portion 231. In this state, the gap between the valve element 241 and the inner peripheral surface of the second housing space forming portion 231 is formed to be sufficiently small as compared to the sectional area of the second housing space.

The excessive flow preventing spring member 233 is a helical compression spring and housed in the second housing space so as to have an axis in common with the second housing space as being supported by the second housing space forming portion 231. The excessive flow preventing spring member 233 is disposed in the second-axially other-side region of the second housing space so that the second-axially one end thereof contacts the reducer 212 while the second-axially other end thereof contacts the second housing space forming portion 231. The excessive flow preventing spring member 233 elastically presses the excessive flow prevention valve element 232 in one way along the second axis line. At this time, the positioning piece 242 of the excessive flow prevention valve element 232 contacts the end surface of the second housing space forming portion 231, thereby maintaining the gap formed between the valve element 241 and the end surface and inner peripheral surface of the second housing space forming portion 231. This allows the compressed air to move from the first housing space into the middle region of the second housing space.

Further, when the pressure in the middle region of the second housing space relative to the region on the axially one side becomes lower than a predetermined second set value, the valve element 241 is displaced to the second-axially other side so as to counter the spring force of the excessive flow preventing spring member 233, by means of force which is generated by a difference between pressures on both sides of the valve element. And then, the valve element 241 is seated on a valve seat which is formed on a stepped part of the second space forming portion. The valve element 241 thus seals the gap between the axially one-side region and middle region in the second housing space, thereby preventing the compressed air from flowing through the second housing space.

Further, the middle region of the second housing space continues into the second-axially other-side region of the second housing space. The compressed air having passed through the middle region of the second housing space passes through the filter member 245 and moves to the second-axially other side region of the second housing space. Further, the introduction space forming portion 235 defines an introduction space. The introduction space continues into a space which is surrounded by the second-axially other side region of the second housing space and the second protruding part 222 and third protruding part 223 in the reducer 212 contained in the first housing space.

The back flow prevention valve 11A is realized by a back flow prevention valve structure 301 in order to prevent the extinguishant from flowing backward to the pressure-source fluid container 2 from the extinguishant containers 3 and 4. The back flow prevention valve structure 301 includes a back flow prevention valve element 302, a third housing space forming portion 303, a back flow prevention valve spring member 304, and an outlet port forming portion 305. The reducing structure 206 is formed in a part of the valve composite 202, and a third axis line L3 is set.

The third housing space forming portion 303 continues into the introduction space, and forms a third housing space which has a third axis line L13 as a central axis line. Further, the outlet port forming portion 305 continues into the third housing space, and forms an outlet port 204 which is a space for leading the compressed air to the pressure-source fluid tube 5. The back flow prevention valve element 302 is housed in the third housing space, and configured so as to be capable of opening and closing a communication path between the introduction space and the third housing space. The flow prevention valve spring member 304 elastically presses the back flow prevention valve element 302 in such a direction that the communication path is closed by the back flow prevention valve element 302. Further, the back flow prevention valve element 302 receives the pressure of the third housing space. In the configuration as above, the back flow prevention valve element 302 maintains the communication path in a closed state even when the pressure in the introduction space becomes equal to the pressure in the third housing space. Further, when the pressure in the introduction space becomes higher than the pressure in the third housing space by the predetermined pressure, the difference in pressure causes displacement to counter the spring force of the back flow prevention valve, thereby setting a state where the communication path is open.

In a not-yet-supplied state where the compressed air has not been supplied from the inlet port 203, the pressure in the first to third housing spaces and respective ports 203 and 204 becomes atmospheric pressure. In this case, as shown in FIG. 30, in the reducing structure 206, the first protruding portion 221 of the base 220 contacts the first-axially one end of the first housing space forming portion 213. Further, in the excessive flow prevention structure 207, a gap is formed between the valve element 241 and the end surface and inner peripheral surface of the second housing space forming portion 231. Further, in the back flow prevention structure, the back flow prevention valve element 302 closes the communication path.

When the compressed air is supplied to the inlet port 203 in this state, the compresses air passes through the insertion hole 224 and the through hole 225 in the base 200 to thereby have the down flow rate decreased, resulting in a gradual increase in the pressure in the space between the first protruding part 221 and the second protruding part 222. The difference between the pressures on both sides of the valve element 241 in the excessive flow prevention structure 207 can be therefore prevented from rapidly changing. The gap formed between the valve element 241 and the second housing space forming portion 231 is maintained so that the compressed air passes through the second housing space and thereby flows into the introduction space.

The flow of the compressed air into the introduction space increases the pressure in the introduction space. This causes the back flow prevention valve to open the communication path so that the compressed air flows to the outlet port 204 through the third housing space. Further, the flow of the compressed air into the introduction space causes the compressed air to flow also to the second protruding part 222 and the third protruding part 223. In this case, a difference is generated between the pressures on both sides of the third protruding part 223, with the result that the reducer 212 moves to the other side along the first axis. This allows the compressed air to move from the inlet port 203 to the second housing space through the first path which includes the insertion hole 224 and the through hole 225 in the base 220, as well as the second path which includes an area between the conical surface of the first housing space forming portion 213 and the first protruding part 221 of the reducer 212.

As described above, the compressed air passes through the first path immediately after the compressed air is supplied. Further, when the pressure in the introduction space becomes sufficiently high, the compressed air passes through the first path and the second path. In the case of passing through the first path only, the compressed air is prevented from rapidly flowing into the second housing space, with the result that the second housing space can be prevented from being closed by the valve element 241 of the excessive flow prevention structure 207 immediately after the compressed air is supplied.

Further, in a supply state where the compressed air is stably supplied, the compressed air passes through the first path and the second path. When the remaining amount of the extinguishant is used up in this state to then cause the compressed air to be ejected from the discharge nozzle, the pressure downstream of the valve element 241 of the excessive flow prevention structure 207 is sharply reduced to generate a difference in pressure, whereby the valve element closes the second housing space. The discharge nozzle is thus prevented from spraying the compressed air so that the compressed air can be prevented from being wasted. Further, the valve structure of the embodiment can be switched into an initial state by suspending the supply of the compressed air to attain the atmospheric pressure in the inlet port 203 and the outlet port, which procedure eliminates the need to carry out a special operation.

For example, in the case of spraying the extinguishant, a flow volume of the compressed air flowing through the passage is 0.06 $m^3$/min (about 60 liters/min) while in the case of spraying the compressed air after using up the remaining amount of the extinguishant, a flow volume of the compressed air flowing through the passage is 0.2 $m^3$/min (about 200 liters/min). Since the flow volumes of the extinguishant and the compressed air become different from each other by approximately three times or more as described above, the setting of the valve for closing the passage can prevent the compressed air from being wasted in the case where the difference in the flow volume is large. In addition, although the excessive flow is prevented based on the difference in pressure between the extinguishant and the compressed air attributable to the difference in flow volume of the compressed air in the embodiment, other configurations may be employed to prevent the excessive flow.

Further, the reducing structure 206, the excessive flow prevention structure 207, and the back flow prevention structure 301 are integrally configured as the valve composite 202, thus reducing components to be connected with the pressure-source fluid tube 5 so that decreases in size and weight can be achieved.

Further, in an alternative example, the reducing structure, the excessive flow prevention structure, and the back flow prevention structure may be formed separately. Moreover, the excessive flow prevention means may be realized by a component other than the excessive flow prevention valve. For example, the excessive flow prevention means may be obtained by integrating flow volume detecting means, an on-off valve, and control means, and when the control means determines that the flow volume of the compressed air detected by the flow volume detecting means exceeds a predetermined set value, the control means gives a control command to the on-off valve so as to close the pressure-source fluid tube 5. This also can provide the same effects as the excessive flow prevention valve does. In addition, although the reducing structure is provided in the embodiment, the reducing structure does not have to be provided if the compressed air can be made to flow down slowly by the on-off valve immediately after the compressed air starts to be supplied.

Further, the excessive flow prevention structure is formed before the branch of the pressure-source fluid tube 5, thus eliminating the need of providing two excessive flow prevention structures, with the result that the configuration can be simplified. Moreover, the compressed air can be reliably prevented from being wasted so that the safety level can be enhanced. Further, in another embodiment, the excessive flow prevention structures may be formed respectively after the branch of the pressure-source fluid tube 5. In this case, even when the extinguishant in one extinguishant container 3 is used up, the extinguishant can be sprayed from the other extinguishant container 4.

Although the excessive flow prevention means 201 is used in the embodiment, the other on-off valve 246 may be used instead of the excessive flow prevention means 201. In this case, the wearer switches the other on-off valve 246 from the open state to the closed state when determining that the extinguishant in the extinguishant containers 3 and 4 has been used up.

Figure 31:
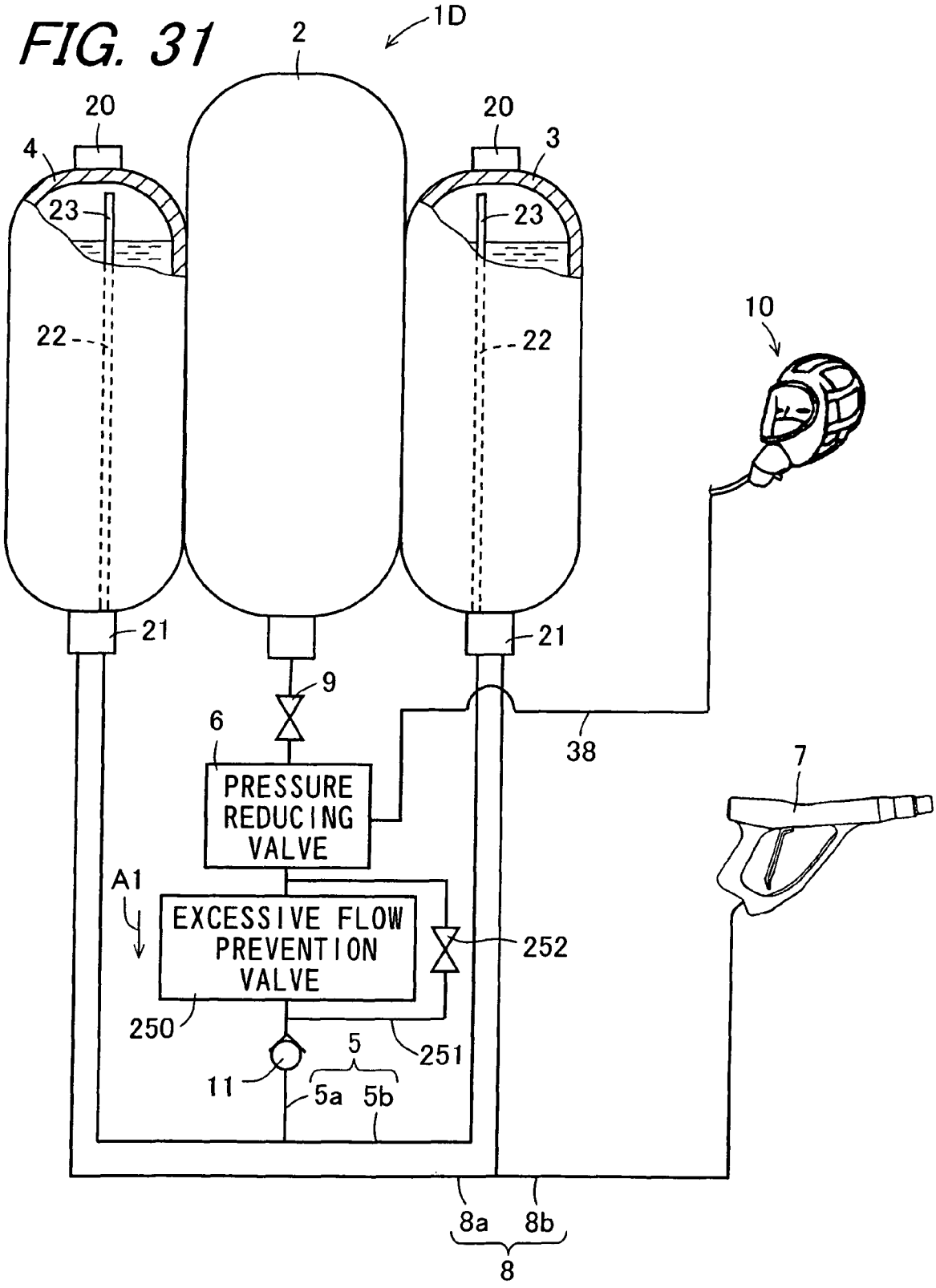
FIG. 31 is a system diagram schematically showing a configuration of a fire extinguisher 1D according to a fourth embodiment of the invention.

FIG. 31 is a system diagram schematically showing a configuration of a fire extinguisher 1D according to a fourth embodiment of the invention. The fire extinguisher 1D according to the present embodiment is similar to the above-described fire extinguisher 1 according to the first embodiment. In the fire extinguisher 1D according to the present embodiment, the above-described down flow prevention valve 12 is replaced by an excessive flow prevention valve 250 described as follows.

The excessive flow prevention valve 250 serving as the excessive flow prevention means intervenes in the first pressure-source fluid tube portion 5*a*. The excessive flow prevention means 201 is provided downstream of the pressure reducing valve 6 in the A1 direction and upstream of the back flow prevention valve 11 in the A1 direction. The excessive flow prevention valve 250 is realized so as to have the same configuration as that of the above-described excessive flow prevention structure 207 according to the third embodiment. The excessive flow prevention valve 250 as just stated prevents the compressed air from flowing down the first pressure-source fluid tube portion 5*a* when the flow volume of the compressed air flowing down the first pressure-source fluid tube portion 5*a* reaches the predetermined set flow volume or more.

The fire extinguisher 1D according to the present embodiment further includes a detour tube 251 which bypasses the excessive flow prevention valve 250, and a detour tube on-off valve 252 which intervenes in the detour tube 251 and configured so as to be capable of being switched between an open sate and a closed state. The detour tube 251 is diverged from a part of the first pressure-source fluid tube portion 5*a* which part is located between the pressure reducing valve 6 and the excessive flow prevention valve 250, and merges into a part of the first pressure-source fluid tube portion 5*a* which part is located between the excessive flow prevention valve 250 and the back flow prevention valve 11.

Before the compressed air is led from the pressure-source fluid container 2 to the extinguishant containers 3 and 4, the pressure inside the extinguishant containers 3 and 4 is the atmospheric pressure. In the case where the pressure inside the extinguishant containers 3 and 4 is the atmospheric pressure, the switching of the on-off valve 9 from the closed state to the open state may cause the compressed air in the amount more than the predetermined set flow volume to flow down into the first pressure-source fluid tube portion 5*a* even if the extinguishant is present inside the extinguishant containers 3 and 4. In view of this point, the detour tube 251 and the detour tube on-off valve 252 are provided.

In order to switch the on-off valve 9 from the closed state to the open state, the detour tube on-off valve 252 is opened firstly. In this state, the one-off valve 9 is switched from the closed state to the open state. At this time, a large part of the compressed air is led to the extinguishant containers 3 and 4 through the detour tube 251. The excessive flow prevention valve 250 can be therefore prevented from being undesirably operated. After the pressure inside the extinguishant containers 3 and 4 increases, the detour tube on-off valve 252 is switched from the open state to the closed state.

Figure 32:
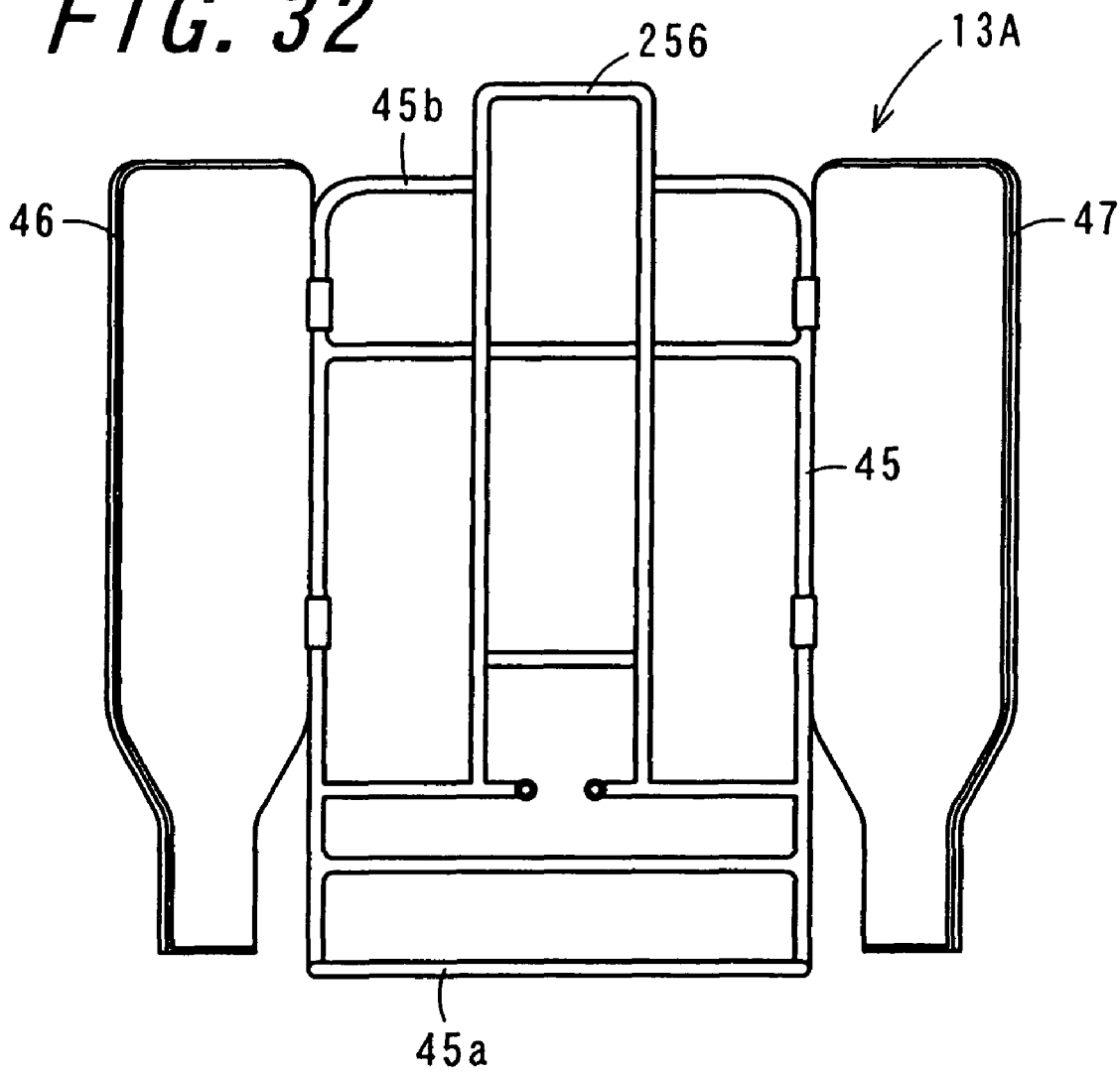
FIG. 32 is a front view showing a container holder 13A provided in a fire extinguisher according to a fifth embodiment of the invention.
Figure 33:
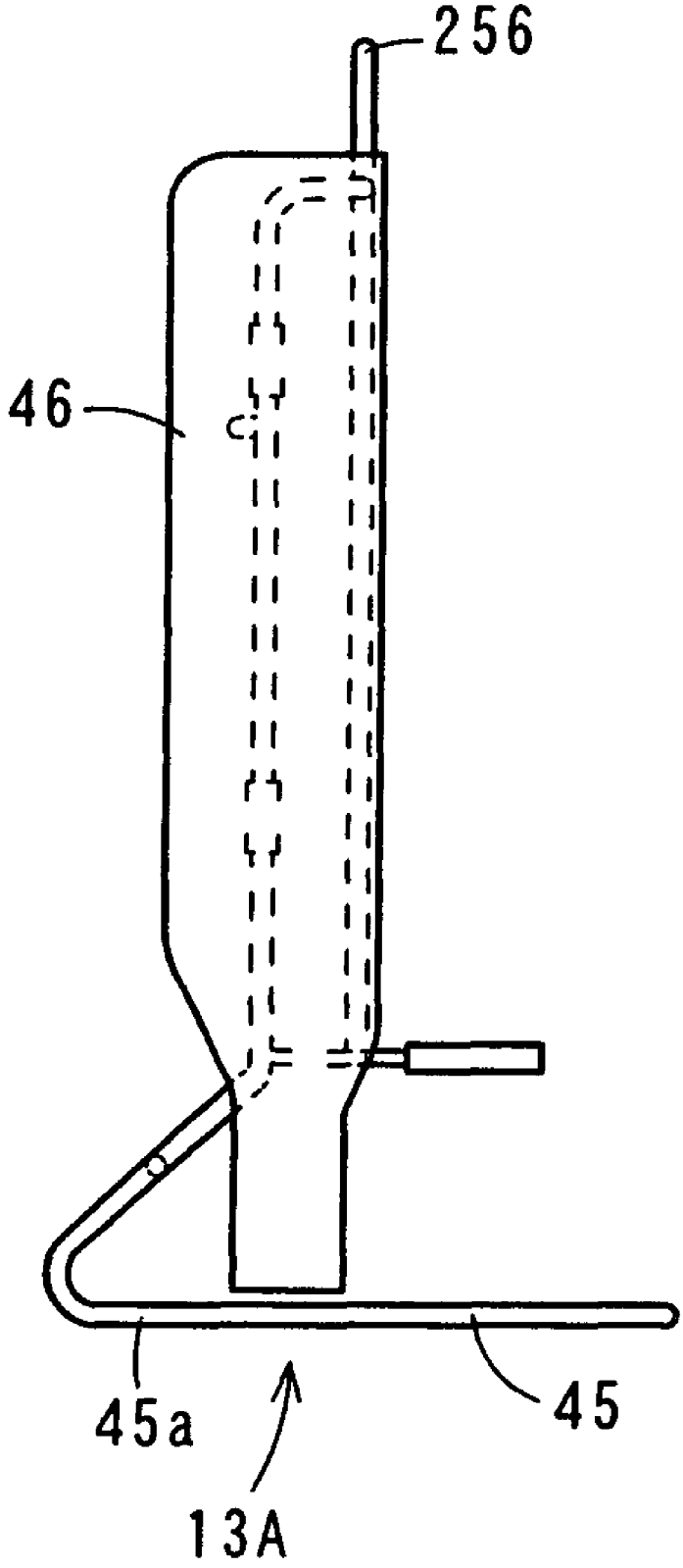
FIG. 33 is a left side view showing the container holder 13A viewed from a left side on the sheet of FIG. 32.
Figure 34:
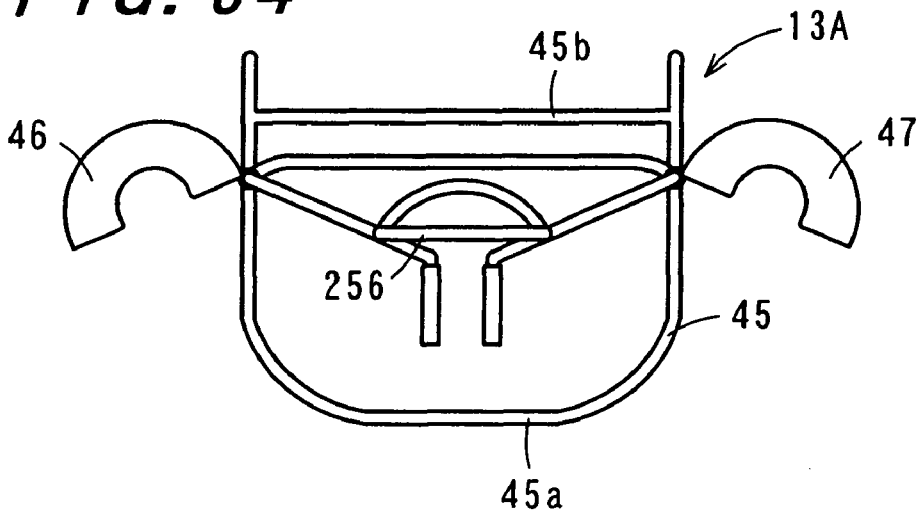
FIG. 34 is a plan view showing the container holder 13A viewed from an upside on the sheet of FIG. 32.
Figure 35:
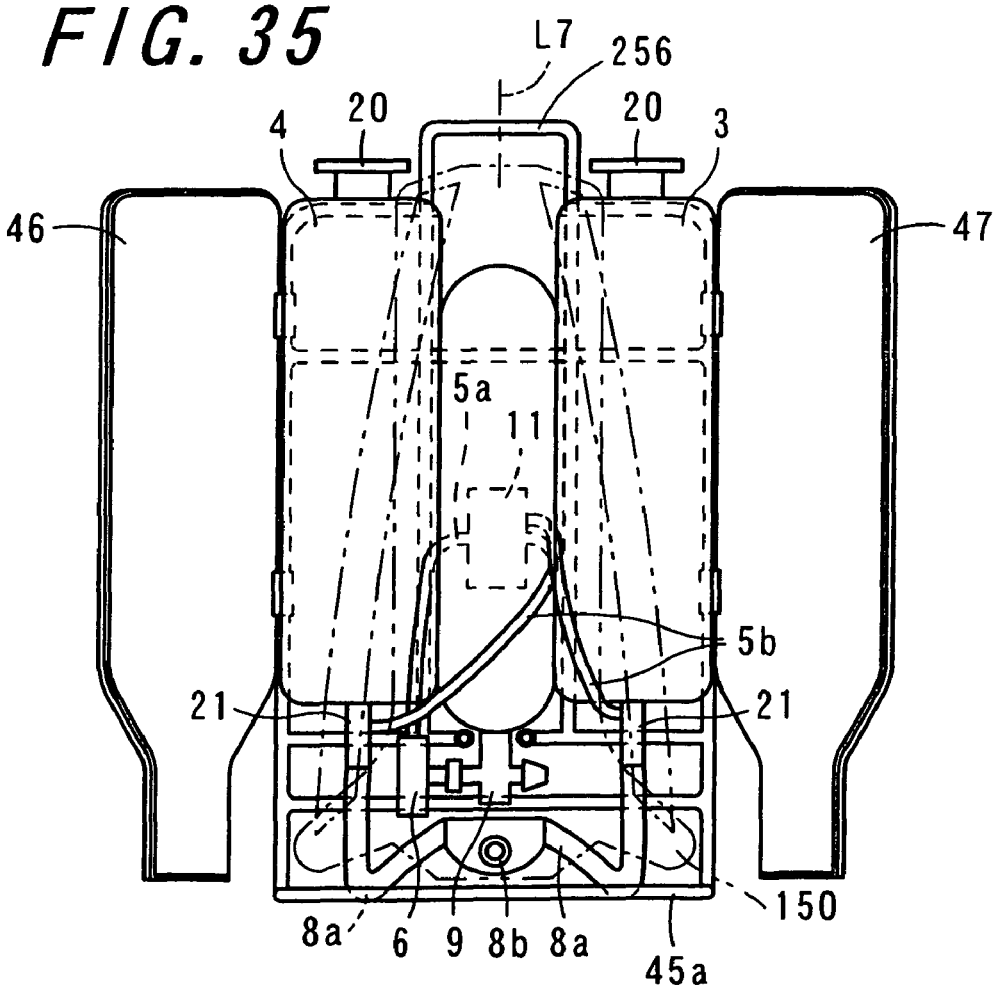
FIG. 35 is a front view showing a state where the pressure-source fluid container 2 and the extinguishant containers 3 and 4 are attached to the container holder 13A.

FIG. 32 is a front view showing a container holder 13A provided in a fire extinguisher according to a fifth embodiment of the invention, and this FIG. 32 shows the container holder 13A having the cover members 46 and 47 open. FIG. 33 is a left side view showing the container holder 13A viewed from a left side on the sheet of FIG. 32. FIG. 34 is a plan view showing the container holder 13A viewed from an upside on the sheet of FIG. 32. FIG. 35 is a front view showing a state where the pressure-source fluid container 2 and the extinguishant containers 3 and 4 are attached to the container holder 13A. Since the container holder 13A has a bilaterally symmetric structure on the sheet of FIG. 32, the container holder 13A viewed from a right side on the sheet of FIG. 32 is symmetrical to the container holder 13A viewed from the left side on the sheet of FIG. 32.

The fire extinguisher according to the present embodiment is similar to the above-described fire extinguisher 1 according to the first embodiment. In the present embodiment, the above-described container holder 13 is replaced by the container holder 13A described as follows. Since the container holder 13A used in the embodiment is similar to the above-described container holder 13, only different points will be explained.

The leg portion 45*a* of the frame 45 is formed so as to extend along a circular arc which centers on a user when the user wears the fire extinguisher. The leg portion 45*a* of the frame 45 can be thus prevented from causing interference with other objects when the user wearing the fire extinguisher moves.

In the trunk portion 45*b* of the frame 45, a handle part 256 is formed which protrudes above an upper part of the pressure-source fluid container 2 in a state where the pressure-source fluid container 2 is attached to the trunk portion 45*b* and which is configured so as to be capable of being gripped by the user. By virtue of the handle part 256 formed as above, the user can easily pick up the fire extinguisher by gripping the handle part 256.

On the handle part 256, a grip member may be provided. The grip member is provided so as to cover the handle part 256. In this case, the user will grip the grip member. In the case where the grip member is gripped, a contact area between the grip member and a user's hand is increased, with the result that force acting on the user's hand from the handle part 256 can be dispersed so that the grip member can be more easily gripped.

Figure 36:
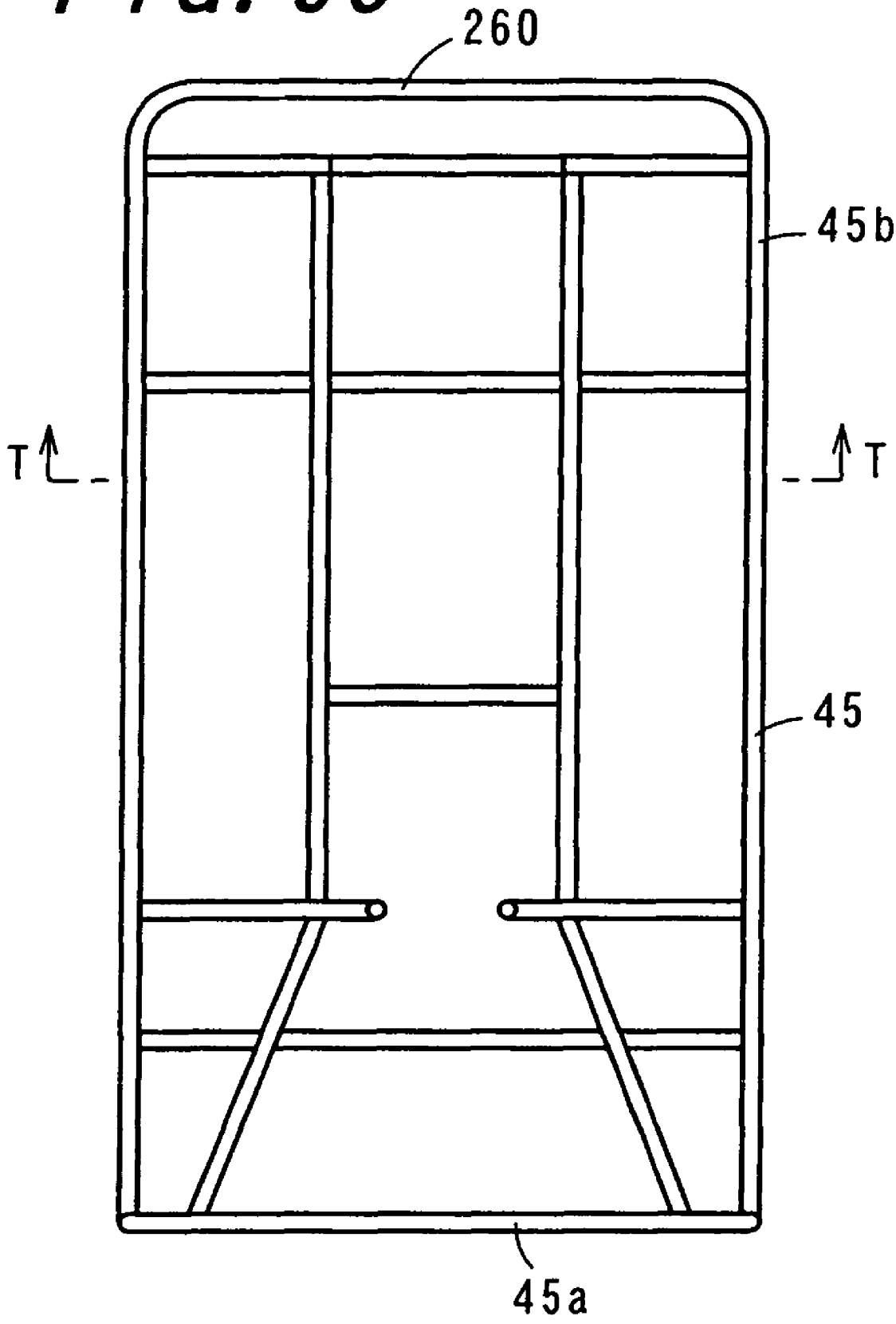
FIG. 36 is a front view showing a container holder 13B provided in a fire extinguisher according to a sixth embodiment of the invention.
Figure 37:
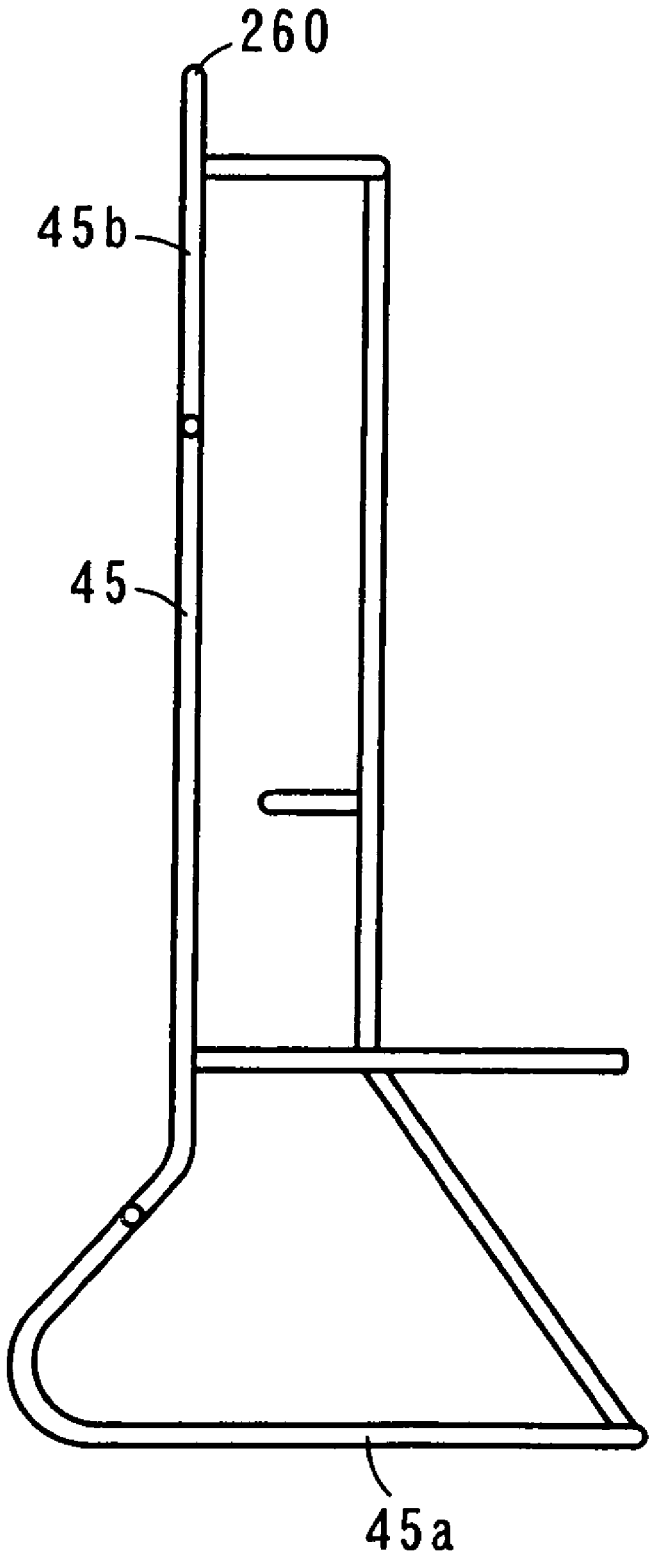
FIG. 37 is a left side view showing the container holder 13B viewed from a left side on the sheet of FIG. 36.
Figure 38:
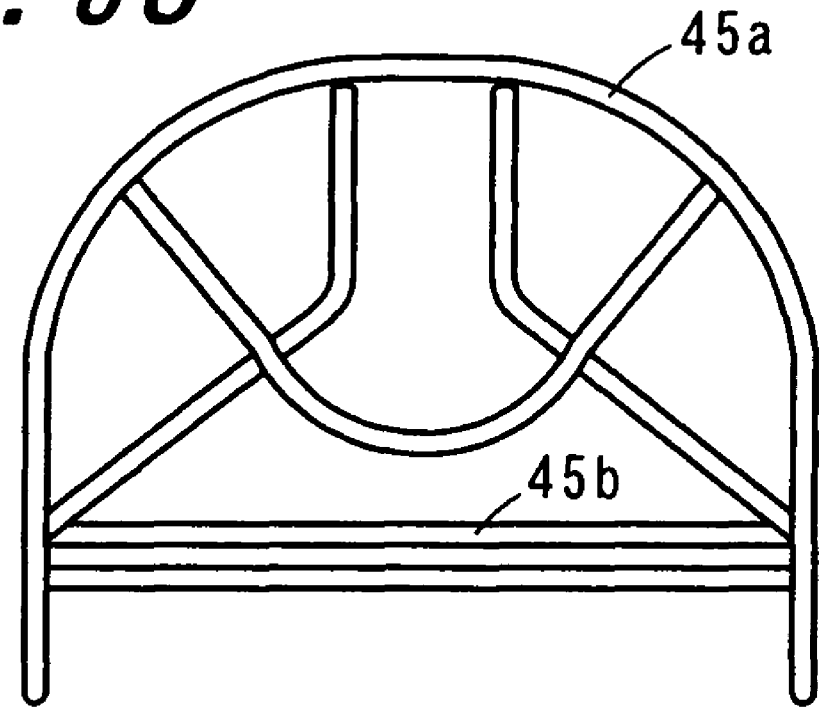
FIG. 38 is a bottom view showing the container holder 13B viewed from an upside on the sheet of FIG. 36.
Figure 39:
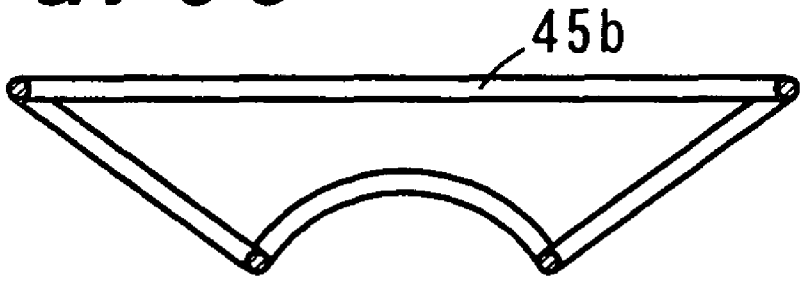
FIG. 39 is a sectional view taken on line T-T in FIG. 36.

FIG. 36 is a front view showing a container holder 13B provided in a fire extinguisher according to a sixth embodiment of the invention. FIG. 37 is a left side view showing the container holder 13B viewed from a left side on the sheet of FIG. 36. FIG. 38 is a bottom view showing the container holder 13B viewed from an upside on the sheet of FIG. 36. FIG. 39 is a sectional view taken on line T-T in FIG. 36. The fire extinguisher according to the present embodiment is similar to the above-described fire extinguisher according to the fifth embodiment. In the fire extinguisher according to the present embodiment, the above-described container holder 13A is replaced by the container holder 13B described as follows. The container holder 13B used in the present embodiment is similar to the above-described container holder 13A.

To be specific, the leg portion 45*a* of the frame 45 is formed so as to extend along a circular arc which centers on a user when the user wears the fire extinguisher, and in the trunk portion 45*b* of the frame 45, a handle part 260 is formed which protrudes above the upper part of the pressure-source fluid container 2 in a state where the pressure-source fluid container 2 is attached to the trunk portion 45*b* and which is configured so as to be capable of being gripped by the user. On the handle part 260, a grip member may be provided. In the embodiment as above, the same effects can be achieved as those obtained in the fifth embodiment.

Figure 40:
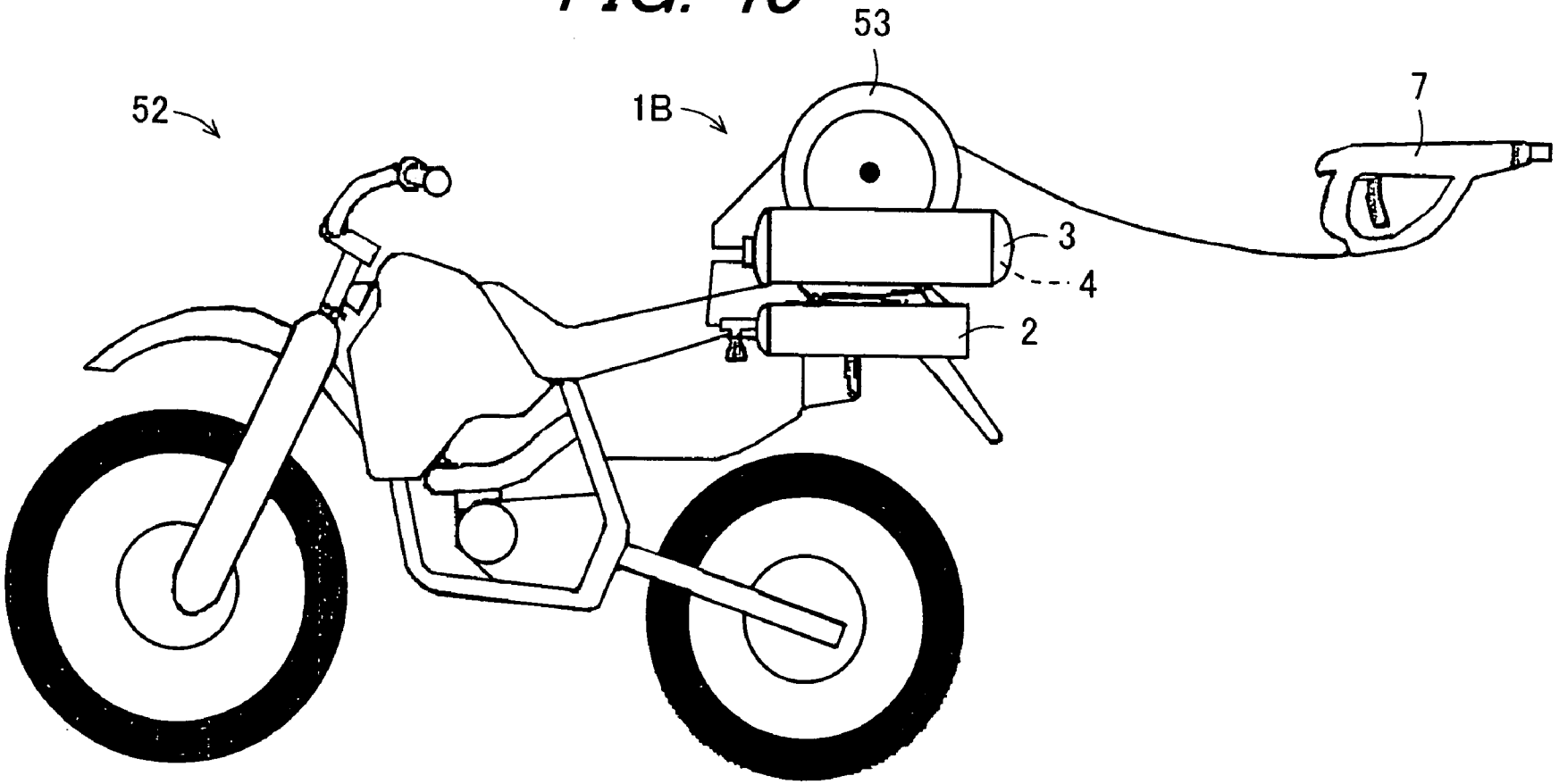
FIG. 40 is a view showing a fire extinguisher 1B according to a seventh embodiment of the invention.

FIG. 40 is a view showing a fire extinguisher 1B according to a seventh embodiment of the invention. The fire extinguisher 1B according to the present embodiment is similar to the above-described fire extinguisher 1 according to the first embodiment. The fire extinguisher 1B according to the present embodiment is carried on a two-wheeled vehicle 52. To be specific, the pressure-source fluid container 2 is carried on a backseat of the two-wheeled vehicle 52, and the extinguishant containers 3 and 4 are arranged respectively on both sides of the backseat. The two-wheeled vehicle 52 is provided with winding means 53 so that the extinguishant tube 8 can be wound and rewound. The extinguishant tube 8 is wound by the winding means 53 to be housed, and rewound when used.

Although the fire extinguisher 1B is carried on the two-wheeled vehicle 52 in the embodiment, a vehicle is not limited to the two-wheeled vehicle 52. The vehicle may be any movable body as long as it can carry and move, including a four-wheeled vehicle such as a fire engine, a dolly, or a cart, or three-wheeled vehicle, or an air vehicle such as a helicopter or airplane, for example.

Figure 41:
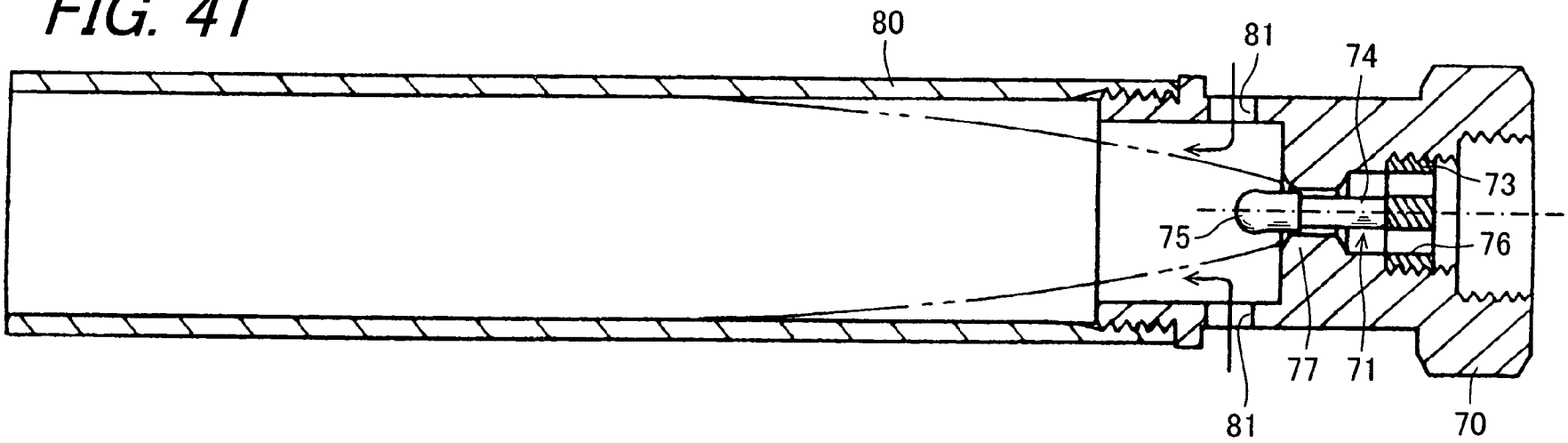
FIG. 41 is an enlarged view showing a spray nozzle 29C of the discharge means 7 provided in a fire extinguisher according to an eighth embodiment of the invention.

FIG. 41 is an enlarged view showing a spray nozzle 29C of the discharge means 7 provided in the fire extinguisher according to an eighth embodiment of the invention. The spray nozzle 29C according to the present embodiment is similar to the above-described spray nozzle 29 according to the first embodiment. The housing body 25*a* of the discharge means 7 has its flange part 77 formed closer to an axially other end side than an axially one end, and has a radially-penetrating intake duct 81 formed between the axially one end and the flange part 77. A nozzle housing 70C is formed into a cylindrical shape of which length extends along an axis line thereof.

According to the spray nozzle 29C configured as above, the extinguishant passes through an inner area of the flange part 77 and thus flows down the spray nozzle 29C. At this time, the down flow of the extinguishant decreases the inner pressure of the spray nozzle 29C so that outside air is taken in through the intake duct 81. The air taken in and the extinguishant are mixed with each other and then discharged by foaming of the extinguishant (as drawn in two-dot chain lines in FIG. 41).

Figure 42:
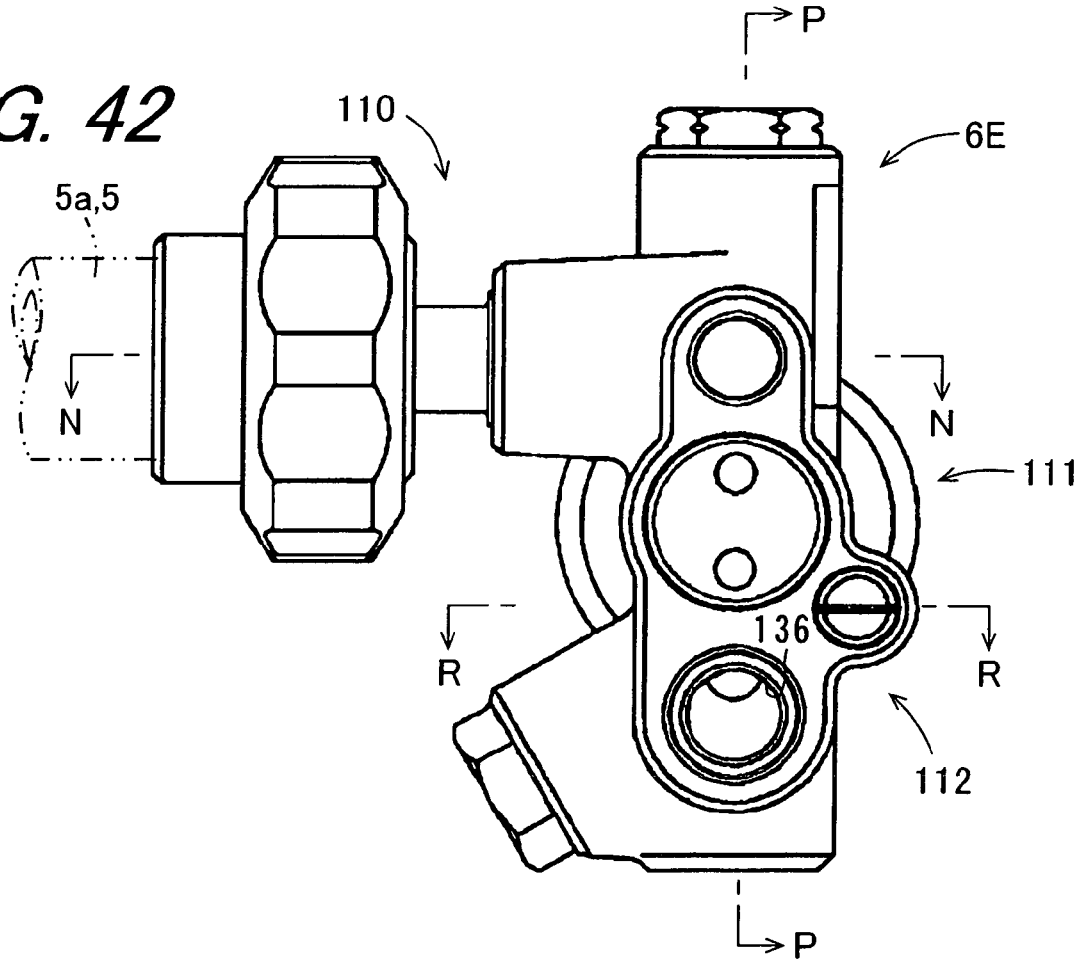
FIG. 42 is a plan view showing a pressure reducing valve 6E provided in a fire extinguisher according to ninth embodiment of the invention.
Figure 43:
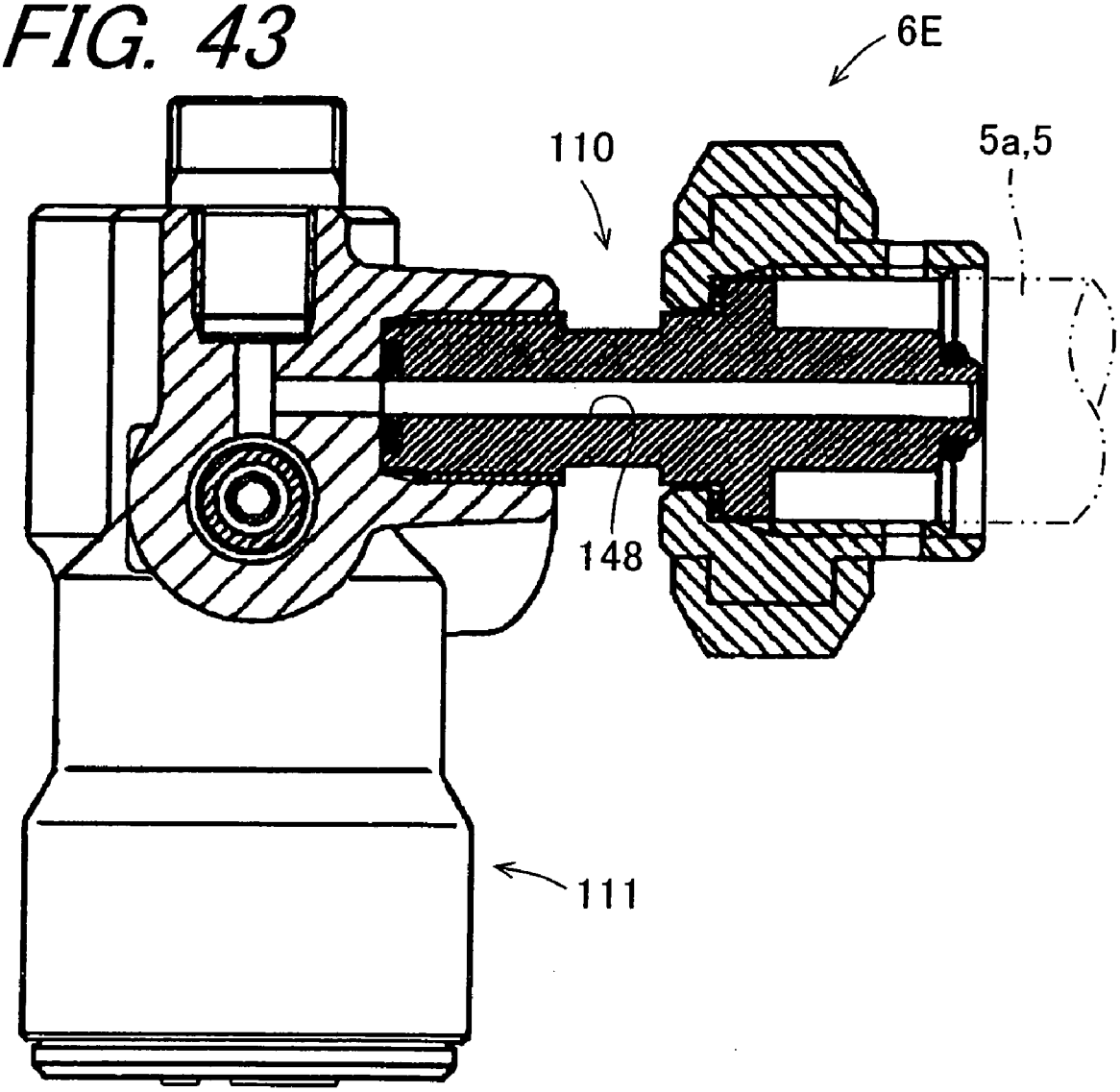
FIG. 43 is a sectional view showing a pressure reducing valve 6E taken on line N-N in FIG. 42.
Figure 44:
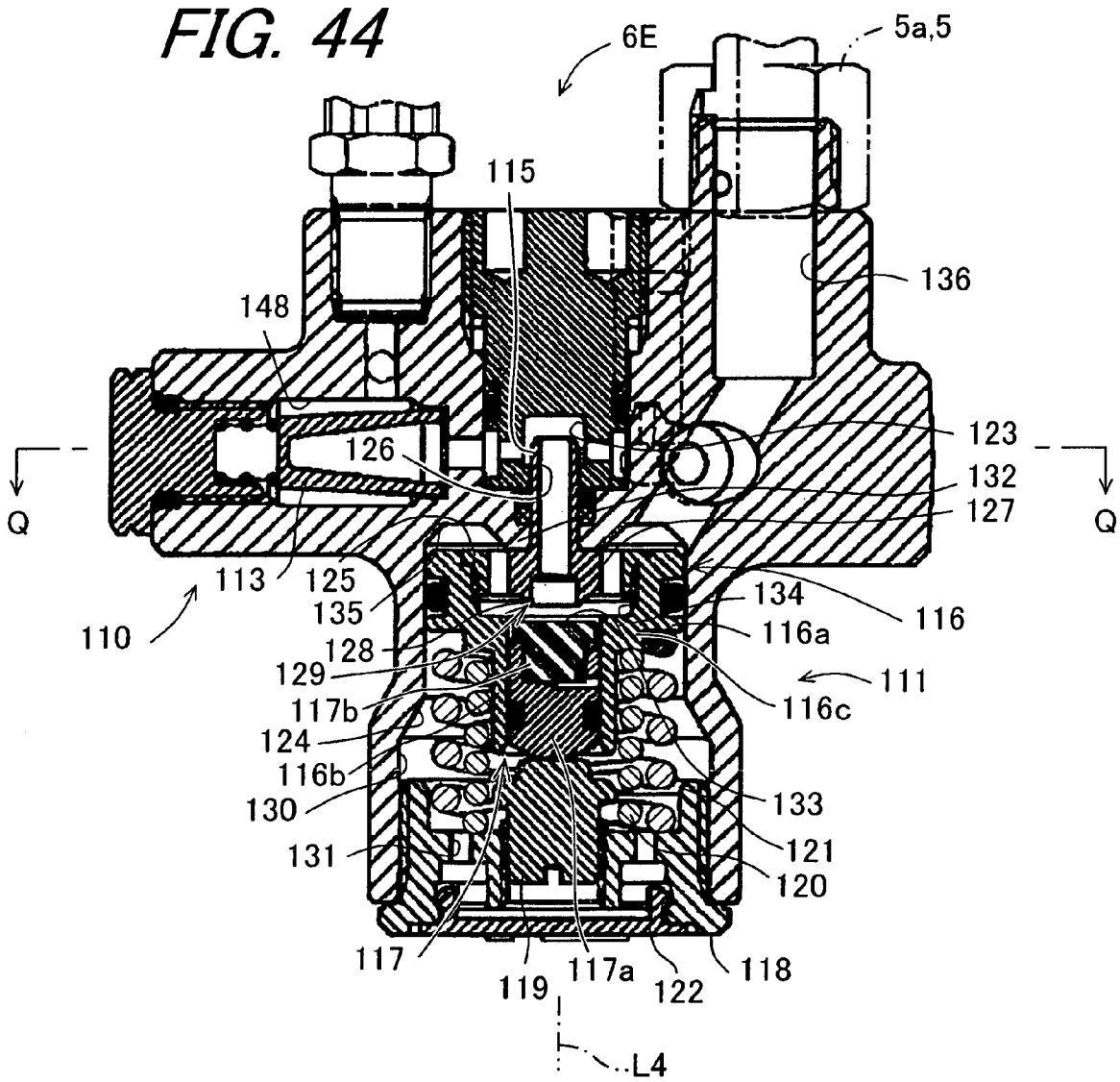
FIG. 44 is a sectional view showing the pressure reducing valve 6E taken on line P-P in FIG. 42.
Figure 45:
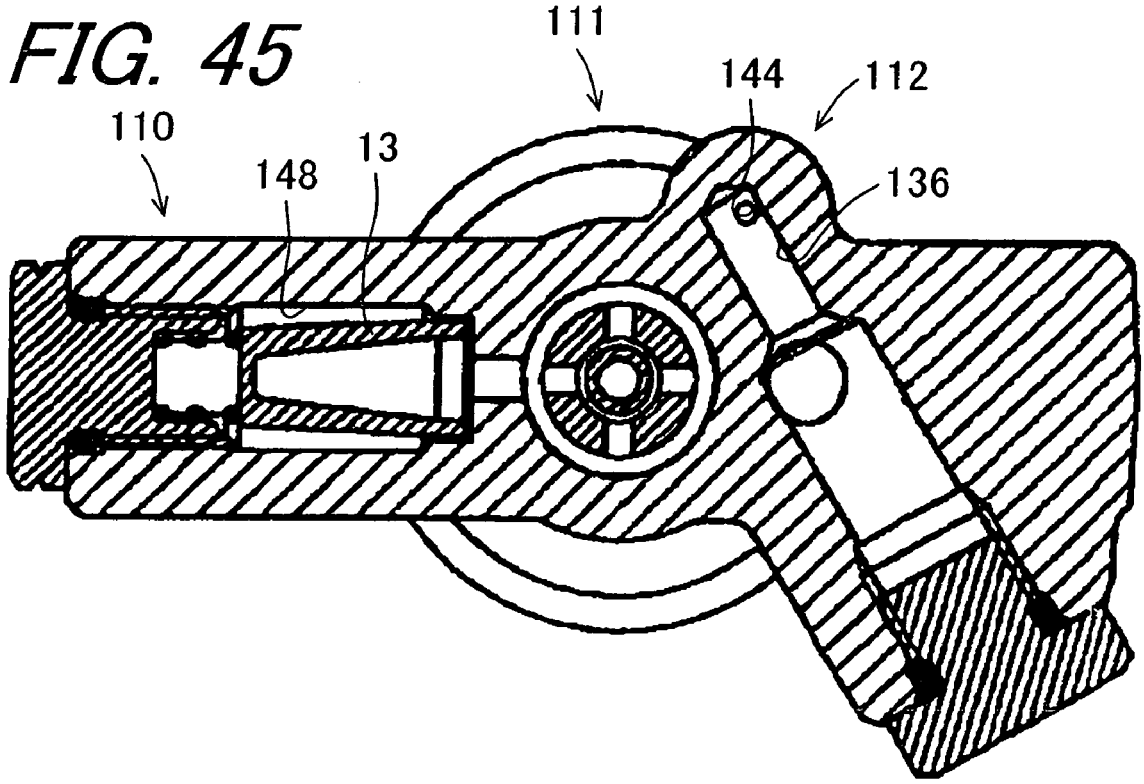
FIG. 45 is a sectional view showing the pressure reducing valve 6E taken on line Q-Q in FIG. 44.
Figure 46:
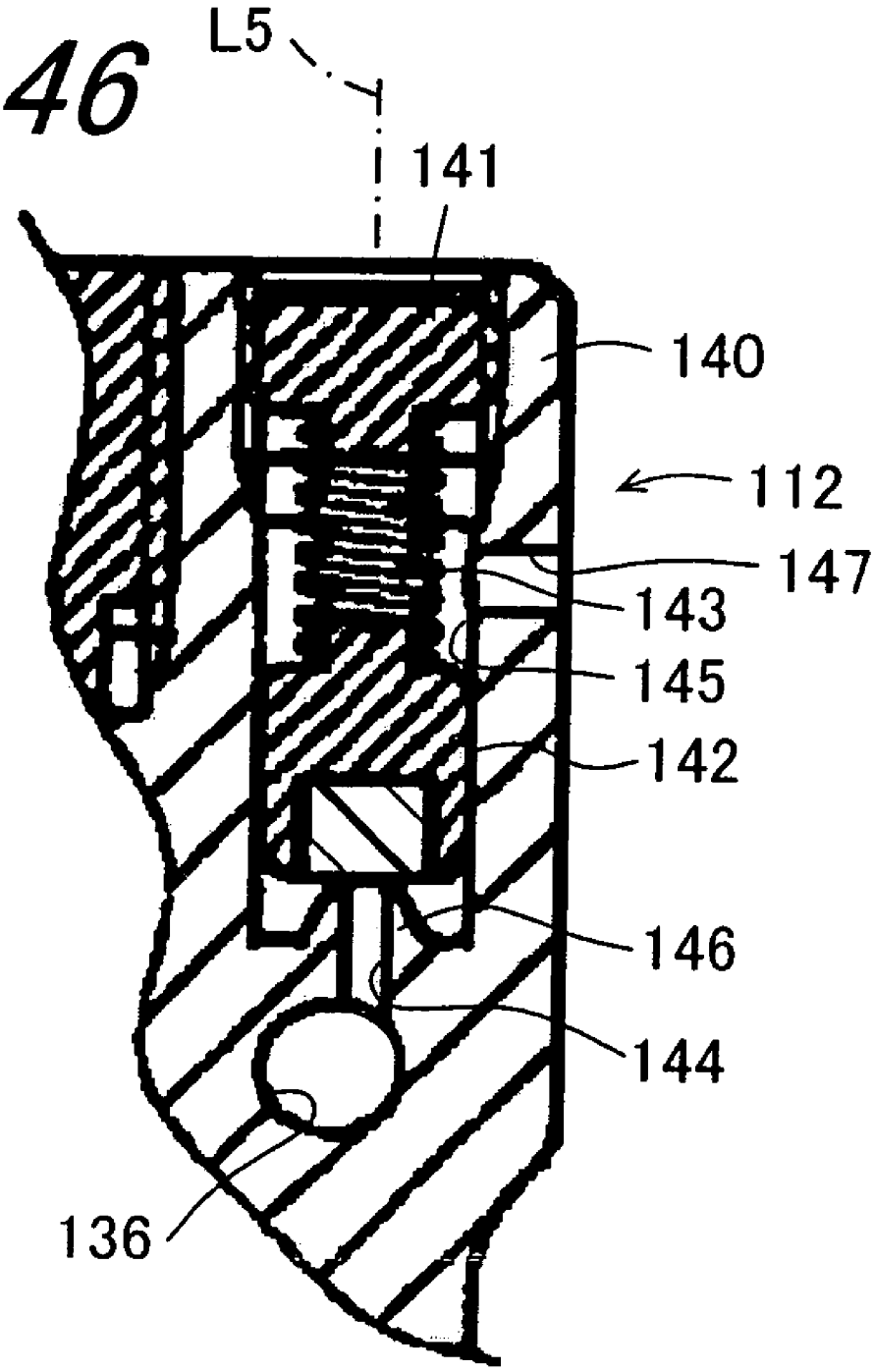
FIG. 46 is a partially sectional view showing the pressure reducing valve 6E taken on line R-R in FIG. 42.

FIG. 42 is a plan view showing a pressure reducing valve 6E provided in a fire extinguisher according to ninth embodiment of the invention. FIG. 43 is a sectional view showing a pressure reducing valve 6E taken on line N-N in FIG. 42. FIG. 44 is a sectional view showing the pressure reducing valve 6E taken on line P-P in FIG. 42. FIG. 45 is a sectional view showing the pressure reducing valve 6E taken on line Q-Q in FIG. 44. FIG. 46 is a partially sectional view showing the pressure reducing valve 6E taken on line R-R in FIG. 42. The pressure reducing valve 6E and the above-described pressure reducing valve 6 according to the first embodiment have substantially the same configurations with differences only in appearance and arrangement of respective configurations. Accordingly, in the pressure reducing valve 6E according to the embodiment, the same configurations as those in the above-described pressure reducing valve 6 according to the first embodiment are denoted by the same numerals so that descriptions thereof will be omitted.

Figure 47:
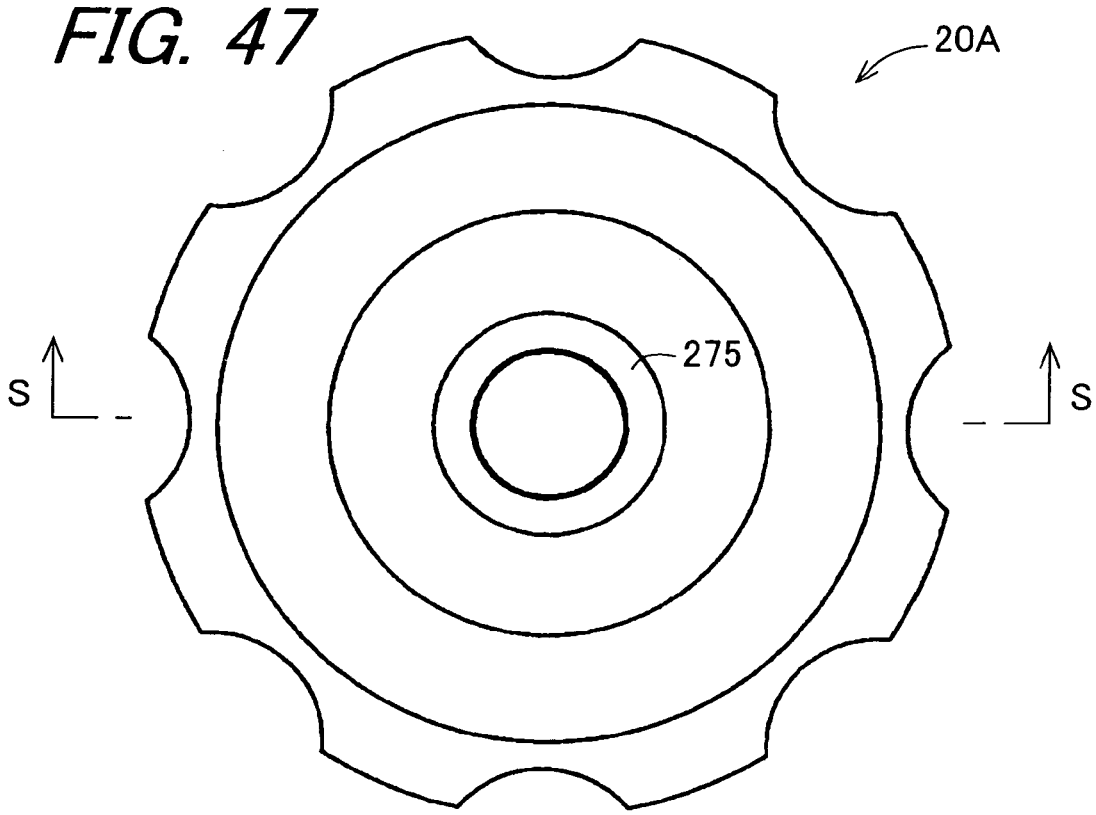
FIG. 47 is a plan view showing a configuration of a lid 20A of the extinguishant containers 3 and 4 provided in a fire extinguisher according to a tenth embodiment of the invention.
Figure 48:
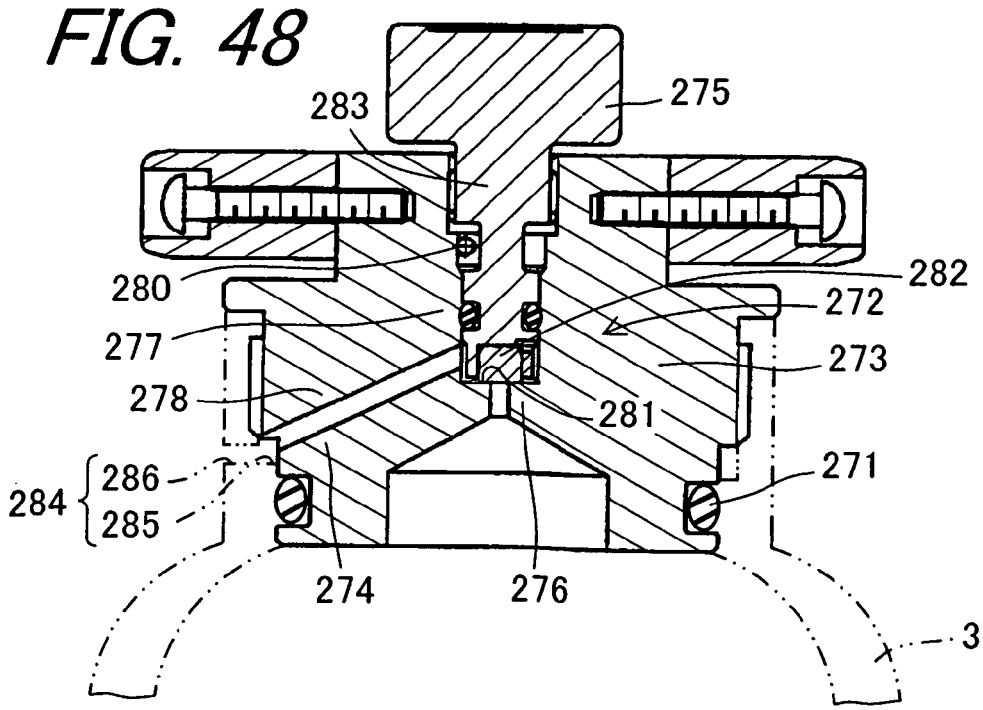
FIG. 48 is a sectional view taken on line S-S in FIG. 47.

FIG. 47 is a plan view showing a configuration of a lid 20A of the extinguishant containers 3 and 4 provided in a fire extinguisher according to a tenth embodiment of the invention. FIG. 48 is a sectional view taken on line S-S in FIG. 47. The fire extinguisher according to the present embodiment is similar to the above-described fire extinguisher 1 according to the first embodiment. In the present embodiment, the above-described lid 20 is replaced by the lid 20A described as follows.

The lids 20A are detachably formed on the openings at the axially one ends of the extinguishant containers 3 and 4, and when the lids 20A are removed from the extinguishant containers 3 and 4, the openings of the extinguishant containers 3 and 4 are opened. Further, when the lids 20A are attached to the extinguishant containers 3 and 4, the openings of the extinguishant containers 3 and 4 are closed. The lids 20A are formed into a cylindrical column shape on which an outer screw is formed, and threaded to inner screws formed in the openings of the extinguishant containers 3 and 4, thereby being attached to the extinguishant containers 3 and 4. The lids 20A are formed into a substantially cylindrical column shape and have axially one end surfaces opposite to inner spaces of the extinguishant container 3 and 4 and outer peripheral surfaces opposite to the openings of the extinguishant containers 3 and 4 when threaded into the extinguishant containers 3 and 4. On outer peripheries of the lids 20A threaded into the extinguishant containers 3 and 4, sealing members 271 are formed which fill gaps between the extinguishant containers 3 and 4 and the lids 20A.

In the lid 20A, a depressurizing valve 272 is formed which has a depressurizing function of reducing the pressure inside the extinguishant containers 3 and 4 to the atmospheric pressure. The lid 20A includes a communication duct 274 which is formed in a lid body 273, and a depressurizing valve element 275 which is formed separately from the lid body 273. The communication duct 274 forms a communication hole which extends from an axially one end surface to an outer peripheral surface through an inner area of the lid 20A. The communication duct 274 has a first part 276 which forms a longitudinal hole which extends along a central axis line of the lid 20A from the axially one end surface; a second part 277 which continues into the first part 276 and forms a housing space for housing the depressurizing valve element 275; and a third part 278 which forms a transverse hole which continues into the second part 277, extends in a radial direction of the lid 20A, and is open on the outer peripheral surface of the lid 20A. The housing space is formed to have an axially sectional area larger than that of the longitudinal hole. In a connection part between the first part 276 and the second part 277, a seat surface 281 is formed on which the depressurizing valve element 275 is seated.

The depressurizing valve element 275 is formed so as to be axially displaceable and contacts the seat surface 281 to thereby close the longitudinal hole formed in the first part 276. The compressed air inside the extinguishant containers 3 and 4 is thus prevented from passing through the communication duct 274. Further, when the depressurizing valve element 275 moves away from the seat surface 281, the sealing of the communication duct 274 is released so that the compressed air inside the extinguishant containers 3 and 4 is allowed to pass through the communication duct 274.

The depressurizing valve element 275 is elastic and composed of a contact member 282 which faces the seat surface 281, and a holding member 283 which holds the contact member 282. The holding member 283 is threaded to an inner screw formed in the lid body 273. The holding member 283 moves the contact member 282 toward the seat surface 281 by spirally advancing and moves the contact member 282 away from the seat surface 281 by spirally retreating. Further, the holding member 283 is stopped by a pin member 280 provided in the lid body 273 whereby a displaceable range is limited.

Further, in each of the extinguishant containers 3 and 4, a depressurization space 284 is formed for depressurization. The depressurization space 284 is composed of a ring-shaped space 285 and an exit hole 286. The ring-shaped space 285 is a space which faces an opening of the transverse hole formed in the lid 20A and is fitted thereto in a thickness direction and which is formed into a circular ring in a state where the lid 20A is threaded. The exit hole 286 is a space which continues into the ring-shaped space 285 and penetrates each of the extinguishant containers 3 and 4 in a thickness direction thereof.

When the holding member 283 is spirally retreated to move the contact member 282 away from the seat surface 281 in a state where the compressed air inside the extinguishant containers 3 and 4 has higher pressure than the atmospheric pressure, the compressed air inside the extinguishant containers 3 and 4 sequentially passes through the communication duct 274 and the depressurization spaces 284 of the extinguishant containers 3 and 4 to be then ejected to outside of the extinguishant containers 3 and 4 by means of the pressure difference from the atmospheric pressure. Further, when the pressure inside the extinguishant containers 3 and 4 reaches the atmospheric pressure, the air stops to be ejected from the extinguishant containers 3 and 4. Moreover, even when receiving the pressure in a direction of moving away from the lid body 273 with the aid of the compressed air, the depressurizing valve element 275 is stopped by the pin member, thus being prevented from coming off the lid body 273 upon depressurizing.

According to the embodiment, the depressurizing valve 272 is used in a case of adding the extinguishant to the extinguishant containers 3 and 4 where a part of the extinguishant inside the extinguishant containers 3 and 4 remains.

In this case, the depressurizing valve 272 causes the compressed air inside the extinguishant containers 3 and 4 to be discharged to outside of the extinguishant containers 3 and 4 in a state where the pressure-source fluid tube 5 is closed by the on-off valve 9. And after the pressure inside the extinguishant containers 3 and 4 is reduced to the atmospheric pressure, the lids 20A are removed from the extinguishant containers 3 and 4 which are then refilled with the extinguishant. Next, the extinguishant containers 3 and 4 are closed by the lids 20A. The extinguishant containers 3 and 4 can be thus refilled with the extinguishant without having the remaining extinguishant discharged, thus allowing for improvement of the convenience.

Figure 49:
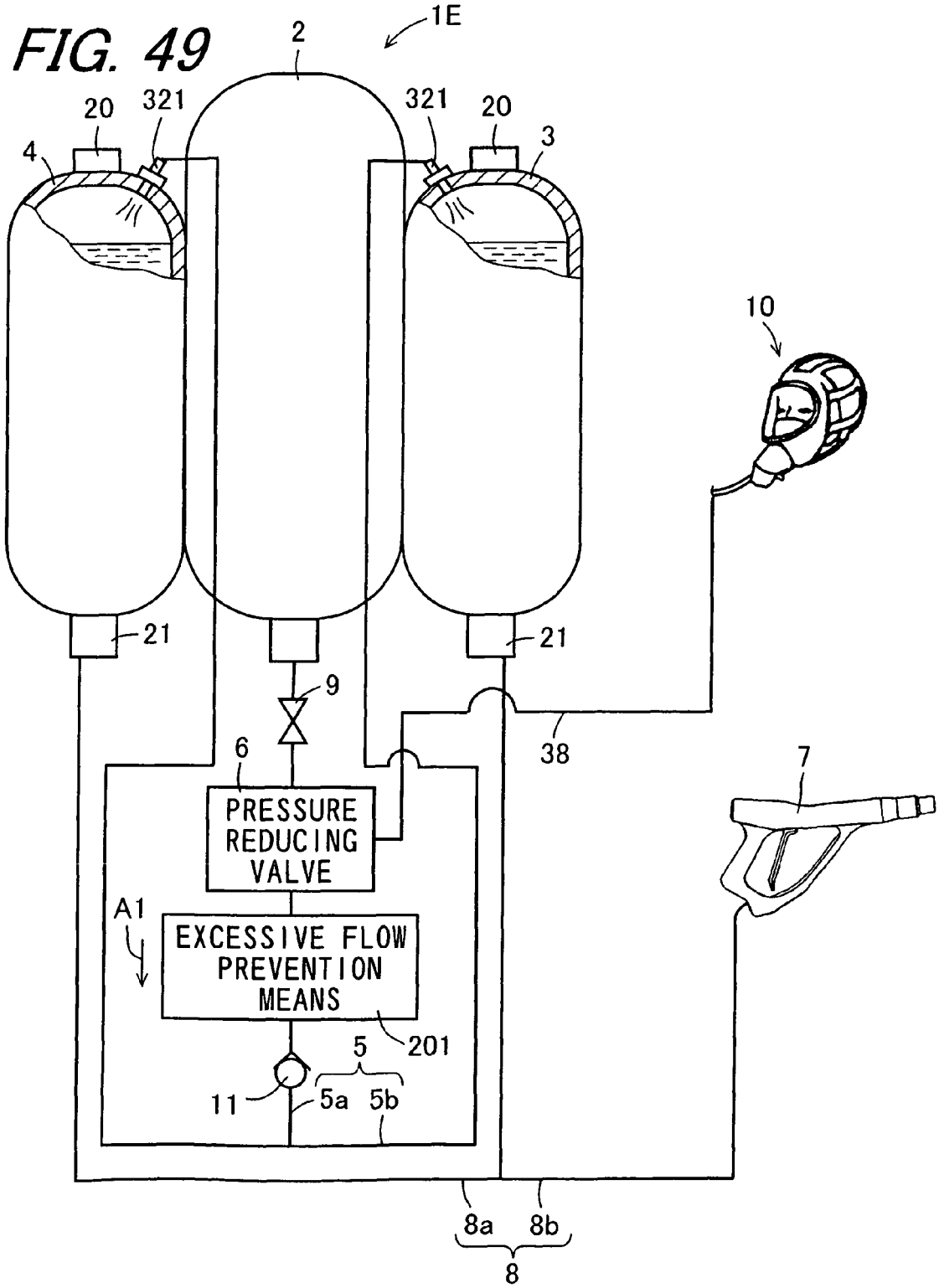
FIG. 49 is a system diagram schematically showing a configuration of a fire extinguisher 1E according to an eleventh embodiment of the invention.

FIG. 49 is a system diagram schematically showing a configuration of a fire extinguisher 1E according to an eleventh embodiment of the invention. The fire extinguisher 1E according to the present embodiment is similar to the above-described fire extinguisher 1C according to the third embodiment. Although the compressed air is supplied to a position away from the openings of the extinguishant containers 3 and 4 by use of the siphons 22 disposed in the inner spaces of the extinguishant containers 3 and 4 in the above-described third embodiment, the compressed air may be introduced into the inner spaces of the extinguishant containers 3 and 4 by connections members 321 which are provided respectively on the extinguishant containers 3 and 4, in the present embodiment.

The connection members 321 are respectively disposed in the vicinity of the lids 20 of the extinguishant containers 3 and 4. The connection members 321 are connected to the extinguishant containers 3 and 4 by welding and form connection ports which are communicated with the inner spaces of the extinguishant containers 3 and 4. The connection members 321 are detachably connected to the ends of the second pressure-source fluid tube portions 5*b*, respectively. When the connection members 321 are connected to the second pressure-source fluid tube portion 5*b*, the compressed air flowing through the pressure-source fluid tube 5 is supplied into the extinguishant containers 3 and 4 through the connection ports. As a result, it is possible to obtain the same effects as those obtained in the case where the siphons 22 are provided.

The connection members 321 are disposed on upper ends of the extinguishant containers 3 and 4 so as to be positioned closer to the pressure-source fluid container 2, being thereby prevented from horizontally protruding from the frame 45. The connection members 321 can be thus prevented from colliding against obstacles in the fire location, being thereby prevented from breaking off the extinguishant containers 3 and 4. Further, the pressure-source fluid tube 5 can be made to pass through a space between the two extinguishant containers 3 and 4, and the pressure-source fluid tube 5 can be thus prevented from extending to outside of the extinguishant containers 3 and 4, being thereby prevented from being stuck by the obstacles. Moreover, also by setting the connection members 321 so as to have upper parts thereof lower than upper parts of the frame 45, the connection members 321 can be prevented from breaking off the extinguishant containers 3 and 4.

Further, in the case of injecting the condensed liquid of the extinguishant and water to the extinguishant containers 3 and 4 by use of a hose, etc., the connection members 321 can eliminate obstacles so that the hose can be easily put into the extinguishant containers 3 and 4. Moreover, when the siphon is present, the hose and the siphon may contact with each other, which may result in breakage of the siphon, but elimination of the siphon as in the present embodiment allows the fire extinguisher to be prevented from damages caused by the breakage of the siphon.

In addition, although the assembled tubing 21 needs to be provided in each of the openings of the extinguishant containers 3 and 4 in the case where the siphon is provided, the assembled tubing 21 can be omitted by providing the extinguishant containers 3 and 4 with inlets for the compressed air separately from the openings of the extinguishant containers 3 and 4, so that a general-purpose component can be used, thus allowing for a lower production cost.

Further, the connection member 321 and the pressure-source fluid tube portion 5*b* are formed so as to be detachable, with the result that the extinguishant containers 3 and 4 having the extinguishant therein used up can be detached from the fire extinguisher, followed by newly mounting thereon the extinguishant containers 3 and 4 which are filled with the extinguishant. This can eliminate the need for an operation of refilling the extinguishant containers 3 and 4 with the extinguishant in the fire location, etc., with the result that the fire fighting operation can restart in a short time.

The respective embodiments described above are mere examples of the invention, and constitutions may be changed within the range of the invention. For example, although the compressed air is used as the pressure-source fluid in the respective embodiments described above, the pressure-source fluid is not limited to the compressed air in the case where no breathing apparatus 10 is provided. For example, gas such as nitrogen may be used, and liquid may also be used. Moreover, as the extinguishant, any liquid having flame retardance may be used and for example, water may be used, or fire-extinguishing foam and reinforcing agent may be used.

Although the pressure reducing valves 6 and 6E are used as the pressure reducing means, the pressure reducing means is not limited to such a configuration capable of reducing the pressure to constant pressure. For example, the pressure may be reduced by forming an orifice in the pressure-source fluid tube 5, and any means may be used as long as it can reduce the pressure of the compressed air. Similarly, the back flow prevention valves 11 and 11A, the down flow prevention valves 12 and 12A, the excessive flow prevention means 201, and the on-off valve 9 are not limited to the configurations as above and may have configurations which can achieve respective functions.

Further, the hand gun serving as the discharge means 7 has ring-shaped coupling portions at one or more positions, for example, two positions. The hand gun can be attached to and detached from a pelvic band by use of coupling metal tools such as a karabiner. The respective coupling portions are arranged at positions away from the spray nozzle, and coupling parts are arranged so that the spray nozzle faces downward in the state where the hand gun is attached to the pelvic band. The first coupling part is disposed at a position which is located away from the spray nozzle in a direction opposite to the spray direction. Further, the second coupling part is disposed closer to the supply tube 27.

When the hand gun is attached to the pelvic band, the wearer does not need to always grip the hand gun with both hands and is therefore capable of smoothly carrying out operations in the fire location. Moreover, the wearer can detach the hand gun from the pelvic band and support the hand gun with both hands to spray the extinguishant to the to-be-extinguished object.

On the frame 45, cushioning members are disposed at positions with which the pressure-source fluid container 2 and the extinguishant containers 3 and 4 will be in contact. Impacts to be applied to the wearer can be thus decreased even if the pressure-source fluid container 2 and the extinguishant containers 3 and 4 move upward and downward relative to the frame 45 when being carried.

The invention may be embodied in other various forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

Industrial Applicability

According to the invention, the compressed pressure-source fluid enables the extinguishant retained in the extinguishant container to be ejected, with the result that the extinguishant can be ejected with the aid of a small amount of the compressed pressure-source fluid, that is not like the two-fluid fire extinguisher of the related art where a large amount of air is used for spraying water. The volume of the compressed fluid which is to be retained in the pressure-source fluid container can be therefore smaller than that in the two-fluid fire extinguisher of the related art, with the result that the pressure-source fluid container can be smaller in weight.

Furthermore, the pressure-source fluid is depressurized by the pressure reducing means, and the pressure-source fluid thus depressurized is then led to the extinguishant container through the pressure-source fluid tube. The pressure of the pressure-source fluid led to the extinguishant container can be thus prevented from fluctuating, with the result that the discharge amount of the extinguishant discharged from the discharge means can be prevented from fluctuating. The prevention of fluctuation in the discharge amount of the extinguishant enabled by leading the depressurized pressure-source fluid to the extinguishant container as described above allows the extinguishant to be stably discharged without depending on the length of discharge time. When the pressure-source fluid is led after depressurized, the extinguishant container does not need higher pressure resistance, and the wall of the extinguishant container may be thinner than those in the fire extinguishers of the first and second related arts. The weight of the fire extinguisher can be therefore reduced.

Further, according to the invention, the flow volume of the extinguishant ejected from the extinguishant container to the extinguishant tube can be constant by virtue of the pressure control valve. The discharge amount of the extinguishant discharged from the discharge means through the extinguishant tube can be therefore maintained constant. In the fire extinguishers of the first and second related arts, the extinguisher is discharged based on the inner pressure of the extinguisher container and therefore, the discharge amount depends on an amount of the extinguishant retained, in other words, the length of discharge time. In the invention, the extinguishant is ejected with the aid of the pressure-source fluid of which pressure is maintained constant, so that the constant amount of the extinguishant can be discharged without depending on the length of discharge time. By maintaining the discharge amount of the extinguishant as described above, it is possible to attain a fire extinguisher having stable fire-extinguishing ability, of which discharge amount of the extinguishant does not depend on the length of discharge time.

Further, according to the invention, the gas supply means can supply the wearer with the mixture gas retained in the pressure-source fluid container which gas contains at least oxygen. When the mixture gas for ejecting the extinguishant from the extinguishant container is supplied to the wearer as described above, there is no need to newly provide a container for retaining the mixture gas only for the above gas supply. This allows for the fire extinction and the gas supply, resulting in a lighter-weight fire extinguisher.

Further, in the invention, the pressure-source fluid is depressurized and led from the pressure-source fluid container to the extinguishant container, with the result that the amount of the mixture gas led from the pressure-source fluid container to the extinguishant container is smaller than that in the fire extinguisher of the first related art. The gas supply means can therefore supply the wearer with a larger amount of the mixture gas as compared to the fire extinguisher of the first related art. This enables the wearer to stay longer in a fire location, etc., to battle the fire without worrying about the lack of oxygen as compared to the case of using the fire extinguisher of the first related art.

Further, according to the invention, the back flow prevention means can prevent the extinguishant from flowing backward to the pressure reducing means. The extinguishant can be thus prevented from being led by the gas supply means and ejected from the gas supply means. The wearer can therefore feel safe to breathe by use of the gas supply means. It is thus possible to attain a fire extinguisher which can supply such mixture gas that the wearer can feel safe to breathe and which can discharge the extinguishant from the discharge means.

Further, according to the invention, the down flow prevention means prevents the pressure-source fluid led to the extinguisher container from flowing down the extinguisher tube and thus being discharged from the discharge means when the extinguisher dischargeable from the extinguisher container is used up. If the pressure-source fluid continues to be discharged after the extinguishant is used up, the pressure-source fluid in the pressure-source fluid container is wasted. When the pressure-source fluid is prevented from being discharged by use of the down flow prevention means, the waste of the pressure-source fluid as above can be cut down.

As compared to the case where no down flow prevention means is provided, a length of time for the mixture gas to be supplied from the gas supply means can be increased by cutting down the waste of the pressure-source fluid after the extinguishant is used up in the case where the gas supply means is provided. It is therefore possible to stay in the fire location longer as compared to the case where no down flow prevention means is provided.

Further, according to the invention, in the case where the extinguisher dischargeable from the extinguisher container is used up, the pressure-source fluid is ejected from the extinguishant container, thus leading to an increase in the flow volume of the pressure-source fluid flowing down the pressure-source fluid tube. In view of this point, the excessive flow prevention means intervenes in the pressure-source fluid tube. The excessive flow prevention means prevents the pressure-source fluid from flowing down the pressure-source fluid tube when the flow volume of the pressure-source fluid flowing down the pressure-source fluid tube reaches the predetermined set flow volume or more. The waste of the pressure-source fluid can be thus cut down.

As compared to the case where no excessive flow prevention means is provided, a length of time for the mixture gas to be supplied from the gas supply means can be increased by cutting down the waste of the pressure-source fluid after the extinguishant is used up in the case where the gas supply means is provided. It is therefore possible to stay in the fire location longer as compared to the case where no excessive flow prevention means is provided.

Further, according to the invention, the aqueous solution having the resin dissolved therein is used as the extinguishant, which resin becomes higher in viscosity as its temperature rises, with the result that the extinguishant attached to the to-be-extinguished object can be therefore prevented from flowing etc., and thus being spread out, so that a larger amount of the extinguishant can stay around the to-be-extinguished object as compared to water. When the large amount of the extinguishant stays, an increased amount of heat will be absorbed, thus allowing for enhancement of the cooling effect for the to-be-extinguished object. The fire-extinguishing performance can be therefore higher than those of the fire extinguishers of the first and second related arts. When the fire-extinguishing performance is enhanced, the fire can be put out with use of a small amount of the extinguishant, with the result that the volume of the extinguishant to be retained in the extinguishant container can be smaller. This allows for a decrease in the weight of the extinguishant container and thus a decrease in the weight of the fire extinguisher. Moreover, the low viscosity of the extinguishant allows for a decrease in the pressure required for discharging the extinguishant which flows down the extinguishant tube, with the result that the pressure of the pressure-source fluid to be led to the extinguishant container can be reduced. The extinguishant container is therefore not required to have higher pressure resistance and can be thinner-walled.

Further, according to the invention, the frame can hold the pressure-source fluid container and the extinguishant container upright. The pressure-source fluid container and the extinguishant container will therefore not be laid on the ground, for example, and the surfaces of these containers can be prevented from being damaged. The prevention of such damages can inhibit the pressure-source fluid container and the extinguishant container from bursting.

The invention claimed is:

1. A fire extinguisher comprising:

a pressure-source fluid container to retain compressed pressure-source fluid;

an extinguishant container to retain extinguishant;

a pressure-source fluid tube connected to the pressure-source fluid container and the extinguishant container, to lead the pressure-source fluid retained in the pressure-source container to the extinguishant container;

a pressure reducing device intervening in the pressure-source fluid tube, to reduce pressure of pressure-source fluid flowing down the pressure-source fluid tube;

a discharge device to discharge the extinguishant retained in the extinguishant container;

an extinguishant tube connected to the extinguishant container and the discharge device, to lead the extinguishant retained in the extinguishant container to the discharge device;

a down flow prevention device, intervening in the extinguishant tube, to prevent the pressure-source fluid from flowing down the extinguishant tube; and a gas supply tube connected to the pressure reducing device and a breathing apparatus.

2. The fire extinguisher of claim 1, wherein the pressure reducing device is a pressure control valve to reduce the pressure of the pressure-source fluid and maintaining the pressure constant.

3. The fire extinguisher of claim 2, wherein the pressure-source fluid retained in the pressure-source fluid container is a mixture gas containing at least $O_2$.

4. The fire extinguisher of claim 2, further comprising an excessive flow prevention device which intervenes in the pressure-source fluid tube and prevents the pressure-source fluid from flowing down the pressure-source fluid tube when a flow volume of the pressure-source fluid flowing down the pressure-source tube reaches a predetermined flow volume or more.

5. The fire extinguisher of claim 2, wherein the extinguishant is a flame retardant aqueous solution having a resin dissolved, which resin becomes higher in viscosity as a temperature rises.

6. The fire extinguisher of claim 2, further comprising a frame for arranging the pressure-source fluid container and the extinguishant container, wherein the frame is configured to hold the pressure-source fluid container and the extinguishant container upright.

7. The fire extinguisher of claim 1, wherein the pressure-source fluid retained in the pressure-source fluid container is a mixture gas containing at least $O_2$.

8. The fire extinguisher of claim 7, wherein a back flow prevention device which intervenes in the pressure-source fluid tube and prevents the extinguishant from flowing back in the pressure-source fluid tube from the extinguishant container toward the pressure-source container, is provided downstream of the pressure reducing device in a direction that the pressure-source fluid flows down.

9. The fire extinguisher of claim 8, further comprising an excessive flow prevention device which intervenes in the pressure-source fluid tube and prevents the pressure-source fluid from flowing down the pressure-source fluid tube when a flow volume of the pressure-source fluid flowing down the pressure-source tube reaches a predetermined flow volume or more.

10. The fire extinguisher of claim 8, wherein the extinguishant is a flame retardant aqueous solution having a resin dissolved, which resin becomes higher in viscosity as a temperature rises.

11. The fire extinguisher of claim 7, further comprising an excessive flow prevention device which intervenes in the pressure-source fluid tube and prevents the pressure-source fluid from flowing down the pressure-source fluid tube when a flow volume of the pressure-source fluid flowing down the pressure-source tube reaches a predetermined flow volume or more.

12. The fire extinguisher of claim 7, wherein the extinguishant is a flame retardant aqueous solution having a resin dissolved, which resin becomes higher in viscosity as a temperature rises.

13. The fire extinguisher of claim 1, further comprising excessive flow prevention device which intervenes in the pressure-source fluid tube and prevents the pressure-source fluid from flowing down the pressure-source fluid tube when a flow volume of the pressure-source fluid flowing down the pressure-source tube reaches a predetermined flow volume or more.

14. The fire extinguisher of claim 1, wherein the extinguishant is a flame retardant aqueous solution having a resin dissolved, which resin becomes higher in viscosity as a temperature rises.

15. The fire extinguisher of claim 1, further comprising a frame to arrange the pressure-source fluid container and the extinguishant container, wherein the frame is configured to hold the pressure-source fluid container and the extinguishant container upright.

16. The fire extinguisher of claim 1, wherein the extinguishant is a flame retardant aqueous solution having a resin dissolved, which resin becomes higher in viscosity as a temperature rises.

17. The fire extinguisher of claim 1, wherein the down flow prevention device is arranged in the extinguishment container.

18. The fire extinguisher of claim 1, wherein the down flow prevention device is configured to prevent pressure-source fluid transferred to the extinguishant container from the pressure-source fluid container from flowing down the extinguishant tube.

* * * * *